US008614656B2

(12) United States Patent
Hashimoto et al.

(10) Patent No.: US 8,614,656 B2
(45) Date of Patent: Dec. 24, 2013

(54) DISPLAY APPARATUS, AND DRIVING CIRCUIT FOR THE SAME

(75) Inventors: Yoshiharu Hashimoto, Kanagawa (JP); Teru Yoneyama, Kanagawa (JP)

(73) Assignee: Renesas Electronics Corporation, Kanagawa (JP)

( * ) Notice: Subject to any disclaimer, the term of this patent is extended or adjusted under 35 U.S.C. 154(b) by 1583 days.

(21) Appl. No.: 11/515,889

(22) Filed: Sep. 6, 2006

(65) Prior Publication Data

US 2007/0001939 A1 Jan. 4, 2007

Related U.S. Application Data

(63) Continuation-in-part of application No. 11/045,608, filed on Jan. 31, 2005, now Pat. No. 7,595,776.

(30) Foreign Application Priority Data

Jan. 30, 2004 (JP) ..... 2004-022974
Sep. 28, 2004 (JP) ..... 2004-282758

(51) Int. Cl.
*G09G 3/30* (2006.01)

(52) U.S. Cl.
USPC ..... 345/77; 345/76; 345/79

(58) Field of Classification Search
USPC ..... 345/76–83, 87–104; 315/169.3
See application file for complete search history.

(56) References Cited

U.S. PATENT DOCUMENTS

| | | | | |
|---|---|---|---|---|
| 5,627,457 | A * | 5/1997 | Ishiyama et al. | 323/318 |
| 6,232,948 | B1 * | 5/2001 | Tsuchi | 345/99 |
| 7,050,028 | B2 | 5/2006 | Morita | |
| 7,158,156 | B2 | 1/2007 | Endou | |
| 7,187,375 | B2 | 3/2007 | Ha et al. | |
| 2002/0033786 | A1 * | 3/2002 | Akimoto et al. | 345/87 |
| 2002/0196214 | A1 | 12/2002 | Park et al. | |
| 2005/0200584 | A1 | 9/2005 | Kudo et al. | |

FOREIGN PATENT DOCUMENTS

| | | |
|---|---|---|
| JP | 2148687 | 6/1990 |
| JP | 2002517806 | 6/2002 |
| JP | 2003195812 | 7/2003 |
| JP | 2003223140 | 8/2003 |
| JP | 200599745 | 4/2005 |

* cited by examiner

*Primary Examiner* — Kenneth Bukowski
(74) *Attorney, Agent, or Firm* — Young & Thompson

(57) ABSTRACT

A drive circuit which outputs an output signal to an output terminal, includes a drive transistor configured to output a gradation current to the output terminal; a single differential amplifier; a resistance element connected with the drive transistor; and a plurality of switches. The plurality of switches are controlled such that a precharge voltage is outputted from the differential amplifier to the output terminal in a first period while blocking off an output from the drive transistor and such that a gradation current is outputted from the drive transistor to the output terminal in a second period after the first period.

20 Claims, 44 Drawing Sheets

Fig. 16

| GRADATION SETTING DATA | GAMMA |
|---|---|
| 0000 | 1.70 |
| 0001 | 1.75 |
| 0010 | 1.80 |
| 0011 | 1.85 |
| 0100 | 1.90 |
| 0101 | 1.95 |
| 0110 | 2.00 |
| 0111 | 2.05 |
| 1000 | 2.10 |
| 1001 | 2.15 |
| 1010 | 2.20 |
| 1011 | 2.25 |
| 1100 | 2.30 |
| 1101 | 2.35 |
| 1110 | 2.40 |
| 1111 | 2.45 |

SWITCHES 11-13, 17-18: TURNED OFF
SWITCHES 14-16: TURNED ON
OPERATE AS CONSTANT CURRENT SOURCE A

SWITCHES 11-13, 14-15: TURNED OFF
SWITCHES 16-18: TURNED ON
OPERATE AS CONSTANT CURRENT SOURCE B

SWITCHES 11-14: TURNED ON
SWITCHES 15-18: TURNED OFF
OPERATE AS VOLTAGE FOLLOWER

DISPLAY APPARATUS, AND DRIVING CIRCUIT FOR THE SAME

CROSS REFERENCE

This patent application is a continuation-in-part application of the U.S. patent application Ser. No. 11/045,608.

BACKGROUND OF THE INVENTION

1. Field of the Invention

The present invention relates to a display apparatus such as a flat-panel display apparatus, a driving circuit for the display apparatus, and a semiconductor device for the driving circuit.

2. Description of the Related Art

The importance of an apparatus to mediate a man or woman and a machine (man-machine interface) has been increased with the advance of computer technology. Especially, a display apparatus as one of the man-machine interfaces on the output side is required to have higher performance. The display apparatus displays data outputted from a computer for a man to visibly recognize the data. Various kinds of display apparatuses are commercially available. A typical display apparatus is a flat-panel display and is widespread.

The flat-panel display apparatus is exemplified by a liquid crystal display and an organic electro-luminescence display apparatus using organic electro-luminescence. The organic electro-luminescence display apparatus has a merit that the display panel is thinner compared with the liquid crystal display. Moreover, the organic electro-luminescence display apparatus is superior in a viewing angle characteristic.

A driving method of the flat-panel display apparatus, especially the organic electro-luminescence display apparatus is mainly classified into two. That is, one is a simple matrix type driving method and the other is an active matrix type driving method. The simple matrix type driving method is suitable for a small-size display apparatus such as a mobile terminal because the structure is simple. However, the method has a problem in a response speed. Therefore, it is not suitable for a large-size display such as a television screen. Thus, the active matrix type driving method is used for a television and a personal computer. As a technique applied to the active matrix type driving method, a TFT (Thin Film Transistor) active matrix method is widely known, in which TFT is used as a pixel. For example, a TFT active matrix method is disclosed in Japanese Laid Open Patent Application (JP-P2003-195812A). The TFT active matrix method is further classified into two. One is a voltage drive type, and the other is a current drive type.

FIG. 1 is a block diagram showing the circuit configuration of a conventional organic electro-luminescence display apparatus 100. As shown in FIG. 1, the display apparatus 100 includes a data line driving circuit 101, a scanning line driving circuit 102, a control circuit 103, and a display panel 104. The display panel 104 has a plurality of data lines 111 arranged in a column direction, i.e., a vertical direction. Each data line 111 is connected with the data line driving circuit 101. Similarly, the display panel 104 has a plurality of scanning lines 121 arranged in a row direction. Each scanning line 121 is connected with the scanning line driving circuit 102. In addition, the display panel 104 has a pixel 105 at each of intersections of the plurality of data lines 111 and the plurality of scanning lines 121.

The data line driving circuit 101 and the scanning line driving circuit 102 are connected with the control circuit 103. The data line driving circuit 101 supplies a voltage or current to each of the plurality of data lines 111 in response to a pixel control signal outputted from the control circuit 103. The scanning line driving circuit 102 supplies a voltage or current to each of the plurality of scanning lines 121 as well as the data line driving circuit 101 in response to the pixel control signal outputted from the control circuit 103.

The control circuit 103 controls the data line driving circuit 101 and the scanning line driving circuit 102. The control circuit 103 receives display data to be displayed on the display panel 104 and a control signal corresponding to the display data, and outputs the pixel control signal based on the display data and the control signal. The pixel control signal is to control the data line driving circuit 101 and the scanning line driving circuit 102. The display panel displays the display data as a display image by driving a light-emitting element of each pixel 105 based on the outputs of the data line driving circuit 101 and the scanning line driving circuit 102.

The display apparatus 100 shown in FIG. 1 is driven based on a sequential line driving and scanning method. The scanning line driving circuit 102 drives the plurality of scanning lines 121 in a predetermined order in response to a scan sync signal. The data line driving circuit 101 drives the plurality of data lines 111 in relation to the scanning line 121 selectively driven by the scanning line driving circuit 102 so that the pixel 105 displays the display data. The data line driving circuit 101 drives each data line 111 by dividing a period for displaying the display data (to be referred to as a data line drive period) into two periods, one being a first period to referred to as a precharge period and a second period to be referred to as an current drive period.

FIG. 2 is a circuit diagram of the pixel 105 of the display apparatus 100 in the active matrix type driving method. As shown in FIG. 2, the pixel 105 includes an electro-luminescent element 130 as a light-emitting element, a drive TFT 131, a switch 132, and a capacitor 135. The electro-luminescent element 130 emits light in accordance with an EL (Electro Luminescence) phenomenon. The drive TFT 131 is connected between the electro-luminescent element 130 and a ground potential GND. The source of the drive TFT 131 is connected with the ground potential GND. The switch 132 is provided for each pixel 105 which is arranged in each of the intersections of the data lines 111 and the scanning lines 121. The switch 132 is connected with the gate of the drive TFT 131 through a node 133. The capacitor 135 is a capacitive element. As shown in FIG. 2, the capacitor 135 is connected between the node 133 and the ground potential GND.

FIG. 3 is a block diagram showing the circuit configuration of the data line driving circuit 101. As shown in FIG. 3, the data line driving circuit 101 includes a shift register circuit 112, a data register circuit 113, a data latch circuit 114, a D/A conversion circuit 115, an input buffer circuit 116, a timing control circuit 117, and a reference current source 118. The data register circuit 113 is a memory circuit to store the display data. The data register circuit 113 stores the above-mentioned display data in synchronism with a signal outputted from the shift register circuit 112. The data latch circuit 114 reads out the display data stored in the data register circuit 113 in synchronism with a latch signal from the timing control circuit 117, and outputs the read data to the D/A conversion circuit 1. The D/A conversion circuit 115 generates a current to be outputted onto the data line based on the data from the data latch circuit 114.

The input buffer circuit 116 carries out bit inversion to the display data based on an inversion control signal in synchronism with a clock signal CLK and outputs the inverted result to the data register circuit 113. The timing control circuit 117 controls operation timings of the data latch circuit 114, the D/A conversion circuit 115, and the reference current source 118 in response to a horizontal sync signal STB in synchronism with the clock signal CLK. The reference current source 118 provides a reference current to the D/A conversion circuit 115. Therefore, in the data line driving circuit 101 shown in FIG. 3, the serial display data is converted into parallel display data through the operations of the shift register circuit 112 and the data register circuit 113. The parallel display data is outputted to the data latch circuit 114. The data latch circuit 114 latches the parallel display data in synchronism with the scanning of the scanning lines. The D/A conversion circuit 115 reads out the parallel display data latched by the data latch circuit 114 for each scanning line, and outputs the display data sequentially during a horizontal drive period.

FIG. 4 is a circuit diagram showing the circuit configuration of the D/A conversion circuit 115. As shown in FIG. 4, the D/A conversion circuit 115 includes a converter circuit 151 and a precharge circuit 152 for every one or more data lines. The converter circuit 151 carries out D/A conversion of a plurality of reference currents weighted in a binary manner by using the display data to generate gradation currents for the display data. The precharge circuit 152 includes a quasi-addition circuit 153, a voltage driver 154, and switches 155, 156, and 157. The precharge circuit 152 generates a gradation voltage adaptive for the input impedance characteristic of the pixel 105 based on the gradation current from the converter circuit 151 by the quasi-addition circuit 153 and the voltage driver 154 which have the same impedance characteristic as the input impedance characteristic of the pixel 105 shown in FIG. 2. In addition, the precharge circuit 152 outputs a gradation voltage and gradation current to carry out the voltage drive and current drive of the data line in the order of the precharge period and the current drive period in one horizontal drive period through switching of the switches 155, 156, and 157.

In the data line driving circuit 101, the data line drive period for the drive of the data line is divided into the two periods of the precharge period and the current drive period. In the precharge period, the data line driving circuit 101 drives the data line 111 by a voltage drive circuit with a high drive ability (Hereinafter, this drive is referred as a voltage drive). In the current drive period, the data line driving circuit 101 drives the data line 111 by a constant current source circuit in a current with a constant current value (Hereinafter, this drive is referred as a current drive). The data line driving circuit 101 outputs the gradation voltage in the precharge period to drive the data line 111 in the voltage drive. The capacitor 135 for each pixel 105 is charged up to a predetermined voltage in a short time with the outputted gradation voltage. In addition, the pixel 105 is driven in high accuracy by the gradation current outputted from the data line driving circuit 101 in the current drive period so as to achieve display with high accuracy.

In the conventional display apparatus 100, the display data is converted so as to be adaptive for a specific gamma characteristic by the driving circuit. For instance, when the display data from a CPU is of 6 bits, the display data is converted to have increased bits for producing the display data adaptive to the gamma characteristic. The conversion of the display data is carried out by the control circuit 103. In the above Japanese Laid Open Patent Application (JP-P2003-195812A), the control circuit 103 converts the display data to have 10 bits or more in accordance with a conversion table, and supplies the converted display data to the data line driving circuit 101. At this time, the data line driving circuit 101 is required for the D/A conversion circuit 115 to have the resolution of 10 bits or more to drive the data line based on the converted display data. The converter circuit 151 of the D/A conversion circuit 115 is provided with transistors which have a same channel length L but different channel widths W of $2^n$. Otherwise, the D/A conversion circuit 115 may be provided with transistors which have the same channel length L and the same channel width W and which are controlled in accordance with different reference currents of $2^n$. If the display data is of 10 bits, the circuit scale has to be large because the converter circuit 151 is provided with at least ten transistors. Especially, in the former configuration, since the channel width W is dependent on $2^n$, the chip area is enlarged very much. In addition, power consumption becomes large in an interface between the control circuit 103 and the data line driving circuit 101 because the number of bits is increased. Moreover, an output capacitance becomes large because the D/A conversion circuit 115 in the data line driving circuit 101 is provided with the plurality of transistors. Here, a current I, a drive voltage V, a capacitance C, and a driving time T satisfy the following relation:

$$I=CV/T$$

The time T is determined from the number of scanning lines and a frame frequency. Therefore, the current value is increased as the capacity increases. As a result, it is difficult to drive the data line in a low current level. A driving circuit with a small chip area is required for a display apparatus. In addition, a driving circuit in low power consumption is required for a display apparatus.

Moreover, a transparent substrate (for instance, a glass substrate) is used for the display panel 104 in the conventional display apparatus 100. When the display panel 104 is manufactured by using the glass substrate, a deviation in characteristics of the transistors formed on the glass substrate is ten times or more larger than that in characteristic of the transistors formed on a silicon substrate. Therefore, if the data line driving circuit is formed on the glass substrate, ununiform display tends to be generated easily. Thus, the data line driving circuit is preferably formed on the silicon substrate. Forming the data line driving circuit 101 on the silicon substrate, it is difficult that the quasi-addition circuit 153 included in the data line driving circuit 101 has the same characteristic as the pixel 105 formed on the glass substrate, resulting in decrease in the reliability of the circuit. Thus, a driving circuit for the display apparatus with high reliability is required.

Furthermore, when a switching is carried out from the voltage drive to the current drive, glitch is generated sometimes in the conventional display apparatus 100. The glitch causes lowering image quality, especially in a low brightness (low current region) because a voltage is drifted from a desired voltage, even if the voltage is precharged to a desired voltage at high speed by the voltage driver. Therefore, a display apparatus is demanded in which the image quality and reliability are improved, while restraining the generation of the glitch.

In conjunction with the above description, an EL display apparatus is disclosed in Japanese Laid Open Patent Application (JP-P2003-223140A). In this conventional example, the EL display apparatus includes an EL element. A drive circuit drives the EL element in current in accordance with a PAM method in correspondence to a gradation level of display data. A precharge circuit applies a precharge voltage corresponding to the gradation level before the drive circuit supplies the current to the EL element.

Also, an EL storage display apparatus is disclosed in Japanese Laid Open Patent Application (JP-A-Heisei 2-148687). In this conventional example, the EL storage display apparatus includes a brightness control circuit, an EL element, a plurality of memory elements provided for the EL element, and a current source connected with the EL element. A plurality of current control elements are respectively provided for the memory elements, and control a current supplied from the current source to the EL element based on signals stored in the memory elements. The signal indicating a brightness requested from the El element is supplied to the memory element.

Also, a current copy-type pixel is proposed in Japanese Laid Open Patent Application (JP-P2002-517806A). FIG. 39A is a circuit diagram showing the configuration of the current copy-type pixel. As shown in FIG. 39A, the pixel is composed of a light emitting element 261, a drive transistor 262, and switch transistors 263, 264, and 265 and a capacitance element 266. The light emitting element 261 emits light through the EL (Electro Luminescence) phenomenon and the brightness changes in accordance with a current value. However, in the current copy-type current drive method, since the magnitude of current supplied from a constant current circuit is especially small on the side of low brightness, a data line 205 and a pixel 206 cannot be driven within a predetermined drive period. For this reason, in Japanese Laid Open Patent Applications (JP-P2003-195812A and JP-P2005-099745A), a quasi transistor approximately equivalent to the drive transistor 262 is provided before the current drive transistor 262, and current is supplied to it. Then, the data line 205 and the pixel 6 are precharged in the voltage generated by the quasi transistor by a voltage follower having a high drive ability.

In a constant current circuit of Japanese Laid Open Patent Application (JP-P2005-099745A), a current value when the current value of the original current source is sampled by a circuit composed of a transistor and a capacitance element are supplied to the pixel. In either case, the data lines 205 and the pixels 206 are precharged by a voltage follower during a voltage precharge period before a current drive period of one horizontal period, and the data lines 205 and the pixels 6 are current driven with current of a current value determined in accordance with display data in the current drive period.

However, there are some problems in the conventional constant current circuit. In the constant current circuit of the Japanese Laid Open Patent Application (JP-P2003-195812A), a plurality of weighted constant current sources are provided. Therefore, there is possibility of loss of monotonous increase due to a deviation of the constant current sources in current value. Also, since the plurality of constant current sources are provided to drive one data line, a circuit region of the constant current sources becomes large in circuit scale and has a large parasite capacitance to elongate the current drive period.

Also, in Japanese Laid Open Patent Application (JP-P2005-099745A), the constant current circuit is of a sample hold type, composed of a TFT and a capacitance. Also, since the voltage deviation is caused due to field flow, there is a large current deviation over the plurality of constant current sources.

SUMMARY OF THE INVENTION

Therefore, an object of the present invention is to provide a drive circuit with monotonous increase and a reduced current value deviation.

Also, another object of the present invention is to provide a drive circuit whose circuit scale can be reduced.

Also, still another object of the present invention is to provide a drive circuit in which a differential amplifier as a part of a constant current circuit is shared in a precharge drive period and a current drive period.

In an aspect of the present invention, a drive circuit which outputs an output signal to an output terminal, includes a drive transistor configured to output a gradation current to the output terminal; a single differential amplifier; a resistance element connected with the drive transistor; and a plurality of switches. The plurality of switches are controlled such that a precharge voltage is outputted from the differential amplifier to the output terminal in a first period while blocking off an output from the drive transistor and such that a gradation current is outputted from the drive transistor to the output terminal in a second period after the first period.

Here, the differential amplifier may have differential input transistors, and polarities of signals to be supplied to the differential input transistors may be switched every predetermined period.

Also, a first power supply line connected to the differential amplifier and a second power supply line connected to the resistance element may be separated from each other.

In another aspect of the present invention, the drive circuit includes an output terminal; and a differential amplifier configured to output a precharge voltage to the output terminal in response to an input signal in a first period. A single drive transistor outputs a gradation current to the output terminal based on an output from the differential amplifier in response to the input signal in a second period after the first period.

Here, the drive circuit may further include a switch circuit configured to switch supply of first and second signals of the input signal to an inversion input and a non-inversion input in the differential amplifier every predetermined period.

Also, a first power supply line may be connected with the differential amplifier and a second power supply line connected with the drive transistor are separated.

Also, the input signal supplied to the differential amplifier in the first period may be determined based on a part of bits of a display data. The input signal supplied to the differential amplifier in the second period may be determined based on all of bits of the display data.

Also, the drive circuit may further include a first switch configured to prohibit an operation of the drive transistor in the first period.

Also, the drive circuit may further include a second switch configured to disconnect the drive transistor from the output terminal in the first period.

Also, the drive circuit may further include a first resistance element connected in series with the drive transistor; and a series circuit of a third switch and a second resistance element, the series circuit being connected in parallel to the first resistance element. The third switch may be controlled based on a resistance value of the first resistance element.

In another aspect of the present invention, a drive method for a display apparatus, is achieved by outputting a precharge voltage from a differential amplifier to an output terminal in response to an input signal in a first period; and by outputting a gradation current from a single drive transistor to the output terminal based on an output from the differential amplifier in response to the input signal in a second period after the first period.

Here, the drive method may be achieved by further switching supply of first and second signals of the input signal to an inversion input and a non-inversion input in the differential amplifier every predetermined period.

Also, powers may be supplied to the differential amplifier and the drive transistor through different power supply lines, respectively.

Also, the input signal supplied to the differential amplifier in the first period may be determined based on a part of bits of a display data, and the input signal supplied to the differential amplifier in the second period may be determined based on all of bits of the display data.

Also, the drive method may be achieved by further prohibiting an operation of the drive transistor in the first period.

Also, the drive method may be achieved by further disconnecting the drive transistor from the output terminal in the first period.

Also, the drive method may be achieved by further adjusting a resistance value of a resistance element connected in series with the drive transistor.

Also, the drive method is carried out by a drive circuit, which includes a resistance element connected in series with the drive transistor; and a series circuit of a third switch and a second resistance element, the series circuit being connected in parallel to the resistance element.

The drive method further includes controlling the third switch based on a resistance value of the first resistance element.

In still another aspect of the present invention, a drive circuit includes an output terminal; and a single drive transistor configured to output a drive current to the output terminal in response to a gate input signal. One of a first voltage corresponding to a difference from a voltage of the input signal to a voltage of a drain of the drive transistor and a second voltage corresponding to a difference from the drain voltage to the input signal voltage is selected every predetermined period, and the selected voltage is supplied to the drive transistor as a gate input signal.

BRIEF DESCRIPTION OF THE DRAWINGS

FIG. 16 is a table showing the correspondence of gradation setting data and gamma values;

DESCRIPTION OF THE PREFERRED EMBODIMENTS

Hereinafter, a display apparatus using a driving circuit of the present invention will be described in detail with reference to the attached drawings. In the following description, a display panel apparatus as one feature of the present invention is driven by a sequential line driving method to display an image. However, it should be noted that driving method for the display panel apparatus of the present invention is not limited to the sequential line driving method.

First Embodiment

Figure 1:
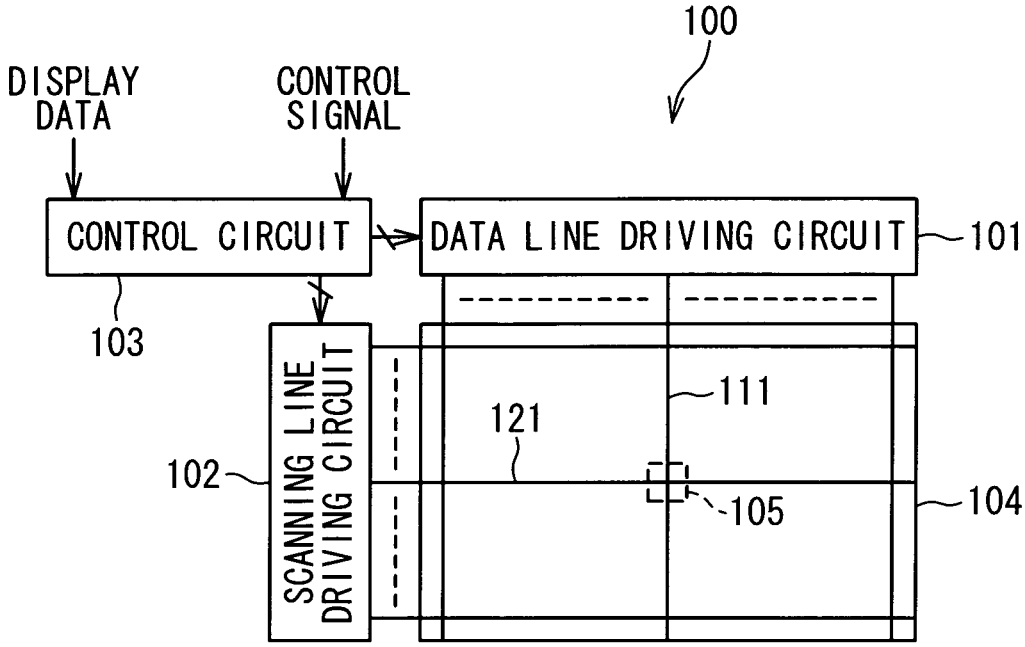
Fig. 1 PRIOR ART
FIG. 1 is a block diagram showing the circuit configuration of a conventional organic electro-luminescence display apparatus.
Figure 2:
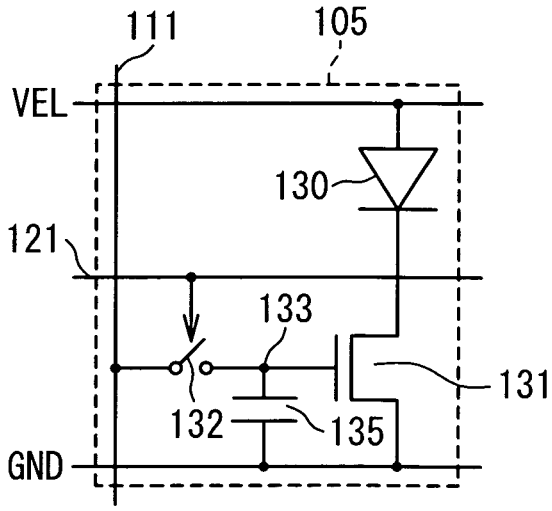
Fig. 2 PRIOR ART
FIG. 2 is a circuit diagram of a pixel of a display apparatus in an active matrix type driving method.
Figure 3:
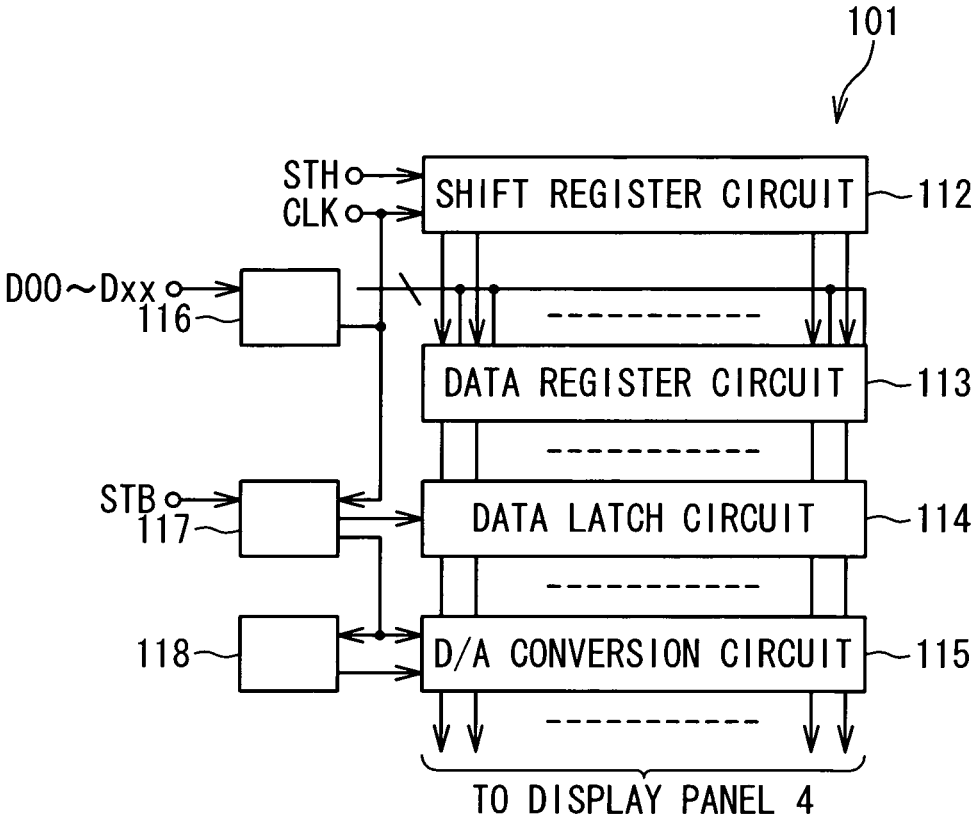
Fig. 3 PRIOR ART
FIG. 3 is a block diagram showing the circuit configuration of a data line driving circuit in the conventional organic electro-luminescence display apparatus.
Figure 4:
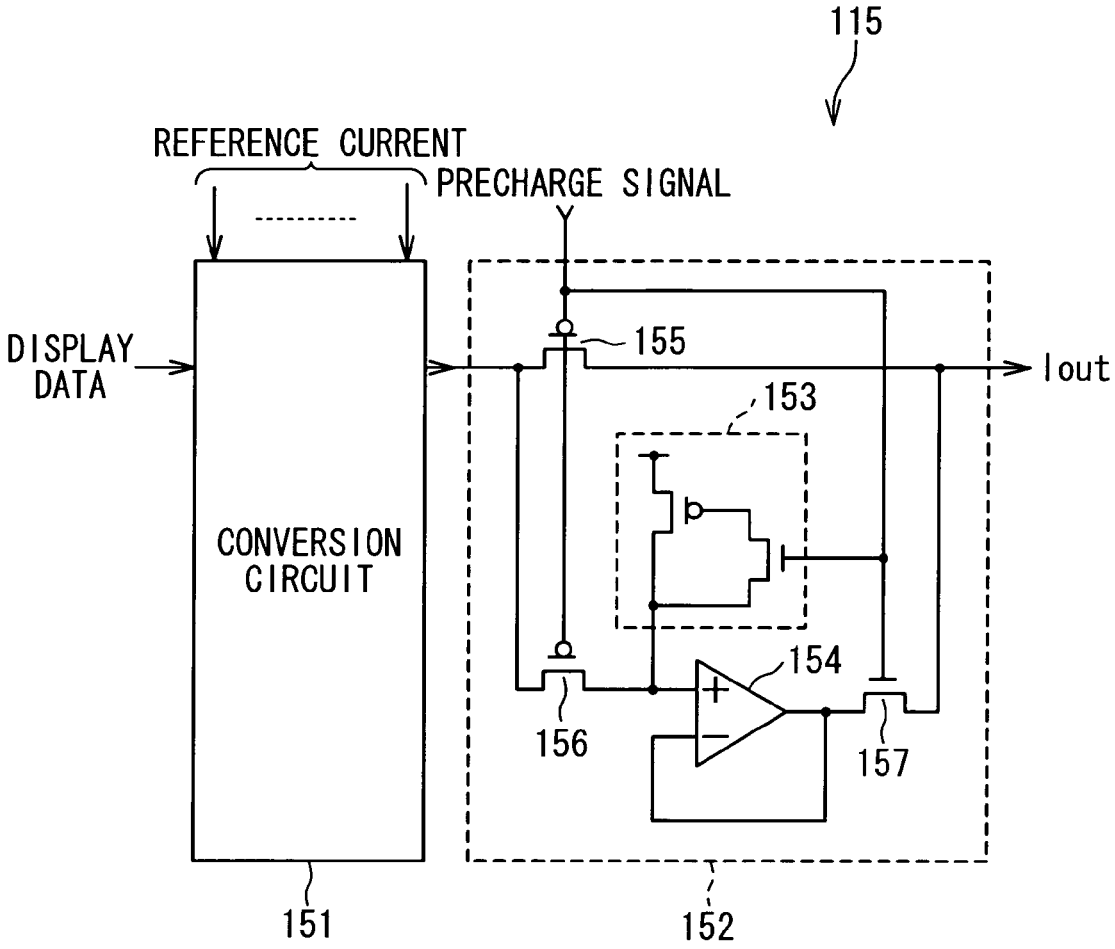
Fig. 4 PRIOR ART
FIG. 4 is a circuit diagram showing the circuit configuration of a D/A conversion circuit in the conventional organic electro-luminescence display apparatus.
Figure 5:
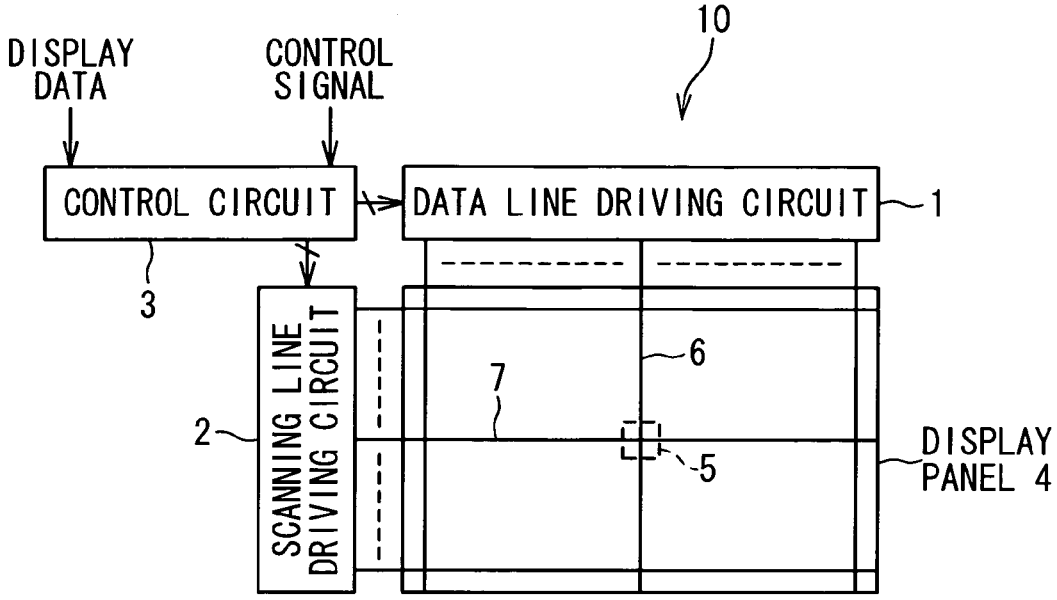
FIG. 5 is a block diagram showing the circuit configuration of a display panel apparatus according to a first embodiment of the present invention.

FIG. 5 is a block diagram showing the circuit configuration of a display panel apparatus according to the first embodiment of the present invention. As shown in FIG. 5, the display apparatus 10 includes a data line driving circuit 1, a scanning line driving circuit 2, a control circuit 3, and a display panel 4. The display panel 4 has a plurality of data lines 6 arranged in a column direction. Each data line 6 is connected with the data line driving circuit 1. Similarly, the display panel 4 has a plurality of scanning lines 7 arranged in a row direction. Each scanning line 7 is connected with the scanning line driving circuit 2. In addition, the display panel 4 has a pixel 5 at each of the intersections of the plurality of data lines 6 and the plurality of scanning lines 7.

The display apparatus 10 shown in FIG. 5 is driven by the sequential line driving method. The scanning line driving circuit 2 drives the plurality of scanning lines 7 in a predetermined order in response to a scanning sync signal. The data line driving circuit 1 drives the plurality of data lines 6 so that the pixels 5 stores the display data in response to the scanning line 7 which is selectively driven by the scanning line driving circuit 2. The data line driving circuit 1 drives the data line 6 in a data line drive period for each pixel to store the display data. The data line drive period is divided into a first period and a second period. The first period is a precharge period and the second periods is a current drive period.

The data line driving circuit 1 and the scanning line driving circuit 2 are connected with the control circuit 3. The data line driving circuit 1 supplies a predetermined voltage or current to the plurality of data lines 6 in response to a driving circuit control signal outputted from the control circuit 3. The scanning line driving circuit 2 supplies a predetermined voltage or current to the plurality of scanning lines 7 as well as the data line driving circuit 1 in response to the driving circuit control signal outputted from the control circuit 3.

The control circuit 3 receives display data to be displayed on the display panel 4 and a control signal corresponding to the display data. The control circuit 3 generates the driving circuit control signal, and outputs the signal to the data line driving circuit 1 and the scanning line driving circuit 2. The display panel 4 has a plurality of pixels 5 in a matrix and displays an image based on the outputs of the data line driving circuit 1 and the scanning line driving circuit 2. The display panel 4 outputs the display data as a display image by driving an electro-luminescent element as a light-emitting element included in each pixel 5.

Figure 6:
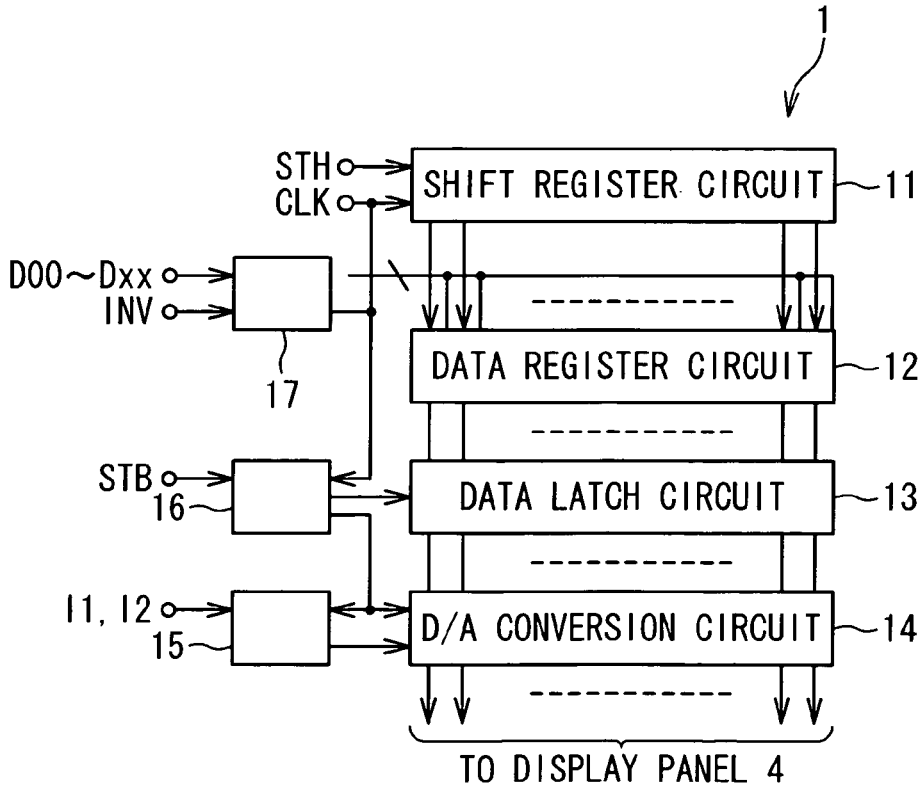
FIG. 6 is a block diagram showing the circuit configuration of a data line driving circuit in the first embodiment.

FIG. 6 is a block diagram showing the circuit configuration of the data line driving circuit 1. As shown in FIG. 6, the data line driving circuit 1 includes a shift register circuit 11, a data register circuit 12, a data latch circuit 13, a D/A conversion circuit 14, a gradation voltage generating circuit 15, a timing control circuit 16, and an input buffer circuit 17. The shift register circuit 11 outputs a sampling signal in response to a horizontal signal STH in synchronism with a clock signal CLK. The input buffer circuit 17 receives the display data, and carries out a bit inversion to the display data based on a control signal INV and then outputs the bit-inverted display data to the data register circuit 12 in synchronism with the clock signal CLK. The data register circuit 12 is a memory circuit to store the display data in synchronism with the sampling signal outputted from the shift register circuit 11. The timing control circuit 16 generates timing control signals in response to a strobe signal STB in synchronism with the clock signal CLK to control the operation of the data latch circuit 13, the D/A conversion circuit 14, and the gradation voltage generating circuit 15. The data latch circuit 13 reads out the display data stored in the data register circuit 12 in synchronism with a latch signal as the timing control signal from the timing control circuit 16 and outputs the latched data to the D/A conversion circuit 14. The gradation voltage generating circuit 15 generates the gradation voltage based on gradation setting data 11 and 12 and outputs the gradation voltage to the D/A conversion circuit 14 in response to the timing control signal from the timing control circuit 16. The D/A conversion circuit 14 converts the digital display data from the data latch circuit 13 into an analog signal based on the gradation voltage supplied from the gradation voltage generating circuit 15 in response to the timing control signal from the timing control circuit. The data lines are driven based on the analog signals.

Figure 7:
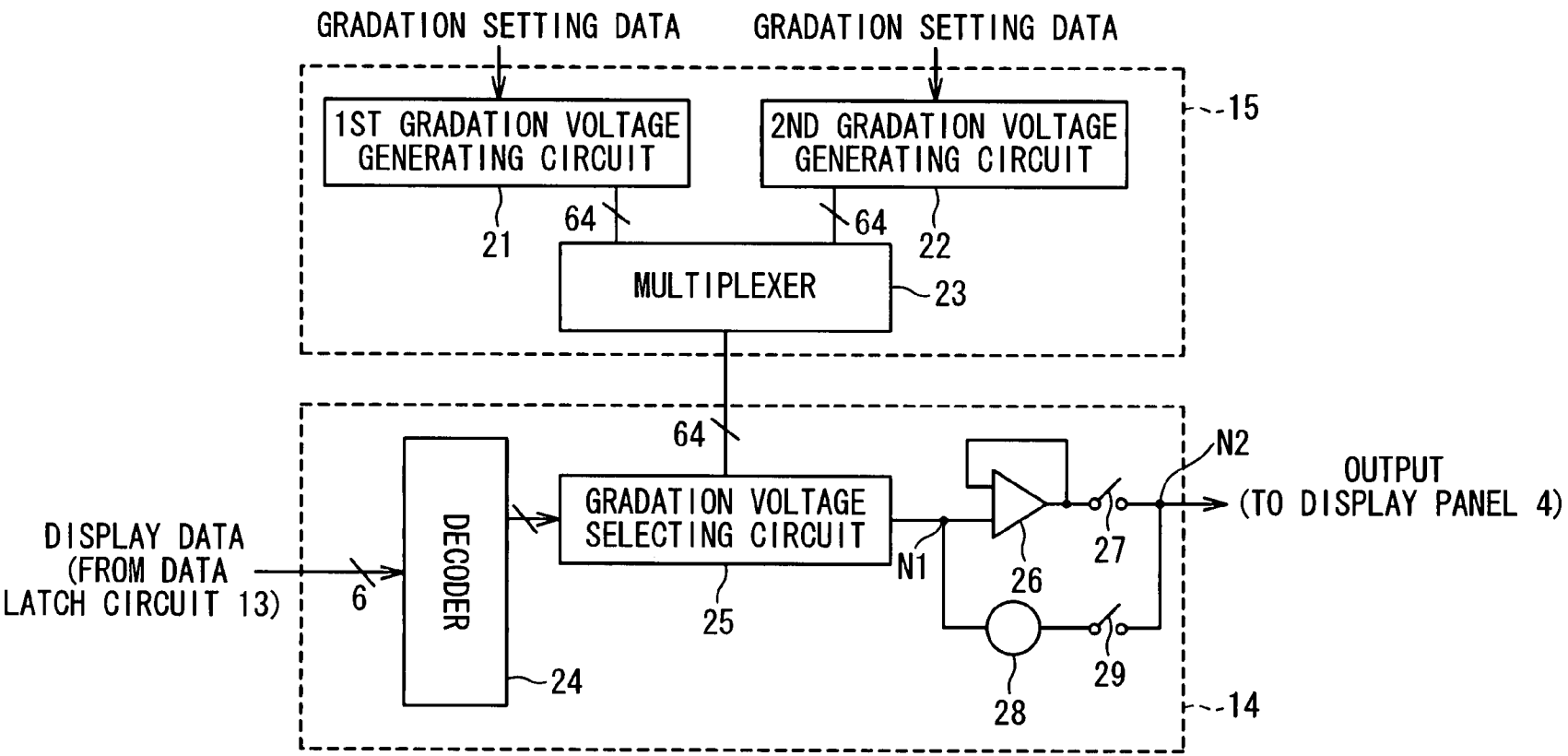
FIG. 7 is a block diagram of the circuit configuration of a D/A conversion circuit and a gradation voltage generating circuit 15 in the first embodiment.

FIG. 7 is a block diagram of the circuit configuration of the D/A conversion circuit 14 and the gradation voltage generating circuit 15 in the first embodiment. The gradation voltage generating circuit 15 a first gradation voltage generating circuit 21 which generates a plurality of first gradation voltages based on the gradation setting data 11, a second gradation voltage generating circuit 22 which generates a plurality of second gradation voltages based on the gradation setting data 12, and a multiplexer 23. The multiplexer 23 outputs one of the plurality of first gradation voltages and the plurality of second gradation voltages as a plurality of gradation voltages to the D/A conversion circuit 14 in parallel in parallel.

As shown in FIG. 7, the D/A conversion circuit 14 includes a decoder 24, a gradation voltage selecting circuit 25, a voltage driver 26, a first switch 27, a current driver 28, and a second switch 29. The decoder 24 is connected with the gradation voltage selecting circuit 25. An output terminal of the gradation voltage selecting circuit 25 is connected with each of input terminals of the voltage driver 26 and current driver 28 through a node N1. An output terminal of the voltage driver 26 is connected with the first switch 27. The first switch 27 is connected with the data line 6 through a node N2. An output terminal of the current driver 28 is connected with the second switch 29. The second switch 29 connected the data line 6 through the node N2.

The decoder 24 decodes the display data for one pixel supplied from the data latch circuit 13 and outputs the decoded data to the gradation voltage selecting circuit 25. The gradation voltage selecting circuit 25 selects a specific gradation voltage from the plurality of gradation voltages supplied from the gradation voltage generating circuit based on the display data supplied from the decoder 24. The gradation voltage selecting circuit 25 outputs the selected data to the voltage driver 26 or the current driver device 28.

The voltage driver 26 can drive a corresponding one of the data lines 6 with high drive ability. For instance, the voltage driver 26 is provided with a voltage follower circuit or a source follower circuit. The voltage driver 26 drives the data line 6 with a voltage corresponding to the voltage supplied from the selecting circuit 25. The current driver 28 can drive the data line 6 with a constant current. Thus, the data line 6 and the pixel 5 are voltage-driven at high speed in the precharge period by the voltage driver 26, and the data line 6 and the pixel 5 are current-driven in a predetermined current in the current drive period by the current driver 28. In the voltage drive, the value and direction of the current flow are both changeable. On the other hand, in the current drive, the current value is constant and the direction of the current flow in not changed.

The gradation voltage selecting circuit 25 selects one of the plurality of first gradation voltages as the plurality of gradation voltages based on the output from the decoder 24. The selected first gradation voltage is subjected to impedance conversion by the voltage driver 26 and is outputted as a precharge voltage. Also, the gradation voltage selecting circuit 25 selects one of the plurality of second gradation voltages as the plurality of gradation voltages based on the output from the decoder 24. The selected second gradation voltage is supplied to the current driver 28. The current converter 28 generates and outputs a drive current by carrying out current conversion to the selected second voltage supplied from the gradation voltage selecting circuit 25. It should be noted that the drive ability of the voltage driver 26 is greatly larger than that of the current driver 28. Therefore, an influence on the precharge voltage is as small as negligible. As a result, the second switch 29 may be omitted from the D/A conversion circuit 14.

Figure 8:
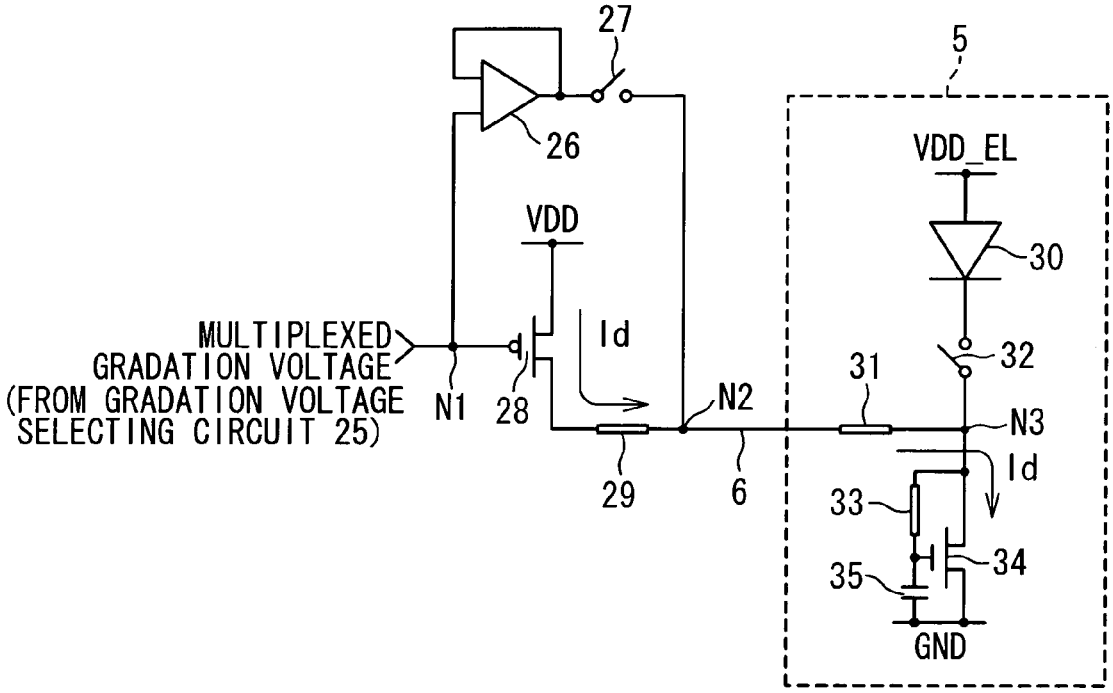
FIG. 8 is a block diagram showing the circuit configurations of a pixel and a current driver connected with the pixel in the first embodiment.

FIG. 8 is a block diagram showing the circuit configurations of the pixel 5 and the current driver 28 connected with the pixel 5 in the first embodiment. As shown in FIG. 8, the pixel 5 in the display panel 4 is connected with the current driver 28 through the data line 6. The pixel 5 includes an electro-luminescent element 30 as a light-emitting element, a plurality of thin film transistors (TFTs) 31 to 34, and a capacitor element 35. The electro-luminescent element 30 emits light through the EL (Electro Luminescence) phenomenon. The first TFT 34 is a driving transistor for the pixel 5 and is configured of a N-channel transistor. The electro-luminescent element 30 is connected with a power supply VDD_EL. The second TFT 32 is connected between the electro-luminescent element 30 and a node N3. The third TFT 31 is connected between the data line 6 and the node N3. The first TFT 34 is connected between the node N3 and the ground potential GND. The capacitor element 35 is connected between the gate of the first TFT 34 and the ground potential GND. The fourth TFT 34 is connected between the node N3 and the gate of the first TFT 34.

The current driver 28 shown in FIG. 8 is configured of a P-channel transistor. The gate of the current driver 28 is connected with the gradation voltage selecting circuit 25 through the node N1. The current driver 28 generates and supplies a current Id to the data line 6 based on the selected second gradation voltage supplied from the gradation voltage selecting circuit 25. The current driver 28 shown in FIG. 8 is configured of a single transistor of the P-channel transistor. This is because the first TFT 34 in the pixel 5 is N-channel transistor. It should be noted that it is desirable that the current driver 28 is configured of the N-channel transistor if the first TFT 34 of the pixel 5 is configured of the P-channel transistor.

Figure 9A:
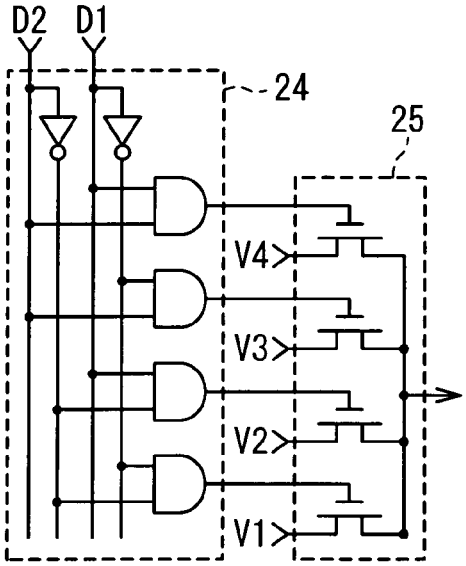
FIGS. 9A and 9B are circuit diagrams showing examples of the configurations of a decoder and a gradation voltage selecting circuit in the D/A conversion circuit in the first embodiment.
Figure 9B:
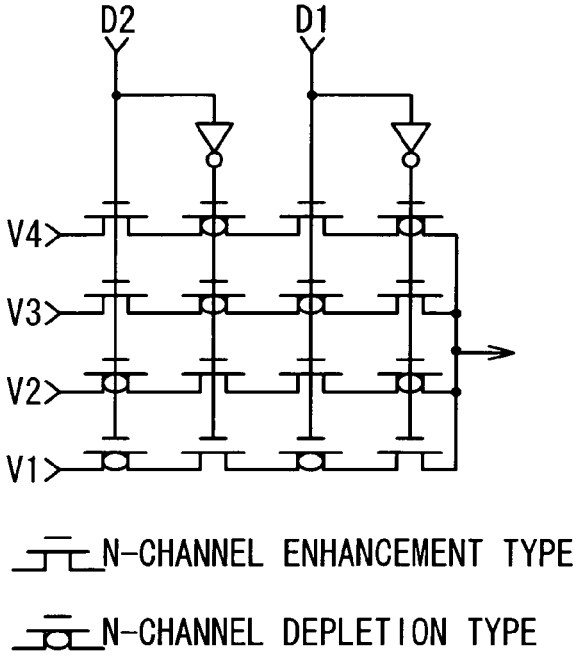

FIGS. 9A and 9B are circuit diagrams showing examples of the configurations of the decoder 24 and the gradation voltage selecting circuit 25 in the D/A conversion circuit 14. FIGS. 9A and 9B shows the examples when the display data is of 2 bits D1 and D2 and the gradation voltages are V1 to V4. FIG. 9A shows a circuit in which the decoder 24 and the gradation voltage selecting circuit 25 are individually configured. FIG. 9B shows a circuit diagram in which the decoder 24 and the gradation voltage selecting circuit 25 are combined. It should be noted that in FIGS. 9A and 9B switches are shown as N-type MOS transistors, but they may be configured of transfer switches of CMOS configuration.

Figure 10:
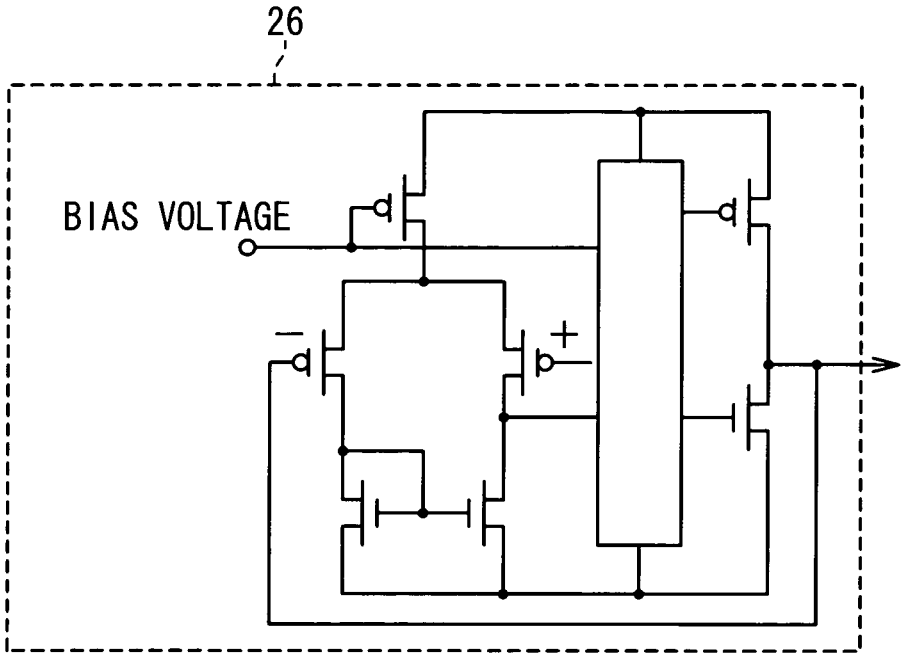
FIG. 10 is a circuit diagram showing the circuit configuration of a voltage driver in the D/A conversion circuit in the first embodiment.

FIG. 10 is a circuit diagram showing the circuit configuration of the voltage driver 26 in the D/A conversion circuit 14. Referring to FIG. 10, an output stage of the voltage driver 26 is of a push-pull type, and differential input transistors are the P-channel transistors because the first TFT 34 of the pixel 5 is the N-channel transistor. If the differential input transistors are the N-channel transistors, the voltage range on the power supply voltage VDD side is narrowed by a threshold voltage Vth. Therefore, it is possible to widen the voltage range in the vicinity of the ground potential by using the P-channel transistors as the differential input transistors.

Although the voltage range can be widened if the differential input transistors are depletion type transistors, this type transistor is not used so much. This is because a deviation in threshold voltage is larger so that a deviation in offset voltage of an amplifier also is larger. However, the depletion type transistors may be used as the differential input transistors in the following case. That is, the deviation in threshold voltage of the first TFT 34 in the pixel 5 is larger by about one digit than that of the depletion type transistor. Also, the first TFT 34 can be driven to a desired current value by the current driver 28 after the data line 6 and the pixel 5 are driven by the voltage driver 26. Therefore, there is no problem in that the depletion type transistors are used for the differential input transistors, if the deviation in the offset voltage is about 0.2V.

Figure 11A:
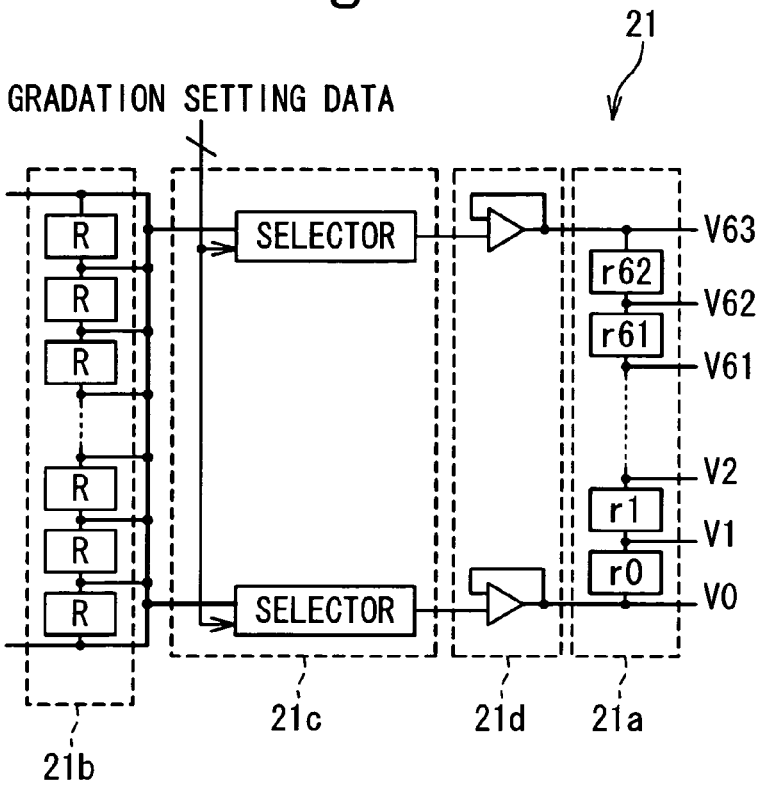
FIG. 11A is a block diagram showing the circuit configuration of a first gradation voltage generating circuit in the first embodiment.

FIG. 11A is a block diagram showing the circuit configuration of the first gradation voltage generating circuit. As shown in FIG. 11A, the first gradation voltage generating circuit 21 includes a resistance string circuit 21*a*, a reference voltage generating circuit 21*b*, a selector circuit 21*c*, and a voltage follower circuit 21*d*. In the resistance string circuit 21*a*, a plurality of resistances r0 to r62 are connected in series. Desired gradation voltages V0 to V63 are outputted from each node of the resistance string circuit 21*a* to the multiplexer 23. The reference voltage generating circuit 21*b* generates voltages based on the gradation setting data. For instance, the reference voltage generating circuit 21*b* generates and outputs two hundred and fifty six voltages in an equal interval by resistances R, having the same resistance, of two hundred and fifty six when the gradation setting data is 8 bits data. The selector circuit 21*c* selects two arbitrary voltages based on the gradation setting data. The arbitrary two voltages selected by the selector circuit 21*c* are supplied to the voltage follower circuit 21*d*. The voltage follower circuit 21*d* carries out impedance conversion and generates two reference voltages based on the arbitrary two voltages. The voltage follower circuit 21*d* applies the reference voltages from the selector circuit 21*c* to both ends of the resistance string circuit 21*a*. The first gradation voltage generating circuit 21 may be configured to include an external circuit of the reference voltage generating circuit 21*b*, the selector circuit 21*c*, and the voltage follower circuit 21*d*. At this time, two reference voltages are supplied from the external circuit to the both ends of the resistance string circuit 21*a*. In the first gradation voltage generating circuit 21 which generates the plurality of first gradation voltages, the values of 63 resistances of the resistance r0 to r62 are set in such a manner that a desired voltage can be obtained, considering characteristic of an current Id-voltage Vg of the first TFT 34 in the pixel 5 and an ON-resistance value of the third TFT 31.

Figure 11B:
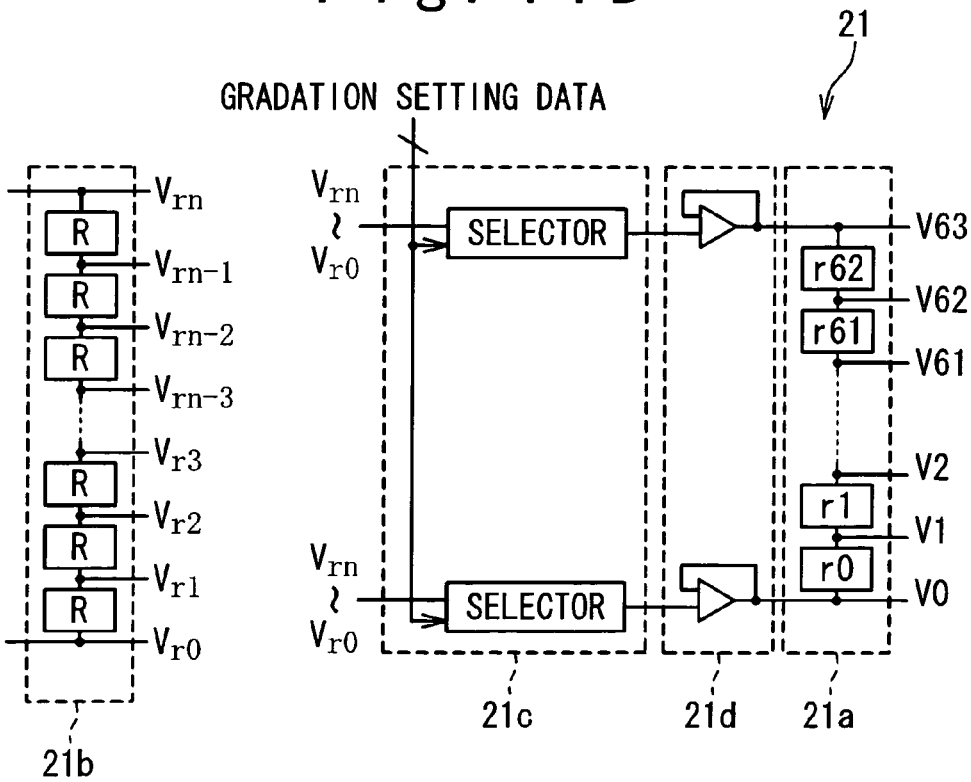
FIG. 11B is a block diagram showing the connection of the respective function blocks in the first gradation voltage generating circuit.

FIG. 11B is a block diagram showing the connection of the respective function blocks in the first gradation voltage generating circuit 21. As shown in FIG. 11B, the reference voltage generating circuit 21*b* and the selector circuit 21*c* are connected with each other such that voltage signals $Vr_0$ to $Vr_n$, (n is an arbitrary natural number) outputted from the reference voltage generating circuit 21*b* are supplied to each of selectors in the selector circuit 21*c*.

Figure 12A:
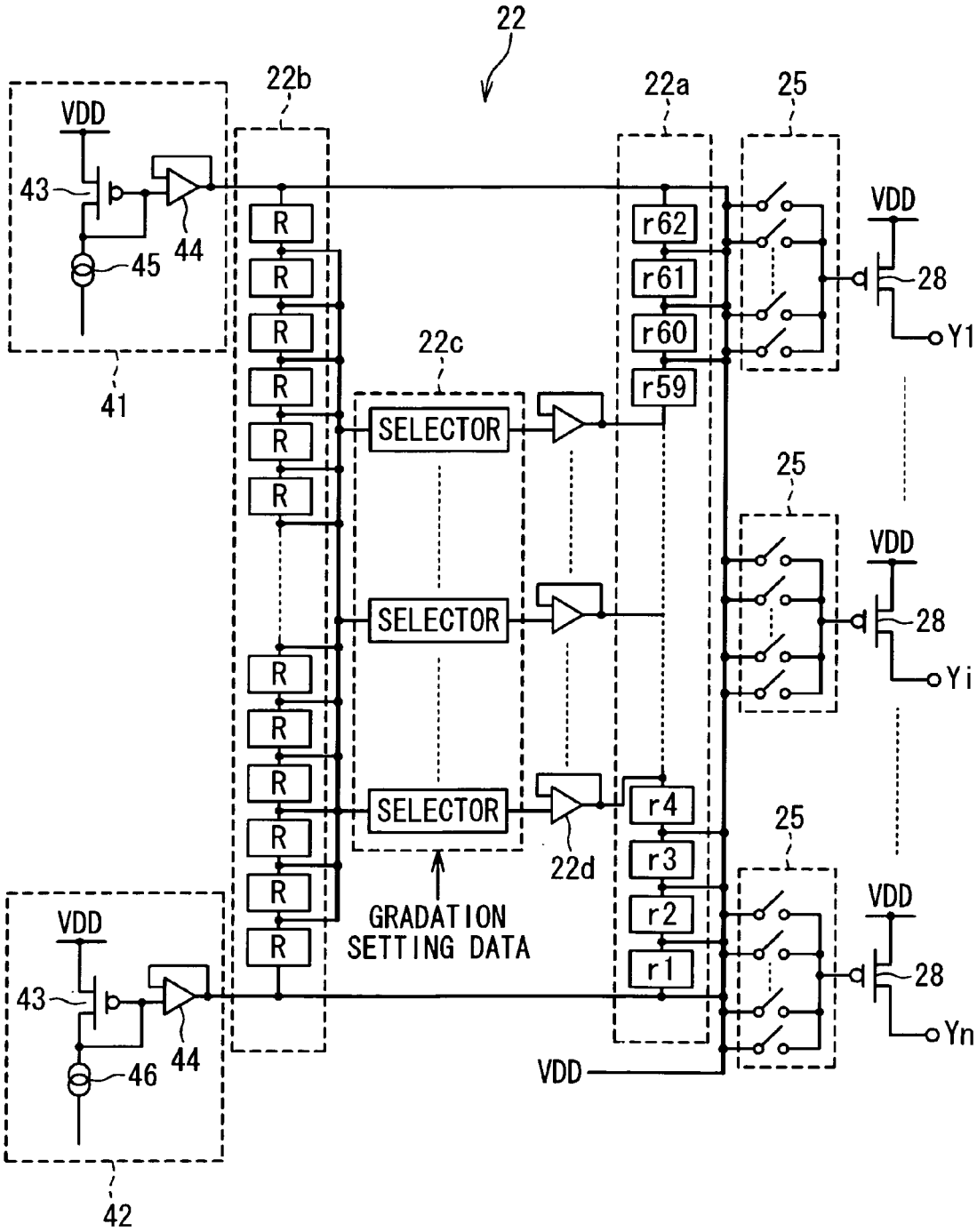
FIG. 12A is a circuit diagram showing the circuit configuration of a second gradation voltage generating circuit in the first embodiment.

FIG. 12A is a circuit diagram showing the circuit configuration of the second gradation voltage generating circuit 22. As shown in FIG. 12A, the second gradation voltage generating circuit 22 includes a resistance string circuit 22*a*, a reference voltage generating circuit 22*b*, a selector circuit 22*c*, and a voltage follower circuit 22*d*, similarly to the first gradation voltage generating circuit 21. In the resistance string circuit 22*a*, 62 resistances r1 to r62 are connected in series such that desired gradation voltage Vc1 (in the first gradation level) to Vc63 (the 63-th gradation level) are outputted from each node. The gradation voltage Vc0 (0-th gradation level) is used as the ground potential of the current driver 28, because the current value supplied from the current driver 28 is 0 [A]. The resistance string circuit 22*a* is connected with the gradation voltage selecting circuit 25 through the multiplexer 23. In addition, the second gradation voltage generating circuit 22 includes a first voltage generating circuit 41 and a second voltage generating circuit 42. The first voltage generating circuit 41 has a voltage generation transistor 43, a voltage follower 44, and a first current source 45. The second voltage generating circuit 42 includes a voltage generation transistor 43, a voltage follower 44, and a second current source 46, like the first voltage generating circuit 41. It is preferable that each of the voltage generation transistors 43 included in the first voltage generating circuit 41 and the second voltage generating circuit 42 has the same conductive type and size as the transistor in the current driver 28. Referring to FIG. 12A, the source of the voltage generation transistors 43 is connected with power supply voltage VDD, and the drain thereof is connected with the current source 45 or 46. The gate and the drain of the voltage generation transistor 43 are short-circuited and are connected with an input of the voltage follower 44.

Figure 12B:
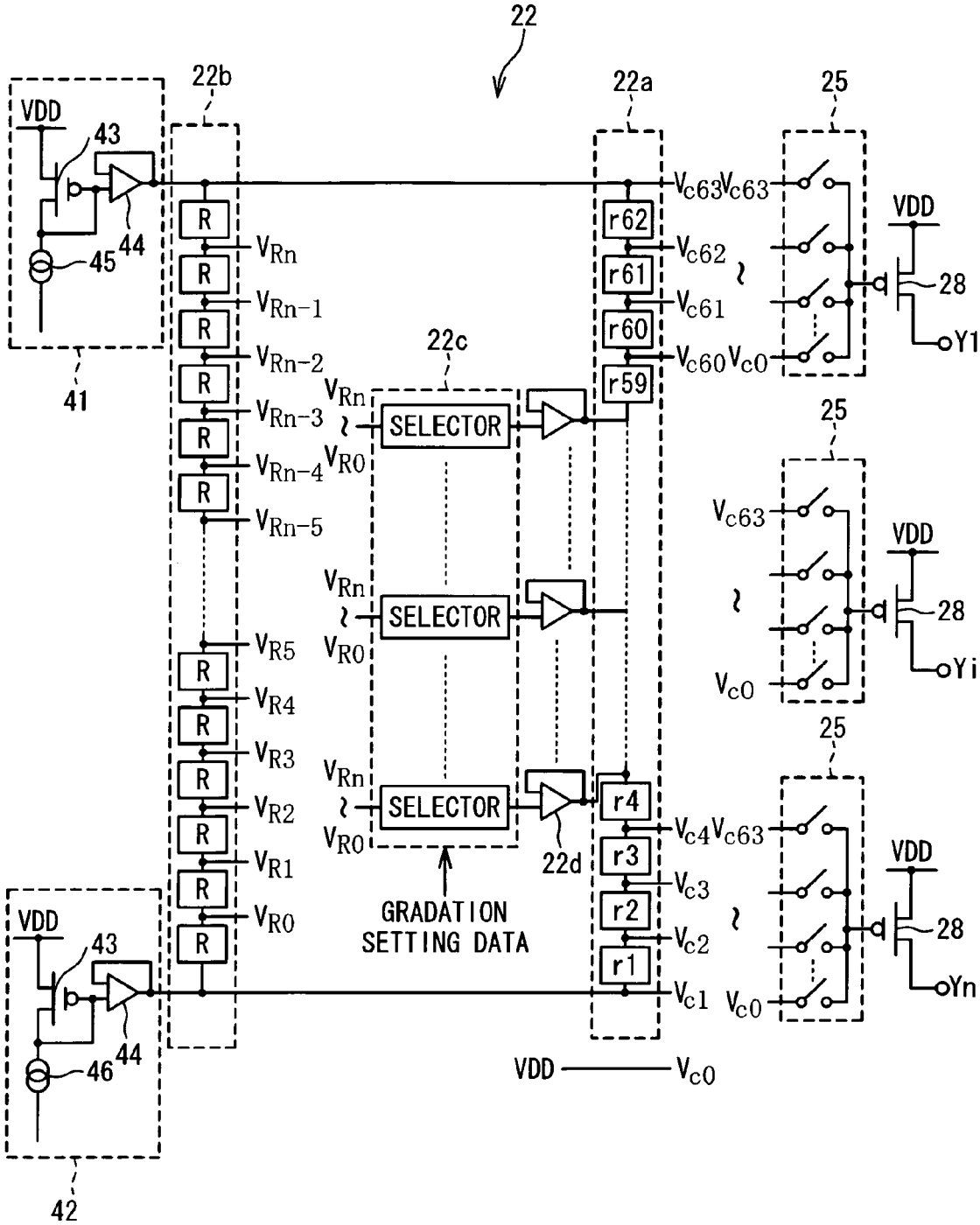
FIG. 12B is a circuit diagram showing the connection of the respective function blocks in the second gradation voltage generating circuit.

FIG. 12B is a circuit diagram showing the connection of the respective function blocks in the second gradation voltage generating circuit 22. As shown in FIG. 12B, the reference voltage generating circuit 22*b* and the selector circuit 22*c* are connected with each other such that voltages $Vr_0$ to $Vr_n$, (n is an arbitrary natural number) outputted from the reference voltage generating circuit 22*b* are supplied to each of selectors in the selector circuit 22*c*. Also, the resistance string circuit 22*a* and each of a plurality of gradation voltage selecting circuits 25 are connected with each other such that at least one of voltages $Vc_0$ to $Vc_{63}$, and $V_{DD}$ outputted from the resistance string circuit 22*a* is supplied to the gradation voltage selecting circuit 25. The voltage generated by the voltage generating circuit 41 or 42 is based on the current value of the first current source 45 or the second current source 46. Here, if the voltage generation transistor 43 and the transistors of the current drivers 28 are formed on the same substrate, the threshold voltages of the transistors can be almost same. For this reason, the deviation in the threshold voltage among the current drivers 28 can be eliminated.

The first voltage generating circuit 41 generates the voltage corresponding to a maximum brightness (63-th gradation level). The second voltage generating circuit 42 generates the voltage corresponding to a minimum brightness (first gradation level), which is the lowest value and not a non-display (0-th gradation level). In case of the non-display (0-th gradation level), the current of current driver 28 is 0, and the minimum voltage is sufficient to be less than the threshold voltage of the transistor of the current driver 28. Therefore, the source voltage is supplied which is the same potential as the power supply voltage VDD in case of the P-channel transistor, and the same potential as ground potential GND in case of the N-channel transistor.

In order to generate the voltage corresponding to the minimum brightness (first gradation level), the current value of the second source current 46 is set based on the gradation setting data. The gate voltage generated based on the current flowing through the voltage generation transistor 43 is subjected to impedance conversion by the voltage follower 44. Similarly, in order to generate the voltage corresponding to the maximum brightness (63-th gradation level), the current value of the first source current 45 is set based on the gradation setting data. The gate voltage generated based on the current flowing through the voltage generation transistor 43 is subjected to impedance conversion by the voltage follower 44. The second gradation voltage generating circuit 22 generates the voltages corresponding to the maximum and minimum brightness, a difference between which is divided by the resistance string circuit 22*a* to generate the plurality of second gradation voltages adaptive for the gamma characteristic. The selector circuit 22*c* and the voltage follower circuit 22*d* is a finely adjusting circuit for the gamma characteristic.

The relation between the input signal and the brightness is such as (brightness)=(input signal)$^{\gamma}$. The gamma value γ is set as γ=2.2 in NTSC or γ=1.8 in Macintosh. In order to make the voltage generated by the second gradation voltage generating circuit 22 adaptive for both γ=2.2 and γ=1.8, it is preferable that the resistance values of the resistance string 22*a* is set so as to be γ=2.0 and then the generated voltages are finely adjusted. For instance, the current Id-voltage Vg characteristic of the current driver 28 is $Id=k(Vg-Vt)^2$. For γ=2.0, the resistances r1 to r62 are set to same. The gamma correction is carried out by the selector circuit 22*c* and the voltage follower circuit 22*d* and the above-mentioned voltages are finely adjusted so that the gradation voltage adaptive for the gamma characteristic can be obtained. Moreover, when the gamma characteristic is different for each of RGB colors, the second gradation voltage generating circuit 22 generates the gradation voltages adaptive for the gamma characteristic for each color.

Figure 13:
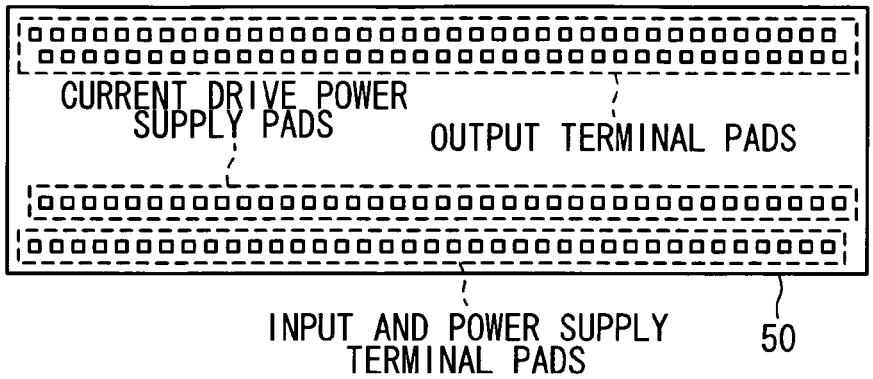
FIG. 13 shows a diagram showing the arrangement of rows of connection pads of power supply for the source voltage of the current driver.

FIG. 13 shows a diagram showing the arrangement of rows of connection pads 50 of the power supply for the source voltage of the current driver 28. As shown in FIG. 13, in the arrangement of the rows of connection pads 50, a plurality of rows of the current driver power supply pads are provided between a row of input and power supply terminal pads and a row of output pads in parallel in a row direction. In the display apparatus 10 of the first embodiment, a gradation current Id is generated by controlling the gate voltage Vg of the transistor of the current driver 28, and is $Id=k(Vg-Vt)^2$ (k is a proportion constant)

The gate voltage Vg is a voltage from the power supply voltage as the source voltage. The deviation in current occurs when the power supply voltages are different for every current driver. It is supposed that the current driver power supply pad is one and the current of 100 μA is supplied to each of 240 current drivers. In this case, when the wiring resistance from the power supply line to each current driver is 0.1Ω, there is voltage drop of 0.1Ω*100 μA*240=2.4 mV. This value corresponds to the voltage difference of 1 or 2 gradation levels in 256 gradation levels. A data line drive IC is connected on a glass substrate in small display apparatus such as cellular phones. In this case, because the connection resistance between the glass substrate and the IC is as high as about 100Ω per one pad, a plurality of pads are required. By adopting such a configuration of the power supply connection pads for the source voltage of the current driver 28, the deviation in current which is caused by the power supply voltage change of the current driver 28 can be restrained.

Figure 14:
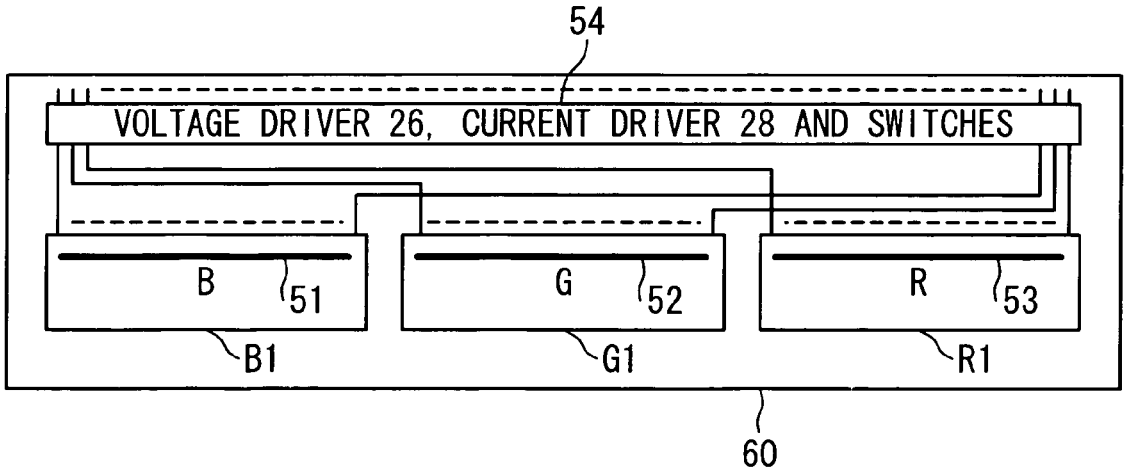
FIG. 14 is a block diagram showing an arrangement of each circuit of the data line driving circuit.

FIG. 14 is a block diagram showing an arrangement of each circuit (11 to 17) of the data line driving circuit 1. As shown in FIG. 14, the arrangement 60 is configured of a B (blue) area B1, a G (green) area G1, an R (red) area R1 and a first specific area 54. The B (blue) area B1 corresponds to pixels 5 which output the B (blue) color of the plurality of pixels 5 of the display panel. Similarly, the G (green) area G1 corresponds to the pixels 5 which output the G (green) color, and the R (red) area R1 corresponds to the pixels 5 which output the R (red) color. A B wiring 51 included in the B (blue) area B1 indicates a wiring for the gradation voltage for the B (blue) color. Similarly, a G wiring 52 indicates a wiring for the gradation voltage for the G (green) color, and an R wiring 53 indicates a wiring for the gradation voltage for the R (red) color.

The different gamma correction is carried out for each of the RGB colors in an organic electro-luminescence display apparatus. Therefore, the gamma correction can be appropriately carried out by grouping the functional blocks in a unit of each of the RGB colors. FIG. 14 shows an arrangement in a region 60, in which each of the shift register circuit 11, the data register circuit 12, the data latch circuit 13, the decoder 24, the gradation voltage selecting circuit 25, and the gradation voltage generating circuit 15 is separately provided for each of the RGB colors. On the other hand, it is preferable that the voltage driver 26, the current driver 28, and the plurality of switches 27 and 29 are not separately provided for each of the RGB colors but are provided in a single area 54 for all the colors, to decrease a parasitic capacitance of the output terminal. Such an area arrangement contributes to an arrangement of the gradation wirings. For instance, when the display data has eight bits (256 gradation levels), the number of gradation wirings is 256. Therefore, if the gradation wirings are provided in each RGB color, an area for 768 wirings is needed so that the arrangement of the gradation wirings is complex. According to the arrangement shown in FIG. 14, the B wirings 51 of the B area, the G wirings 52 of the G area, and the R wirings 53 of the R area are separates each other without intersecting. Therefore, the gradation wiring area can be arranged easily. Thus, the semiconductor device can be configured being reduced the chip size.

Figure 15:
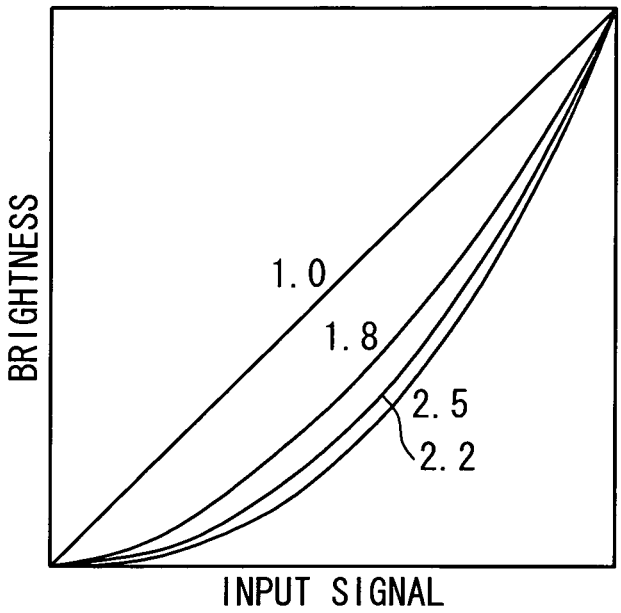
FIG. 15 shows a brightness (current)—gradation characteristic having a gamma characteristic.

FIG. 15 shows a brightness (current)—gradation characteristic having the gamma characteristic. In the current (brightness)—gradation characteristic having the gamma characteristic as shown in FIG. 15, the resolution of ten bits or more is needed in a low current range under the condition that the maximum current value is 1, the lower current range is 0 to ⅓, the middle current range is ⅓ to ⅔, and the high current range is ⅔ to 1. For instance, when the input signal has 6 bits (64 gradation levels), γ=2.2 and the maximum brightness is 1, each gradation level can be expressed as follow. That is, 0-th gradation level: 0, First gradation level: $(1/63)^{2.2}=0.0001$ which is approximated to 0, Second gradation level: $(2/63)^{2.2}=0.0005$ which is approximated to 0.0004, and Third gradation level: $(3/63)^{2.2}=0.0012$, and further 61-th gradation level: $(61/63)^{2.2}=0.93149$ which is approximated to 0.932, 62-th gradation level: $(62/63)^{2.2}=0.96541$ which is approximated to 0.964, and 63-th gradation level (maximum brightness): $(63/63)^{2.2}=1$.

In this way, the resolution of 11 bits ($2^{11}=2048$) is required because the resolution of about 0.0004 is required in the lower current range.

In the range from the middle current range to the high current range, the resolution of about 0.004 is acceptable, and the gradation can be expressed in the resolution of 8 bits ($2^8=256$). As shown in FIG. 7, as the γ approaches to 1, the resolution may be reduced lower. In case of γ=2.0, the resolution in the lower current range may be about 10 bits, and in case of γ=2.5, the resolution of 12 bits or more is required.

FIG. 16 is a table showing the correspondence of the gradation setting data and the gamma value. As shown in FIG. 16, the resistances r1 to r62 of the second gradation voltage generating circuit 22 shown in FIG. 12A or FIG. 12B may be the same resistance in case of the gamma value of γ=2.0. In case of the gamma value other than γ=2.0, the voltage is adjusted based on the gradation setting data by the selector circuit 22*c* so as to be adaptive to the desirable gamma characteristic.

Figure 17:
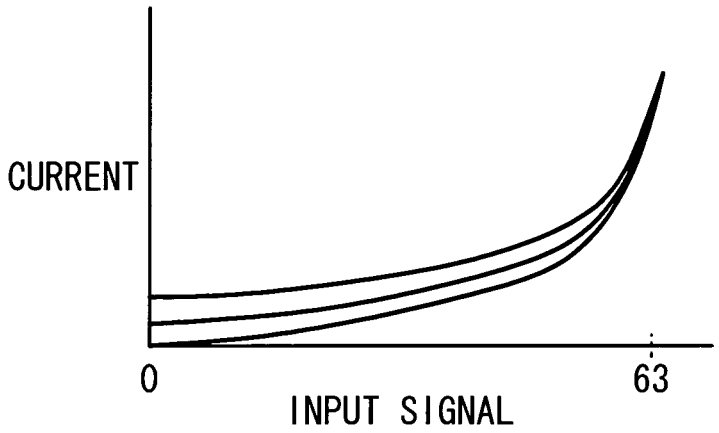
FIG. 17 is shows a gamma curve when the setting of the first voltage generating circuit is changed in the second gradation voltage generating circuit.
Figure 18:
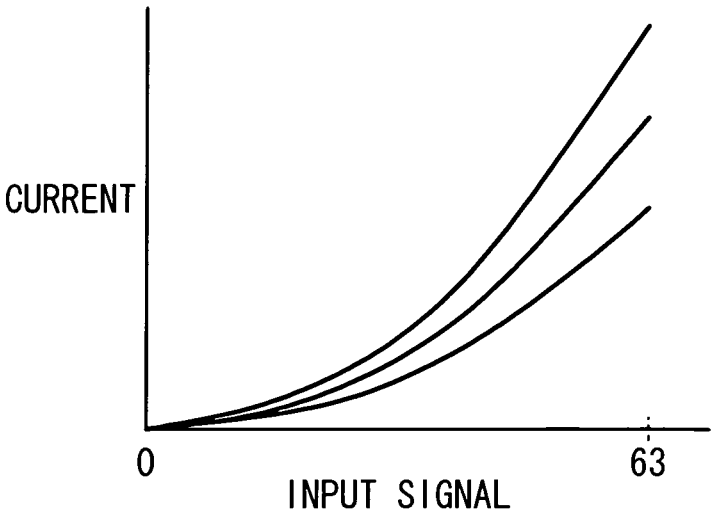
FIG. 18 shows the brightness (current)/gradation characteristic upon changing the setting of the second voltage generating circuit in the second gradation voltage generating circuit.

FIG. 17 is shows a gamma curve when the setting of the first voltage generating circuit 41 is changed in the second gradation voltage generating circuit 22 shown in FIG. 12A or FIG. 12B. As shown in FIG. 17, the gamma curve can be changed by changing the setting of the first voltage generating circuits 41. FIG. 18 shows brightness (current)/gradation characteristic upon the changing the setting of the second voltage generating circuit 42 in the second gradation voltage generating circuit 22. As shown in FIG. 18, the gamma curve can be changed by changing the setting of the second voltage generating circuits 42. In addition, the gamma curve can be changed by changing the setting of the selector circuit 22*c* in the second gradation voltage generating circuit 22.

Figure 19:
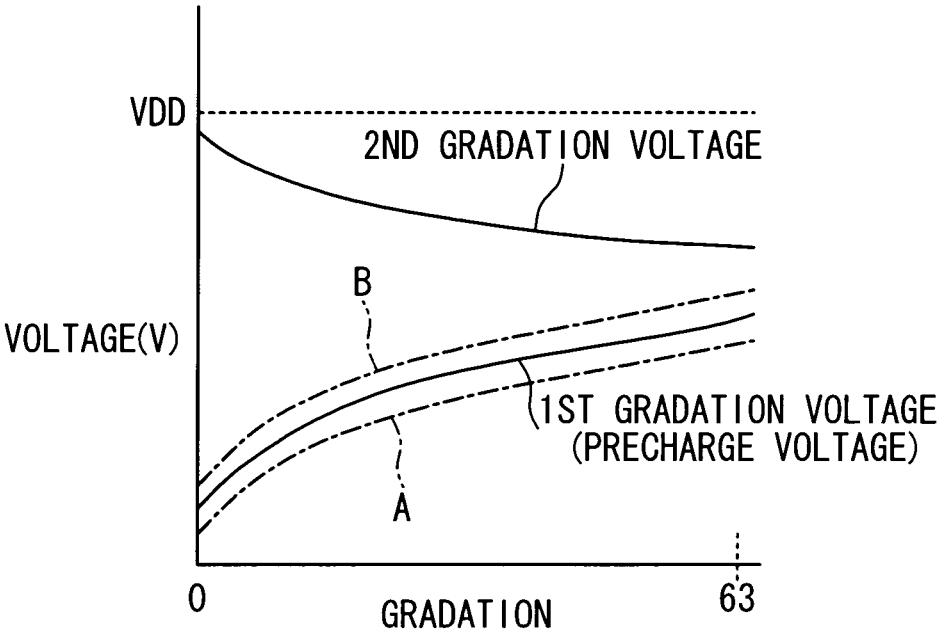
FIG. 19 shows voltage characteristic of the gradation setting upon setting of the plurality of first gradation voltages and second gradation voltages.
Figures 20A, 20B, 20C, 20D:
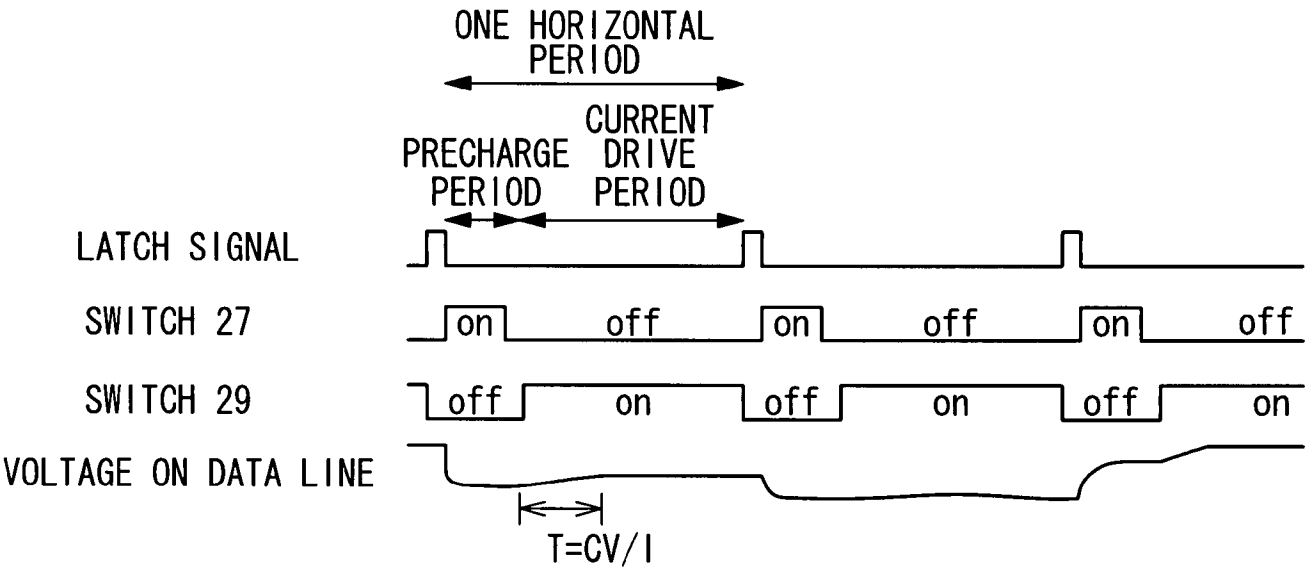
FIGS. 20A to 20D are timing charts showing an operation in the first embodiment.

FIG. 19 shows voltage characteristic of the gradation setting upon the setting of the plurality of first gradation voltages and the second gradation voltages. A curve A shows an initial value of an input signal (gradation)/voltage characteristic of the pixel 5. A curve B shows an input signal/voltage characteristic of the pixel 5 after tens of thousands of hours passed. A time during which the third TFT 31 in the pixel 5 is turned on can be shown as a value of 1/(the number of scanning lines). Here, the threshold voltage of the TFT changes by about 1V in the tens of thousands of hours. This is because the current flows through the first TFT 34 for almost all the periods, and the deterioration speed is fast. Therefore, it is desirable to set the precharge voltage in consideration of the deterioration of the first TFT 34. That is, it is desirable to approximately set the precharge voltage to an average of the values indicated by the curve A and the curve B. Thus, an appropriate gradation setting can be carried out.

As mentioned with reference to FIG. 8, when the first TFT 34 is the N-channel transistor, the current driver 28 is configured of the P-channel transistor. In this case, the first gradation voltage becomes a voltage in the neighborhood of the lower power supply voltage, and the second gradation voltage becomes a voltage in the neighborhood of the higher power supply voltage. Moreover, when the first TFT 34 is the P-channel transistor, the current driver 28 is configured of the N-channel transistor. In this case, the first gradation voltage becomes a voltage in the neighborhood of the higher power supply voltage and the second gradation voltage becomes a voltage in the neighborhood of the lower power supply voltage.

It is desirable to manufacture the data line driving circuit 1 on the silicon substrate because the deviation in characteristic of the transistor on the silicon substrate is superior to the deviation in characteristic of the TFT formed on the glass substrate by about one digit. The data line driving circuit 1 can precharge the pixel to an average of a voltage in the initial characteristic and a voltage in the deteriorated characteristic, independently from the gradation current. Also, the initial value of the precharge may be set to the initial characteristic (the curve A). In this case, the gradation voltage set by the gradation voltage generating circuit 15 should be changed according to a time-based variation in the characteristic of the pixel 5. Thus, an appropriate gradation setting can be carried out.

The data latch circuit 13 is included in the data line driving circuit 1 in the description of the embodiment. However, the configuration of the data line driving circuit 1 is not limited to this in the present invention. For instance, the effect of the present invention can be accomplished even in the following configuration. That is, a frame memory is built into the data line driving circuit 1, and the display data for one line is outputted from the frame memory to the data register circuit 12 all together, so that the display data is stored in the data register circuit 12.

FIGS. 20A to 20D are timing charts showing an operation in the first embodiment. The timing charts shown in FIGS. 20A to 20D show a driving operation of the data line driving circuit 1. The display apparatus 10 is driven by the sequential line driving scanning method as mentioned above. Therefore, the data line driving circuit 1 drives the plurality of data lines 6 in response to the scanning of the plurality of scanning lines. In other words, each data line 6 is driven sequentially at the each scanning (a period during which each data line 6 is driven in response to the scanning of one scanning line is referred as a data line drive period). When each data line is driven, the data line driving circuit 1 divides the data line drive period into a first period (the precharge period) and a second period (the current drive period). Here, the timing control circuit 16 controls the operation timings of the data latch circuit 13, the D/A conversion circuit 14, and the gradation voltage generating circuit 15 as mentioned above in response to the clock signal CLK and a horizontal sync signal. In the following description of the operation, the timing control circuit 16 is assumed to generate the timing control signals corresponding to the above-mentioned precharge period and current drive period. Moreover, the input buffer circuit 17 carries out a bit inversion of the display data in response to the clock signal CLK and the inversion control signal.

As shown in FIGS. 20*a* to 20D, the multiplexer 23 of the gradation voltage generating circuit 15 outputs the plurality of first gradation voltages generated by the first gradation voltage generating circuit 21 to the D/A conversion circuit 14 in the precharge period in response to the timing control signal supplied from the timing control circuit 16. Moreover, the data latch circuit 13 outputs the latched display data to the D/A conversion circuit 14 in response to the timing control signal.

The D/A conversion circuit 14 turns on the first switch 27 in response to the timing control signal supplied from the timing control circuit 16. Also, the D/A conversion circuit 14 activates the voltage driver 26 to carry out impedance conversion to the first gradation voltage outputted from the gradation voltage selecting circuit 25. The first gradation voltage which has been subjected to the impedance conversion is supplied to the corresponding data line 6 through the node N2, and drives the data line 6 up to a desired voltage at high speed. It takes time of about 5 μsec as the precharge period for the data line driving circuit 1 to drive each data line 6. In addition, it is also possible to make the precharge period short in correspondence to the first gradation voltage supplied to the data line 6. The data line driving circuit 1 recognizes a rest in the one data line drive period as an current drive period and controls the current driver 28 to drive the data line 6 in the current drive period. In the current drive period, the multiplexer 23 of the gradation voltage generating circuit 15 outputs the plurality of second gradation voltages, which are generated by the second gradation voltage generating circuit 22, to the D/A conversion circuit 14 in response to the timing control signal supplied from the timing control circuit 16. The D/A conversion circuit 14 receives the timing control signal, and turns the first switch 27 off and turns the second switch 29 on in synchronism with the timing control signal. Moreover, the D/A conversion circuit 14 blocks off a bias current to the voltage driver 26 in synchronism with the timing control signal so as to set the voltage driver 26 to an inactive state. Therefore, the second gradation voltage outputted from the gradation voltage selecting circuit 25 is supplied to the current driver 28. The current driver 28 generates a gradation current to be supplied to the data lines 6 based on the second gradation voltage and drives a corresponding one of the data lines 6 with the generated gradation current. For instance, because the driving time of each data line is about 50 μsec when the number of pixels of the display apparatus follows the QVGA specification and the frame cycle is 60 Hz, the driving time of the current driver 28 is about 45 μsec. Also, the power consumption can be reduced by blocking off the bias current to the voltage driver 26 in the current drive period so that the voltage driver 26 is set to the inactive state. The gradation current generated by the current driver 28 is determined based on the current Id/voltage Vg characteristic of the transistor of the current driver 28. However, the voltage drop occurs in the power supply line when the current flows from the current driver 28 to the power supply line VDD (or the ground potential GND), which causes a deviation in current. The deviation in current in the current driver 28 can be retrained by blocking off an unnecessary current such as the bias current to the voltage driver 26. Therefore, the image quality can be improved.

It should be noted that the plurality of first gradation voltages generated by the first gradation voltage generating circuit 21 are determined based on an ON-resistance of the third TFT 31 in the pixel 5 and the current Id/voltage Vg characteristic of the first TFT 34. For instance, it is supposed that the characteristics of the voltage value applied to the first TFT 34 and the current value flowing through the first TFT 34 is (voltage value, current value)=(3V, 1 μA) and (3.3V, 10 μA), and the ON-resistance of the third TFT 31 is 100 KΩ. In this case, in order to set the current flowing through the first TFT 34 to 1 μA, precharge voltage=3 V+100 KΩ*1 μA
=about 3.1V.

In order to set the current flowing through the first TFT 34 to 10 μA, precharge voltage=3.3 V+100 KΩ*10 μA
=4.3V.

Thus, by setting in this way, the precharge voltage can be appropriately set. However, the precharge voltage value is desirably set in consideration of the initial characteristic and the characteristic after deterioration because the characteristic change of the TFT in the pixel 5 is large.

The second gradation voltage generating circuit 22 generates the plurality of second gradation voltages based on the current Id/voltage Vg characteristic of the transistors of the current driver 28 so as to be adapted to the desirable gamma characteristic. The plurality of second gradation voltages are finely corrected based on the gamma control data by connecting a plurality of resistances in series so as to be adaptive for the gamma characteristic and generating desirable voltages from the respective nodes.

The current driver 28 receives the second gradation voltage, which has been selected based on the display data by the gradation voltage selecting circuit 25. The gradation voltage selecting circuit 25 receives the plurality of second gradation voltages predetermined. The plurality of second gradation voltages are gradation voltages set by the second gradation voltage generating circuit 22 so as to be a gradation current of the brightness (current)/gradation characteristic having the gamma characteristic shown in FIG. 15. The current driver 28 supplies the gradation current corresponding to the second gradation voltage to the pixel 5 through the data line 6 in the current drive period so that the pixel is driven. At this time, in the pixel 5, the third TFT 31 and the fourth TFT 34 are turned on. The gradation current Id generated by the current driver 28 flows through the first and third TFTs 31 and 34. A voltage corresponding to the gradation current Id is generated in the gate electrode of the first N-channel TFT 34. Then, the voltage is sample-held on the gate electrode of the first TFT 34 when the fourth TFT 34 is turned off. Next, the third TFT 31 is turned off, and the second TFT 32 is turned on. At this time, the first TFT 34 drives the electro-luminescent element 30. The same gradation current Id as the gradation current Id from the current driver 28 flows through the electro-luminescent element 30. As a result, the electro-luminescent element 30 emits light in the brightness corresponding to the gradation current value.

This current driver 28 is configured of the transistors of 1/n, compared with the conventional configuration using a plurality of current sources. Such a configuration of the current driver 28 contributes to considerably reduction of the circuit scale of the data line driving circuit 1. Also, the parasitic capacitance of the output electrode of the current driver 28 becomes constant without depending on the number of bits of the display data and can be decreased greatly. The relation among the voltage V which is driven by the current driver 28, the driving time T, the current I, and the capacity C, is expressed as $$I=CV/T$$

When the capacitance value decreases, the drive in a low current becomes possible, and the number of driving circuits and the power consumption in the display apparatus can be reduced.

Figure 21:
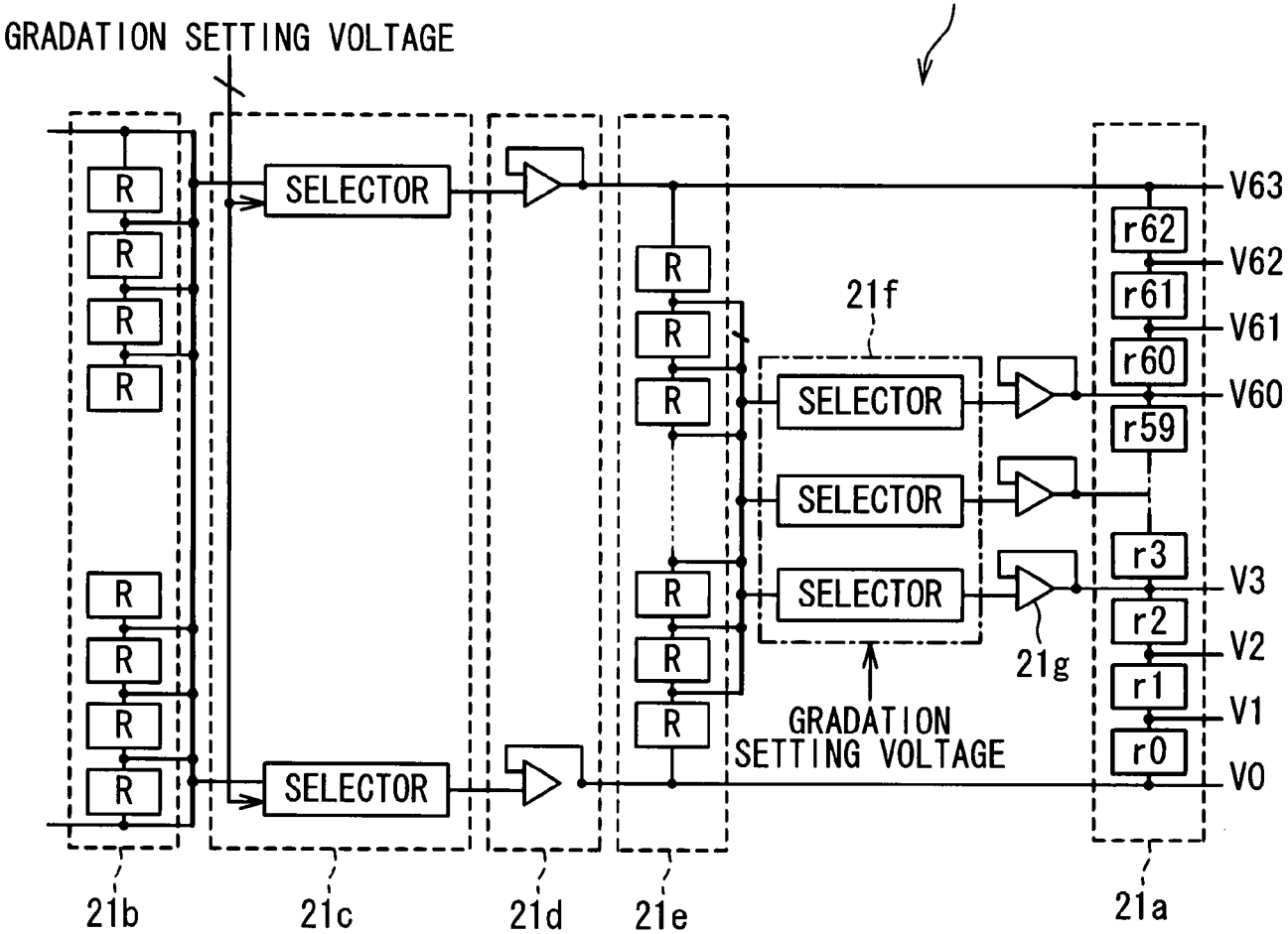
FIG. 21 is a block diagram showing another configuration of the first gradation voltage generating circuit.

FIG. 21 is a block diagram showing another configuration of the first gradation voltage generating circuit 21. A first gradation voltage generating circuit 21-1 shown in FIG. 21 includes a resistance string circuit 21*e*, a selector circuit 21*f*, and a voltage follower circuit 21*g* in addition to the first gradation voltage generating circuit 21. Here, the reference voltage generating circuit 21*b* and the selector circuit 21*c* are connected with each other as in the first gradation voltage generating circuit 21 shown in FIGS. 11A and 11B. Also, the resistance string circuit 21*e* and the selector circuit 21*f* are connected with each other in the same way as the reference voltage generating circuit 21*b* and the selector circuit 21*c* in the first gradation voltage generating circuit 21 shown in FIGS. 11A and 11B. The first gradation voltage generating circuit 21-1 further divides a voltage difference between a higher voltage and a lower voltage by the resistance string circuit 21*e* for the gamma correction by including the resistance string circuit 21*e*, the selector circuit 21*f*, and the voltage follower circuit 21*g*. According to the first gradation voltage generating circuit 21-1, a fine adjustment for the gamma correction can be facilitated without changing the maximum brightness or the minimum brightness.

Figure 22:
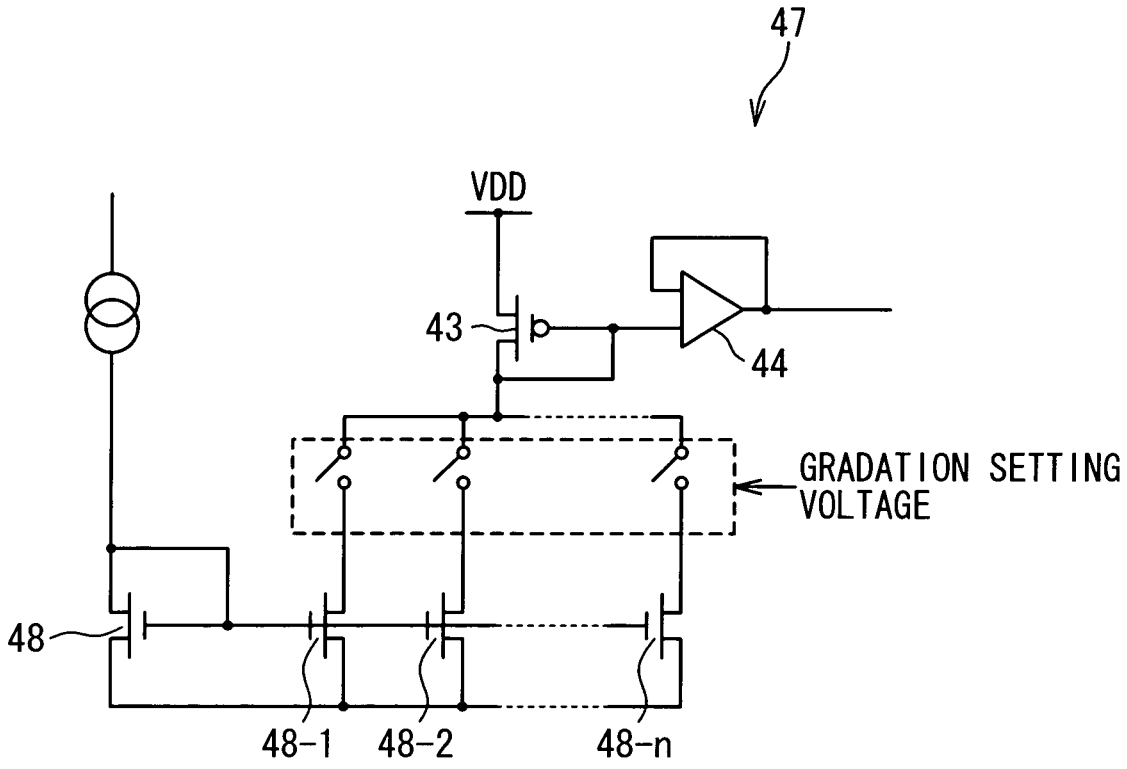
FIG. 22 is a circuit diagram showing a circuit of another configuration of the voltage generating circuit.

FIG. 22 is a circuit diagram showing a circuit 47 of another configuration of the voltage generating circuit 41 or 42. As shown in FIG. 22, the voltage generating circuit 47 includes a current mirror circuit. The current mirror circuit is configured from a specific transistor 48 corresponding to a reference current, and a plurality of transistors (48-1 to 48-*n*) corresponding to the specific transistor 48. The voltage generating circuit 47 supplies the reference current generated externally to the specific transistor 48. By forming the respective transistors 48-1 to 48-*n* (n is an arbitrary natural number) to have different transconductance coefficients, a plurality of different currents proportional to the current flowing through the specific transistor 48 can be obtained. The voltage generating circuit 47 selects one of the plurality of currents to supply the selected current to the reference voltage generating circuit 22*b*. The adoption of the configuration of the voltage generating circuit 47 shown in FIG. 22 contributes to appropriately generating and outputting the current supplied from the reference voltage generating circuit 22*b*.

Second Embodiment

Figure 23:
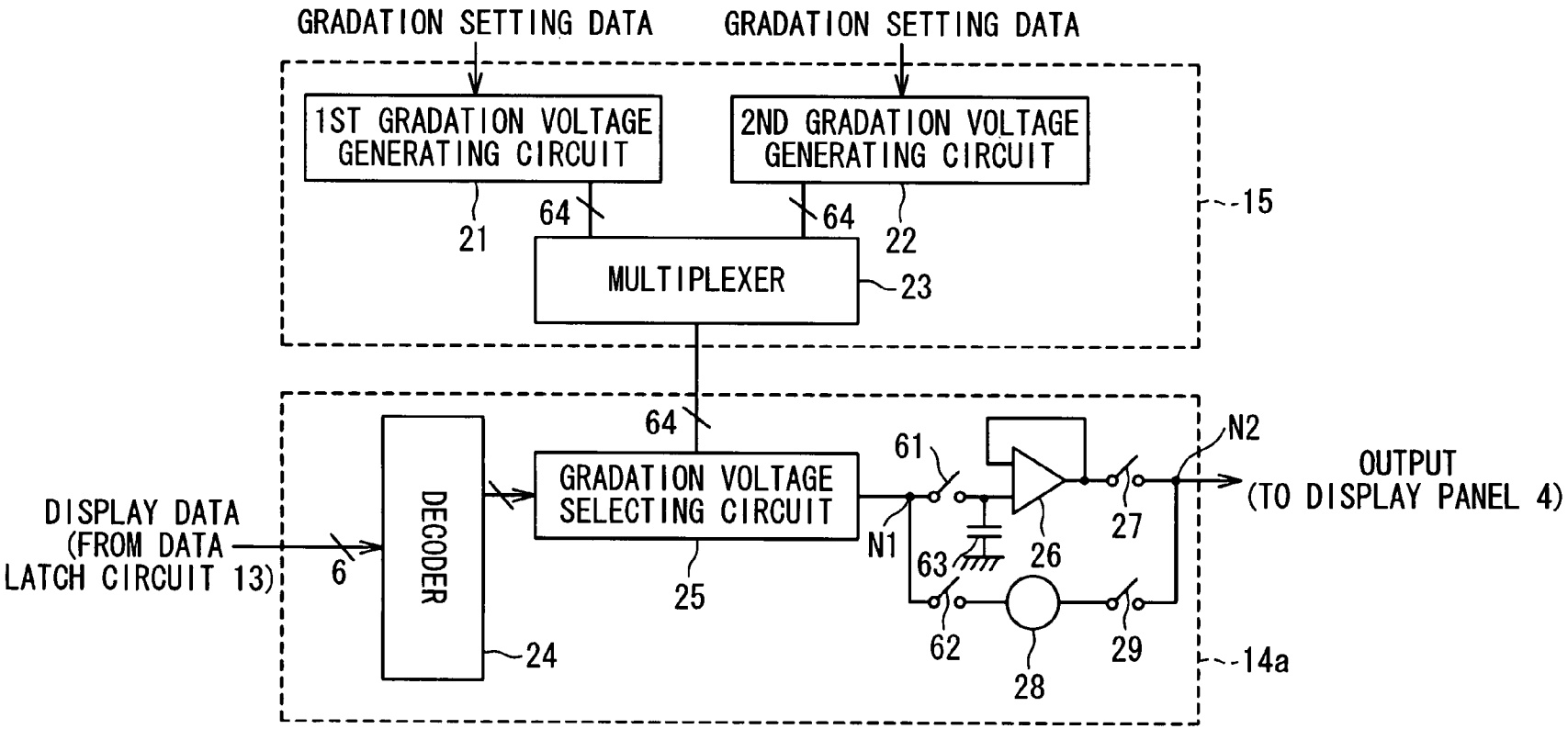
FIG. 23 is a block diagram showing the configuration of the D/A conversion circuit in a second embodiment of the present invention.

The second embodiment of the present invention will be described below. FIG. 23 is a block diagram showing the configuration of a D/A conversion circuit 14*a* in the second embodiment of the present invention. As shown in FIG. 23, the D/A conversion circuit 14*a* in the second embodiment includes a first switch 61, a second switch 62, and a capacitor 63 in addition to the configuration of the above-mentioned D/A conversion circuit 14. The first switch 61 is connected between the node N1 and the input of the voltage driver 26. The capacitor 63 is connected between the input of the voltage driver 26 and the ground potential. The voltage driver 26, the first switch 61 and the capacitor 63 configure a sample-hold circuit. Also, the second switch 62 is connected between the node 1 and the current driver 28.

An operation of the D/A conversion circuit 14*a* shown in FIG. 23 will be described below. The D/A conversion circuit 14*a* turns the first switch 61 off immediately before the current drive period (immediately before expiration of the precharge period) based on the timing control signal supplied from the timing control circuit 16. The sample-hold circuit is configured from the voltage driver 26, the first switch 61, and the capacitor 63, and carries out a sample holding operation of the first gradation voltage in response to the first switch 61 being turned off. The D/A conversion circuit 14*a* turns the second switch 62 on in response to a switching operation from the precharge period to the current drive period. At this time, the gradation voltages outputted from the multiplexer 23 are switched from the plurality of first gradation voltages to the plurality of second gradation voltages. The D/A conversion circuit 14*a* turns the second switch 29 on and turns the first switch 27 off after an input voltage to the current driver 28 is stabilized enough.

As shown in FIG. 19, the plurality of first gradation voltages and the plurality of second gradation voltages have potential differences of several volts. Therefore, it takes a certain period of time to switch from the plurality of first gradation voltages to the plurality of second gradation voltages. In addition, it takes a certain period of time for the voltage selected by the gradation voltage selecting circuit 25 to be switched. For these reasons, a glitch might be generated. In the above-mentioned configuration of the D/A conversion circuit 14*a*, the gradation voltage outputted from the multiplexer 23 restrains the glitch caused in the switching from the plurality of first gradation voltages to the plurality of second gradation voltages.

Third Embodiment

Figure 24:
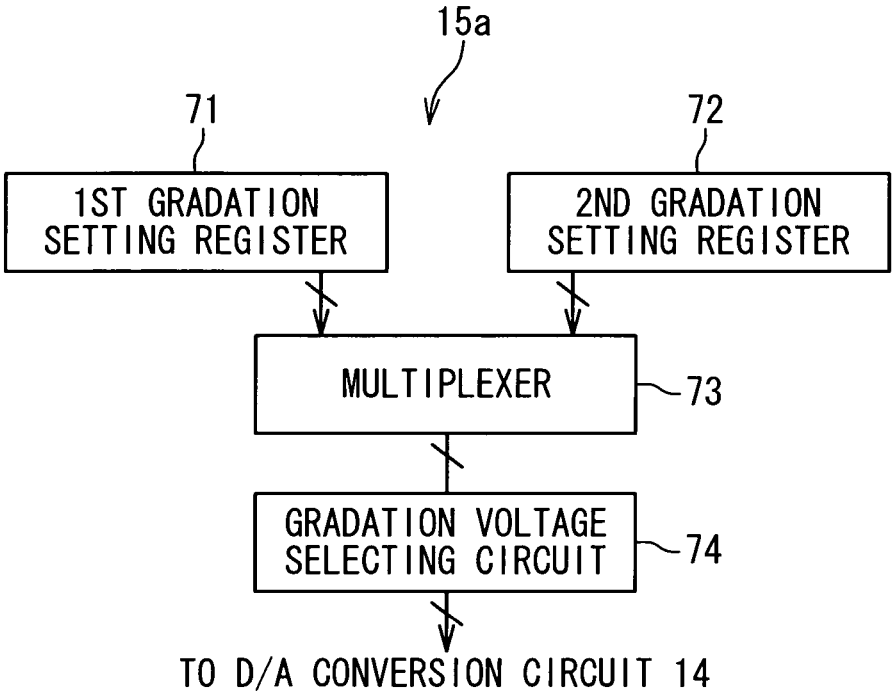
FIG. 24 is a block diagram showing the configuration of the gradation voltage generating circuit in the data line driving circuit according to a third embodiment of the present invention.

The third embodiment of the present invention will be described below. FIG. 24 is a block diagram showing the configuration of a gradation voltage generating circuit 15*a* in the data line driving circuit 1 according to the third embodiment of the present invention. As shown in FIG. 24, the gradation voltage generating circuit 15*a* in the third embodiment includes a first gradation setting register 71, a second gradation setting register 72, a multiplexer 73, and a gradation voltage generator 74. The first gradation setting register 71 is a memory circuit to store the first gradation setting data for the plurality of first gradation voltages. Similarly, and the second gradation setting register 72 is a memory circuit to store the second gradation setting data for the plurality of second gradation voltages. The multiplexer 73 selects one of the gradation setting data stored in the first gradation setting register 71 and the second gradation setting register 72, and outputs the selected gradation setting data. The gradation voltage generator 74 is a voltage generating circuit configured similarly to the first gradation voltage generating circuit 21 (or the second gradation voltage generating circuit 22).

An operation of the gradation voltage generating circuit 15*a* shown in FIG. 24 will be described below. The first gradation setting register 71 and the second gradation setting register 72 output the stored gradation setting data in response to a request from the multiplexer 73. The multiplexer 73 selects the gradation setting data from the first gradation setting register 71 in response to the timing control signal from the timing control circuit 16 in the precharge period and outputs the selected gradation setting data to the gradation voltage generator 74. Similarly, the multiplexer 73 selects the gradation setting data from the second gradation setting register 72 in response to the timing control signal from the timing control circuit 16 in the current drive period and outputs it to the gradation voltage generator 74. The gradation voltage generator 74 generates the plurality of first gradation voltages in the precharge period and generates the plurality of second gradation voltages in the current drive period, based on the output from the multiplexer 73. The plurality of first gradation voltages and the plurality of second gradation voltages generated by the gradation voltage generator 74 are outputted to the D/A conversion circuit 14.

The gradation voltage generating circuit 15 in the third embodiment can update the gradation setting data in the first gradation setting register 71 and the second gradation setting registers 72 so that the plurality of first gradation voltages and the plurality of second gradation voltages can be each generated arbitrarily and individually. As a result, for instance, in an organic electro-luminescence display apparatus for a cellular phone, when the emitted light from the organic electro-luminescence element cannot be seen because of the strong light of sunshine, a contrast can be set high by adjusting the maximum current value of the gradation current. Also, in a so-called stand-by state, that is, the state that the user does not use the phone, the low power consumption drive is possible by setting the maximum current value of the gradation current to low though the contrast decreases. This setting can be set in an arbitral period according to a state of use.

Fourth Embodiment

Figure 25:
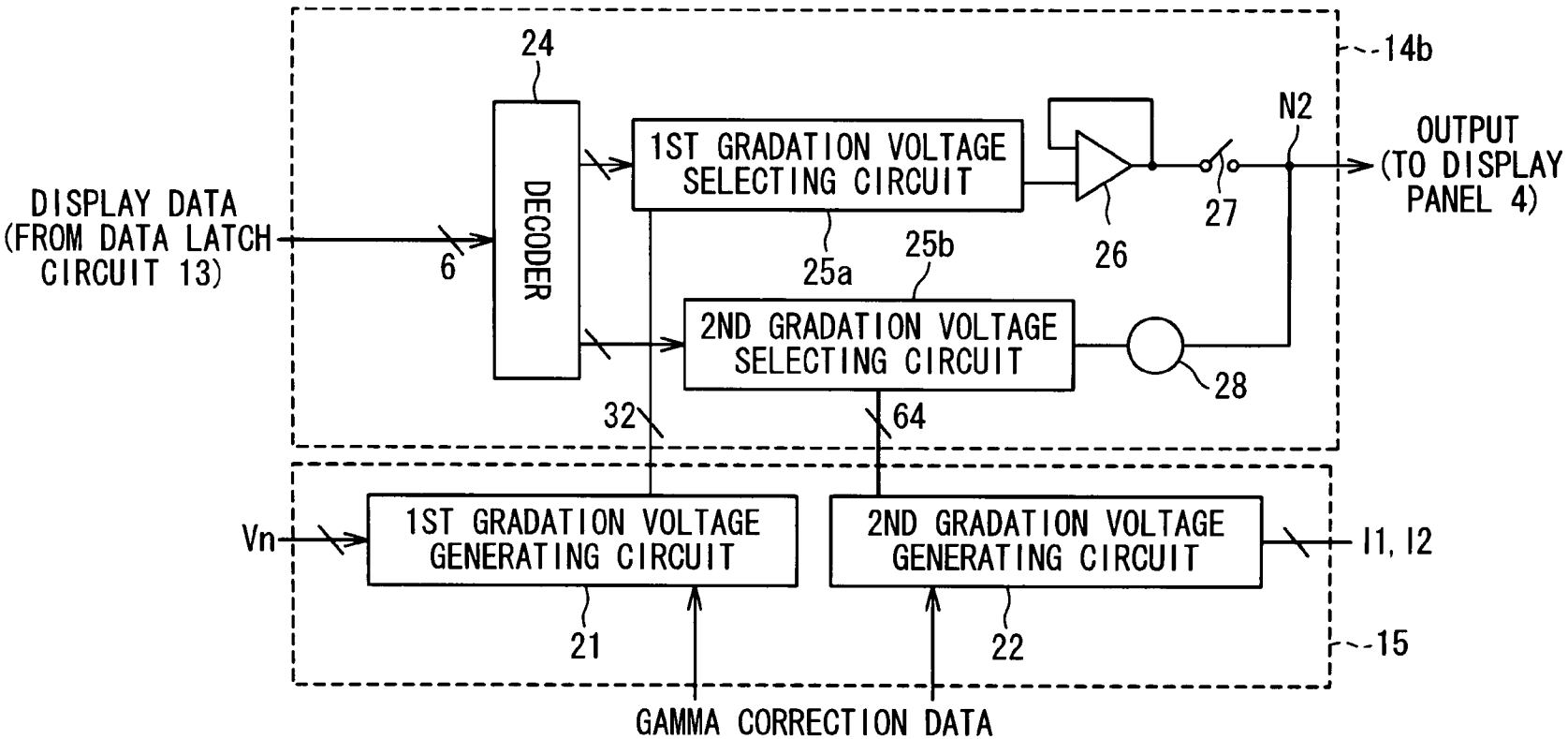
FIG. 25 is a block diagram showing the configuration of the D/A conversion circuit and the gradation voltage generating circuit in the forth embodiment.

The fourth embodiment of the present invention will be described below. FIG. 25 is a block diagram showing the configuration of a D/A conversion circuit 14*b* and the gradation voltage generating circuit 15 in the fourth embodiment. As shown in FIG. 25, the D/A conversion circuit 14*b* includes the decoder 24, a first gradation voltage selecting circuit 25*a*, a voltage driver 26, a first switch 27, a current driver 28, and a second gradation voltage selecting circuit 25*b*. The first gradation voltage selecting circuit 25*a* selects a first specific one of the plurality of first gradation voltages supplied from the first gradation voltage generating circuit 21. Similarly, the second gradation voltage selecting circuit 25*b* selects a second specific one of the plurality of second gradation voltages supplied from the second gradation voltage generating circuit 22. An output of the first gradation selecting circuit 25*a* is connected with the input of the voltage driver 26. The output of the voltage driver 26 is connected with the first switch 27. A gradation voltage outputted from the voltage driver 26 is supplied to the data line 6 through the first switch 27 and the node N2. An input of the current driver 28 is connected with the output of the second gradation voltage selecting circuit 25*b*, and an output of the current driver 28 is connected with the node N2. A gradation current outputted from the current driver 28 is supplied to the data line 6 through the node N2.

In the fourth embodiment, it is desirable that the first gradation voltage selecting circuit 25*a* is configured from the transfer switches of CMOS transistors. The second gradation voltage selecting circuit 25*b* is configured in correspondence to the current driver 28. Therefore, when the current driver 28 is configured from the P-channel transistor, the second gradation voltage selecting circuit 25*b* is configured from the P-channel transistor.

Operations of the D/A conversion circuit 14*b* and the gradation voltage generating circuit 15 shown in FIG. 25 will be described below. As shown in FIG. 25, the decoder 24 decodes the display data supplied from the data latch circuit 13, and outputs the decoded data to the first gradation voltage selecting circuit 25*a* and the second gradation voltage selecting circuit 25*b*. The first gradation voltage selecting circuit 25*a* is supplied with the plurality of first gradation voltages generated by the first gradation voltage generating circuit 21 of the gradation voltage generating circuit 15 in addition to the decoded display data. Similarly, the second gradation selecting circuit 25*b* is supplied with the plurality of second gradation voltages generated by the second gradation voltage generating circuit 22 of the gradation voltage generating circuit 15 in addition to the decoded display data. The first gradation voltage selecting circuit 25*a* selects the first specific one from the plurality of first gradation voltages based on the display data from the decoder 24 and outputs the selected voltage to the voltage driver 26. Similarly, the second gradation selecting circuit 25*b* selects the specific second gradation voltage from the plurality of second gradation voltages based on the display data from the decoder 24 and outputs the selected voltage to the current driver 26. The voltage driver 26 carries out impedance conversion of the selected voltage from the first gradation selecting circuit 25*a* to produce the gradation voltage. The current driver 28 converts the selected voltage from the second gradation selecting circuit 25*b* to produce the gradation current.

Figure 26:
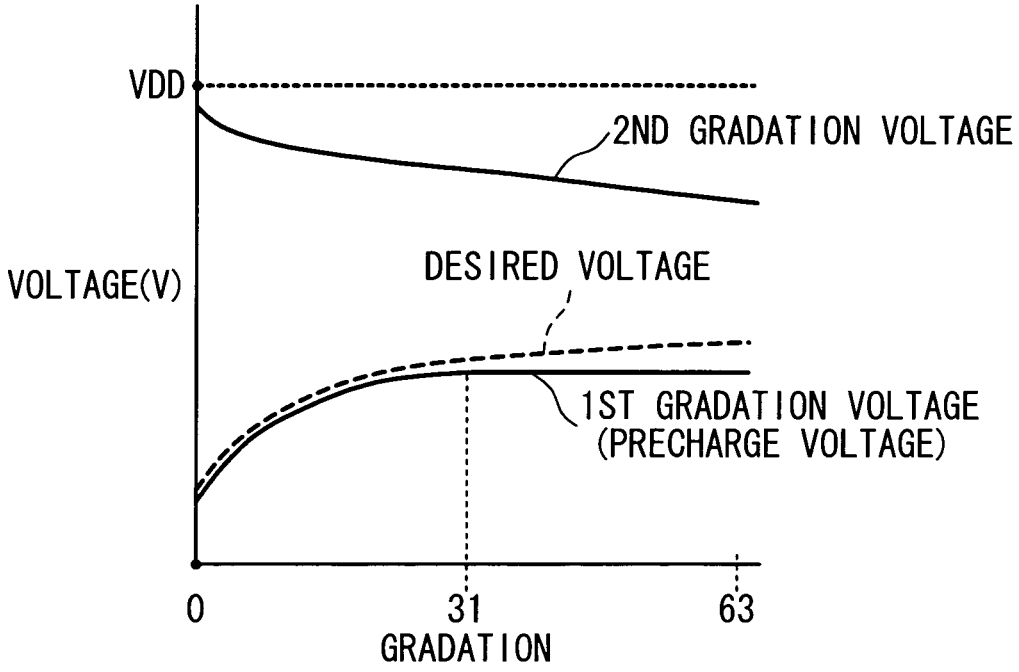
FIG. 26 is a characteristic chart of the gradation setting when the plurality of first gradation voltages and the plurality of second gradation voltages are set in a fourth embodiment.
Figure 27A:
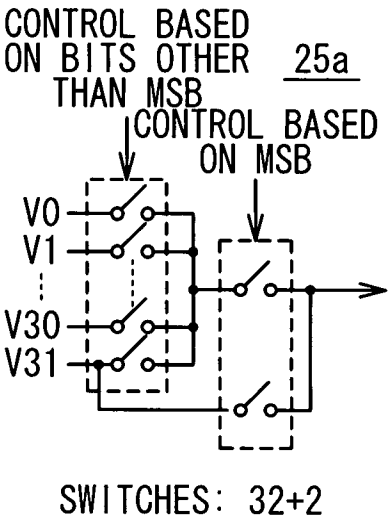
FIGS. 27A to 27C are circuit diagrams showing specific configurations of the first gradation selecting circuit.
Figure 27B:
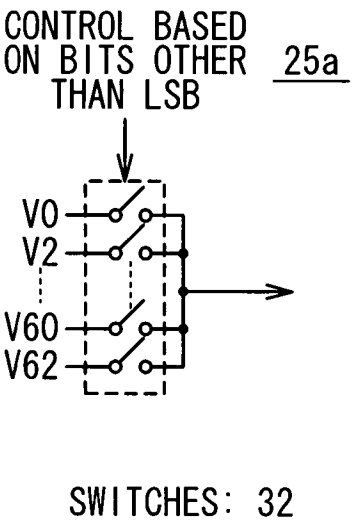
Figure 27C:
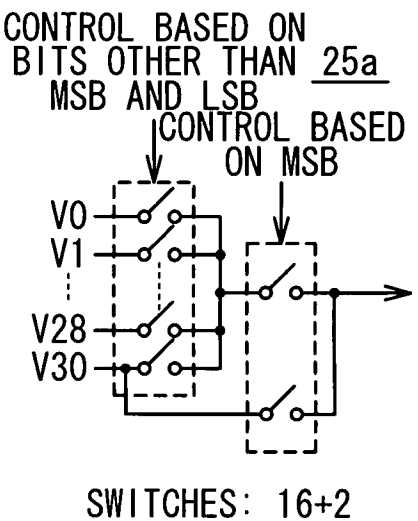

The operation in the fourth embodiment will be further described in detail with reference to FIG. 26 and FIGS. 27A to 27C. FIG. 26 is a characteristic chart of the gradation setting when the plurality of first gradation voltages and the plurality of second gradation voltages are set in the fourth embodiment. FIGS. 27A to 27C are circuit diagrams showing specific configurations of the first gradation selecting circuit 25*a*. FIG. 27A shows a circuit structure in case of the control of the selector circuit based on the most significant bit (MSB) and bits other than the MSB. FIG. 27B shows a circuit structure in case of the control of the selector circuit based on bits other than the least significant bit LSB. FIG. 27C shows a circuit structure in case of the control of the selector circuit based on bits other than the most significant bit (MSB) and the least significant bit (LSB).

As shown in FIG. 26, the plurality of first gradation voltages are set by using the 31-th gradation level which is an intermediate gradation level, as a boundary between a lower current region and a higher current region. The gradation voltages are set to be approximately adaptive for the characteristic of the pixel in the lower current region of 0-th to the 31-th gradation levels. The gradation voltages are set to same voltage as the gradation voltage of the 31-th gradation level in the higher current region of the 31-th to the 63-th gradation levels. The reason why the voltage drive is carried out before the current drive is in that the relation between a current drive time T and the current is expressed as $$T=CV/I,$$

so that it takes a certain time to reach the desirable voltage in case of smaller current.

The current is proportional to a square of the voltage in the current Id/voltage Vg characteristic of the driving TFT, i.e., $Id=k(Vg-Vt)^2$ (k is a proportion constant)

Even if the precharge voltage is fixed in the middle or higher current region, the desired voltage can be obtained by only the gradation current from the current driver 28 in a short time because the voltage difference in the middle or higher current region is small. Therefore, the number of switches can be decreased to (32+2) by controlling the first gradation selecting circuit 25*a* with the bits other than the most significant bit (MSB) and the MSB as shown in FIG. 27A. The switches of the first gradation selecting circuit 25*a* are desirably configured of the transfer switch as mentioned above.

In addition, the precharge voltage is not necessary to have accuracy since the precharging operation is a preliminary operation before the current drive. As a result, the least significant bit (LSB) and a next bit of the least significant bit may be invalidated in order to decrease the number of switches. FIG. 27B shows the circuit in which the least significant bit is invalidated and only even-numbered gradation levels are set. In this case, the number of switches is reduced to 32. Further, FIG. 27C shows a circuit in which the drive voltage difference is small in the low current region in the current drive and the circuit is configured of a combination of the circuits shown in FIGS. 27A and 27B. In this case, the number of switches can be decreased to (16+2).

When the first TFT 34 is configured of the N-channel transistor, the current driver 28 is configured of the P-channel transistor. The precharge voltage is a voltage near to the lower power supply voltage, and the second gradation voltage is a voltage near to the higher power supply voltage. When the first TFT 34 is configured of the P-channel transistor, the current driver 28 is configured of the N-channel transistor. The precharge voltage is a voltage near to the higher power supply voltage, and the second gradation voltage is a voltage near to the lower power supply voltage. In this way, the second gradation voltage selecting circuit 25*b* may be configured of a transistor having one of the two conductive types.

The second gradation voltage selecting circuit 25*b* selects the second gradation voltage in the precharge period and the current drive period. Therefore, a glitch dose not occur, which has conventionally occurred due to the voltage delay in the switching from the first gradation voltage to the second gradation voltage. The drive ability of the voltage driver 26 is 100 times or more larger than that of the current driver 28, whose current value is about 20 μA at maximum. Therefore, the precharge voltage is hardly influenced even if the voltage driver 26 and the current driver 28 are operated at the same time in the precharge period.

Fifth Embodiment

Figure 28:
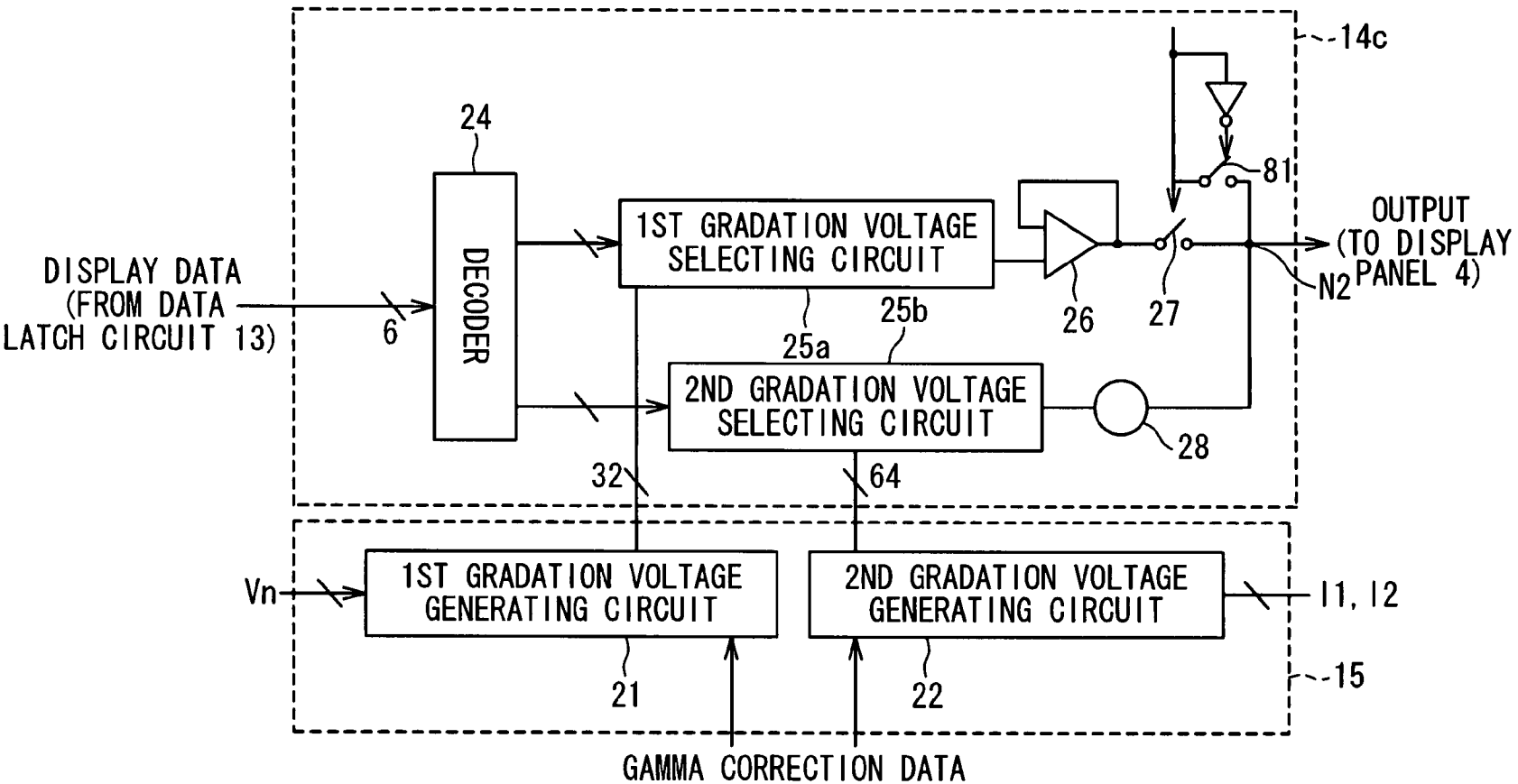
FIG. 28 is a block diagram showing the configuration of the D/A conversion circuit and the gradation voltage generating circuit in a fifth embodiment of the present invention.

The fifth embodiment of the present invention will be described below. FIG. 28 is a block diagram showing the configuration of a D/A conversion circuit 14*c* and the gradation voltage generating circuit 15 in the fifth embodiment of the present invention. As shown in FIG. 28, the D/A conversion circuit 14*c* includes a dummy switch 81 in addition to the above-mentioned D/A conversion circuit 14*b*. Referring to FIG. 28, the dummy switch 81 is connected with the data line 6 through the node N2. The output of the voltage driver 26 is connected with the data line 6 through the first switch 27 and the node N2. Each of the first switch 27 and the dummy switch 81 is configured from a transistor. The transistors have the same gate length L. The gate width W of the transistor of the dummy switch 81 is a half width of that of the transistor of first switch 27. In addition, a source and a drain of the transistor of the dummy switch 81 are short-circuited.

An operation of the D/A conversion circuit 14*c* shown in FIG. 28 will be described below. As mentioned above, the operation of the first switch 27 is controlled depending on whether the data line drive period is the precharge period or the current drive period. The D/A conversion circuit 14*c* is controlled so that the first switch 27 and the dummy switch 81 operate in opposite phases respectively. That is, when the first switch 27 is turned on, the D/A conversion circuit 14*c* turns the dummy switch 81 off. When the first switch 27 is turned off, the D/A conversion circuit 14*c* turns the dummy switch 81 of.

A glitch is caused by a circuit delay and a noise of the switch. The noise generated from the first switch 27 can be decreased by controlling the operation of the dummy switch 81 in the D/A conversion circuit 14*c* as described above. As a result, the glitch is restrained and quality of image to be displayed is improved in the display apparatus.

Figure 29:
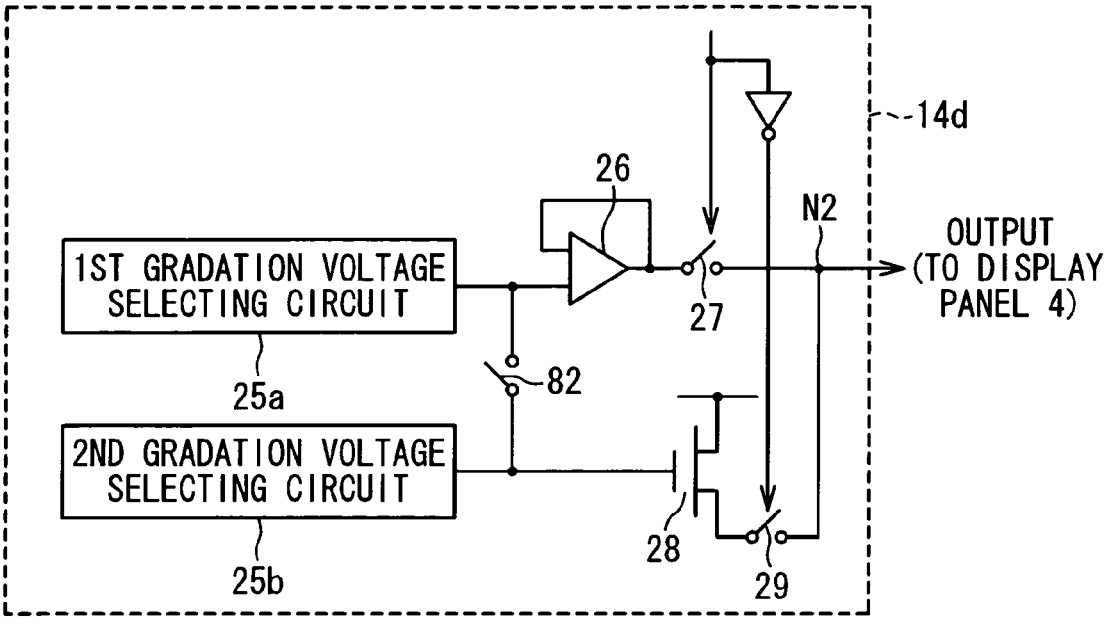
FIG. 29 is a block diagram showing the D/A conversion circuit in which a second switch is provided between the current driver and the data line.

The D/A conversion circuit 14*c* can be substituted by a D/A conversion circuit 14*d* in which a second switch 29 is provided between the current driver 28 and the data line 6 as shown in FIG. 29. In this case, the second switch 29 is turned off in the precharge period. The first switch 27 is controlled to be switched from the ON state to the OFF state in the switching from the precharge period to the current drive period. Here, in the switching, the second switch 29 is controlled to be switched from the OFF state to the ON state so that the period during which the first and second switches 27 and 29 are both turned on is present. The period during which the first and second switches 27 and 29 are both turned on contributes to restrain the glitch and quality of the image to be displayed is improved in the display apparatus.

Sixth Embodiment

Figure 30:
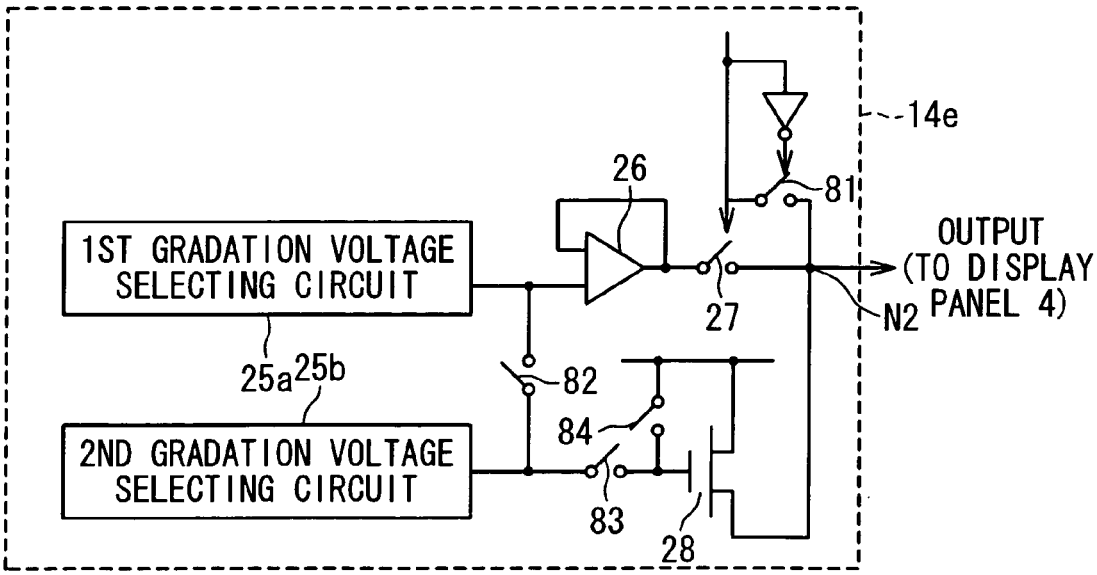
FIG. 30 is a block diagram showing the configuration of the D/A conversion circuit in a sixth embodiment of the present invention.

The sixth embodiment of the present invention will be described below. FIG. 30 is a block diagram showing a configuration of a D/A conversion circuit 14*e* in the sixth embodiment of the present invention. As shown in FIG. 30, the D/A conversion circuit 14*e* includes test switches for a final test carried out in shipping of the data line driving circuit 1. The D/A conversion circuit 14*e* includes a first test switch 82, a second test switch 83, and a third test switch 84.

An operation of the D/A conversion circuit 14*e* shown in FIG. 30 in a test mode will be described below. In a first stage in the test mode, it is checked whether or not the current corresponding to the 0-th gradation level is supplied from the current driver 28. In addition, it is checked whether or not currents of the first gradation level and the maximum gradation level are respectively within a predetermined current range. In a second stage in the test mode, the third test switch 84 is turned on, and the second test switch 83 is turned off. As a result, the current of the current driver 28 is blocked off. Further, all the switches of the first gradation voltage selecting circuit 25*a* are turned off to disconnect the first gradation voltage selecting circuit 25*a* from the voltage driver 26. Then, the first test switch 82 is turned on in order to connect the second gradation selecting circuit 25*b* and the voltage driver 26. At this time, whether the voltage of the second gradation selecting circuit 25*b* is within a predetermined range is checked for another gradation test. Here, the current corresponding to the 0-th gradation level is ideally 0 μA. Therefore, the 0-th gradation level can be checked by confirming the presence of a leakage current. Thus, the tests of the 0-th gradation level, the first gradation level, and the maximum gradation level are carried out by using the current driver 28. Then, the other gradation tests are carried out by using the voltage driver 26. In this way, the test can be completed in short time.

Seventh Embodiment

Figure 31:
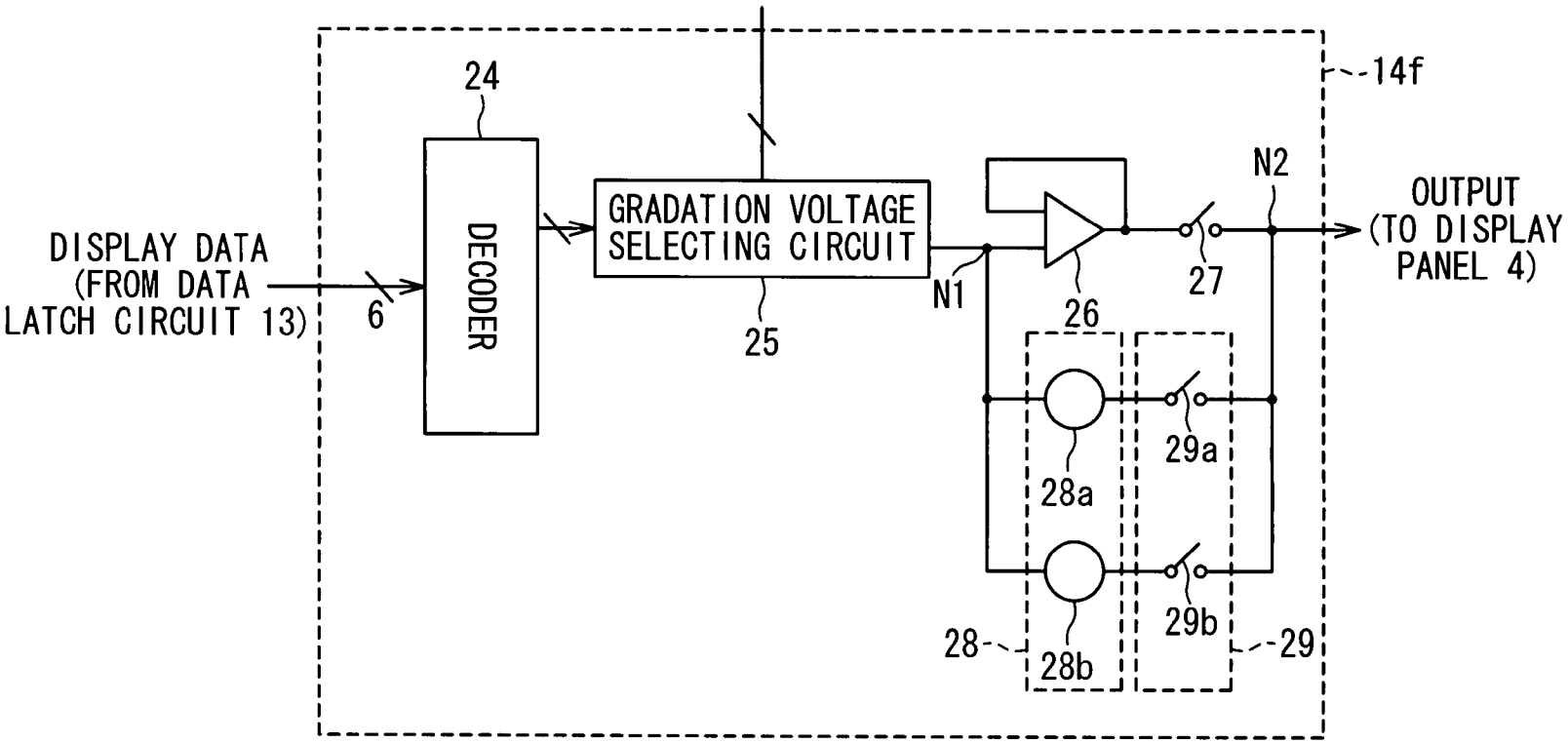
FIG. 31 is a block diagram showing the configuration of the D/A conversion circuit in the seventh embodiment of the present invention.

The seventh embodiment of the present invention will be described below. FIG. 31 is a block diagram showing the configuration of a D/A conversion circuit 14*f* in the seventh embodiment of the present invention. As shown in FIG. 31, the current driver 28 of the D/A conversion circuit 14*f* is configured from a first current driver 28*a* and a second current driver 28*b*. In addition, the second switch 29 of the D/A conversion circuit 14*f* is configured from a first current switch 29*a* and a second current switch 29*b*.

The first current driver 28*a* receives the gradation voltage selected by the gradation voltage selecting circuit and generates a flowing-out current based on the gradation voltage. The second current driver 28*b* receives the gradation voltage selected by the gradation voltage selecting circuit, and generates a flowing-in current based on the gradation voltage. As shown in FIG. 31, the input of the first current driver 28*a* is connected with the output of the gradation voltage selecting circuit 25 through the node N1. The output of the first current driver 28*a* is connected with the data line 6 through the first current switch 29*a* and the node N2. Similarly, the input of the second current driver 28*b* is connected with the output of the gradation voltage selecting circuit 25 through the node N1. The output of the second current driver 28*b* is connected with the data line 6 through the second current switch 29*b* and the node N2. Either the first current driver 28 or the second current driver 28*b* in the current driver 28 is specified based on the first TFT 34 in the pixel 5. Either the first current switch 29*a* or the second current switch 29*b* is specified in the second switch 29 based on the first TFT 34 of the pixel 5. The specified current switch 29*a* or 29*b* is turned on in the current drive period in response to the timing control signal supplied from the timing control circuit 16. As a result, the data line driving circuit 1 can be configured without depending on whether or not the first TFT 34 of the pixel 5 is of the N-channel transistor or the P-channel transistor. Therefore, in the manufacture of the driving circuit of the display apparatus, it is possible to flexibly cope with the configuration of the pixel 5 by switching the first current switch 29*a* and the second current switch 29*b*. This accomplishes the decrease in development cost. Trial manufactures of many kinds of panels are carried out depending on the design of the pixels in the development stage of the panel. Especially, in this stage, the quality of the panel can be tested by driving the panel by the same product.

Eighth Embodiment

Figure 32:
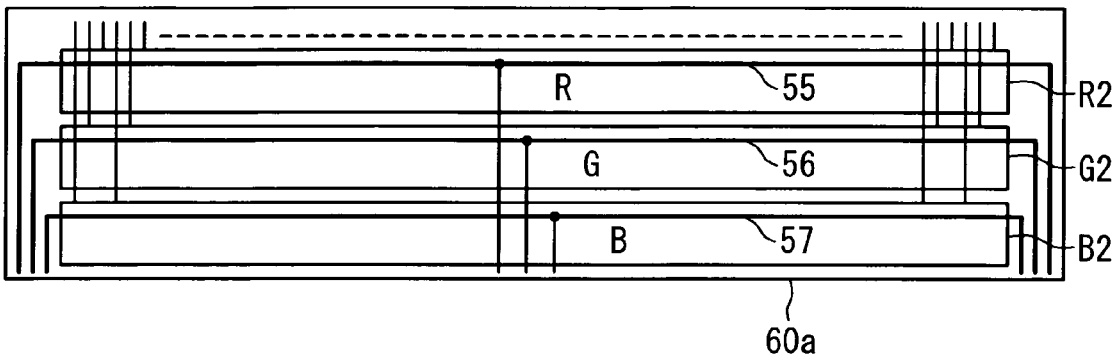
FIG. 32 is a diagram showing another layout of each circuit in the data line driving circuit.

The eighth embodiment of the present invention will be described below. The eighth embodiment is related to a layout of each circuit of the data line driving circuit 1. The layout of each circuit in the data line driving circuit 1 is desirable to be the layout shown in FIG. 14. However, other configurations are acceptable under a certain condition. FIG. 32 is a block diagram showing another layout of each circuit in the data line driving circuit 1. As shown in FIG. 32, a wiring 55 of R, a wiring 56 of G, and a wiring 57 of B are arranged as an arrangement 60*a*. The power supply voltage of the current driver 28 can be arranged in a different region for each of the RGB colors in the arrangement 60*a*. Though the gradation wiring area is three times wider than the arrangement shown in FIG. 14, the arrangement 60*a* is desirable when the drive voltage of the pixel to be driven is different for each RGB color.

The D/A conversion circuit 14 and the gradation voltage generating circuit 15 are arranged separately in a unit of an R (red) area R2, a G (green) area G2, and a B (blue) area B2 at least. In this case, the shift register circuit 11, the data register circuit 12, and the data latch circuit 1 may be arranged separately, and may be arranged in a same area. Thus, the power supply voltage and the gamma characteristic of the current driver 28 are changed for each of the RGB colors to achieve the display apparatus with high quality of display.

Figure 33:
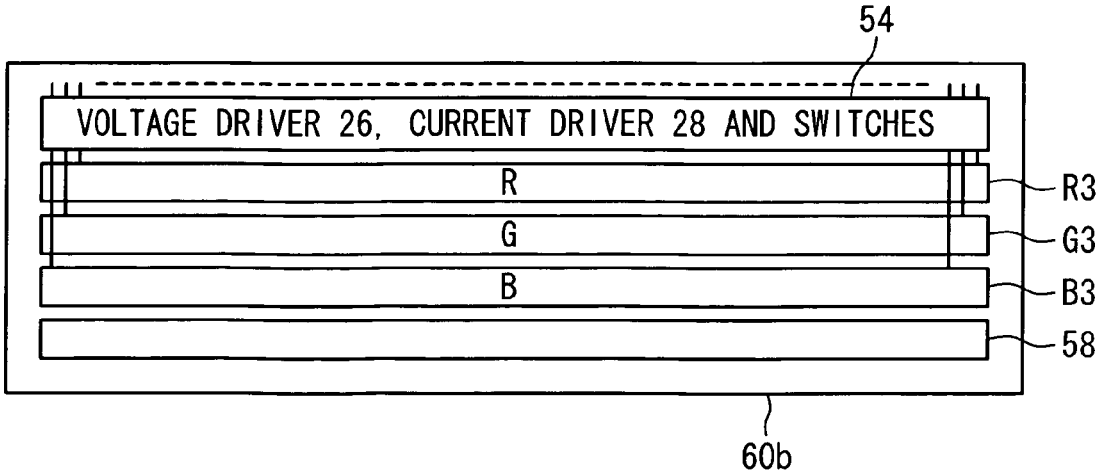
FIG. 33 is a diagram showing still another layout of the data line driving circuit.

FIG. 33 is a diagram showing still another layout of the data line driving circuit. As shown in an arrangement 60*b* of FIG. 33, the shift register circuit 11 is arranged in a second specific area 58. The data register circuit 12, the data latch circuit 13, the decoder 24 and the gradation voltage selecting circuit 25 (the first gradation selecting circuit 25*a* and the second gradation selecting circuit 25*b*) as a part of the D/A conversion circuit 14, and the gradation voltage generating circuit 15 are arranged separately for each of the RGB colors. An R (red) area R3, a G (green) area G3 and a B (blue) area B3 are areas where circuits corresponding to the R (red), the G (green) and the B (blue) are arranged. The voltage driver 26, the current driver 28 and the switches in the D/A conversion circuit 14 are all arranged in a second specific area 58 to decrease a parasitic capacitance at the output terminals. In the arrangement 66*b* shown in FIG. 33, the parasitic capacitance is small because the wiring length from the output terminal is short. Therefore, if the number of wirings on which the gradation voltages or currents are outputted is lager than the number of the output terminals, the arrangement 60 of FIG. 14 is preferable, and if the number of wirings on which the gradation voltages or currents are outputted is less than the number of output terminals, the arrangement 60*b* of FIG. 33 is preferable.

Ninth Embodiment

Figure 34:
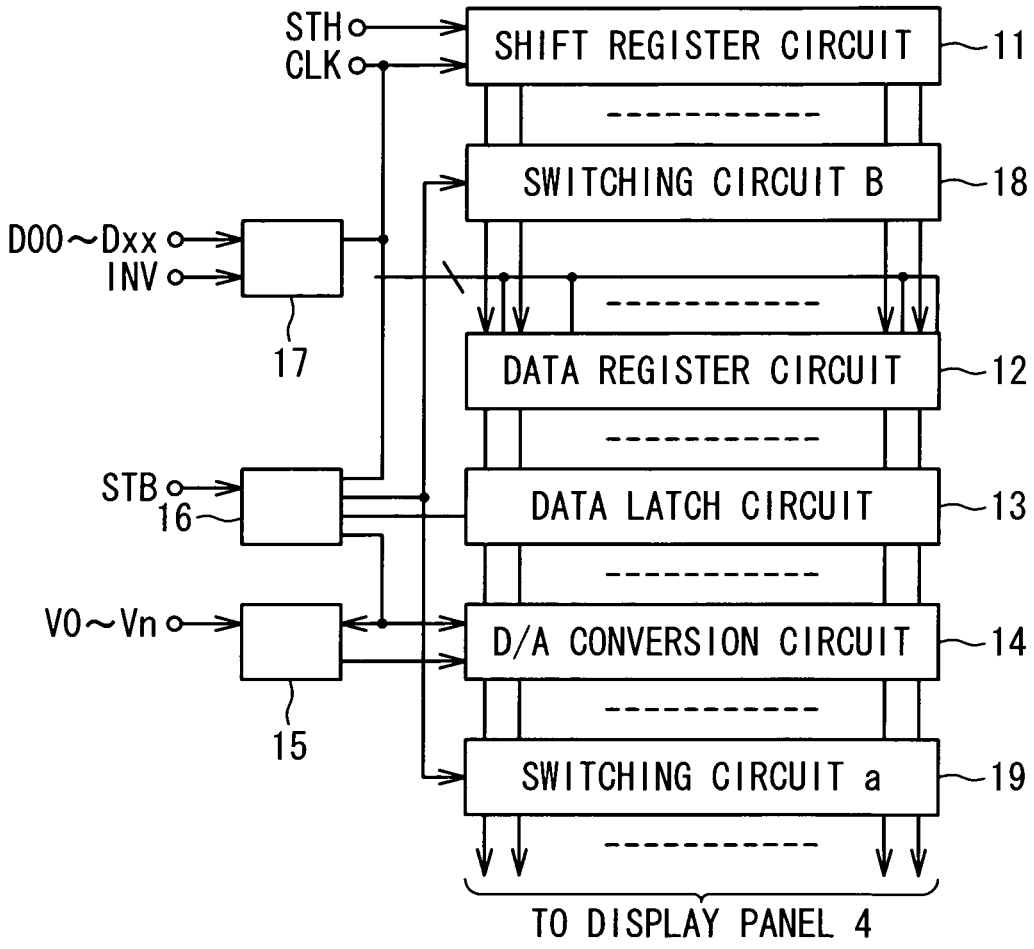
FIG. 34 is a block diagram showing the configuration of the data line driving circuit in a ninth embodiment of the present invention.

The ninth embodiment of the present invention will be described below. FIG. 34 is a block diagram showing the configuration of the data line driving circuit 1 in the ninth embodiment of the present invention. The data line driving circuit 1 in the ninth embodiment includes a switch circuit section in addition to the components of the above-mentioned data line driving circuit 1. The switch circuit section connects the data lines 6 to the D/A conversion circuit while sequentially switching the data lines 6. As shown in FIG. 34, the switch circuit section is composed a switch circuit A 18 and a switch circuit B 19. The switch circuit A 18 is connected with the output of the D/A conversion circuit, and the switch circuit B 19 is connected with the output of the shift register circuit 11 to switch image data by changing the order of sampling pulses.

The switch circuit section may switch the image data for every frame period or for every horizontal line. Also, the switching order may be random or regular. The control circuit 3 receives the clock signal CLK, a horizontal sync signal Hs, and a vertical sync signal Vs and generates timing signals to control the switch circuit section and the timing of the latch signal. The switch circuit section may be manufactured on a glass substrate and the other circuits may be manufactured on a silicon substrate. The deviation in characteristics of the current drivers 28 of each D/A conversion circuit 14 is distributed to time and space by the switch circuit section of the data line driving circuit 1 in the ninth embodiment. As a result, the image quality of the display apparatus can be improved.

Tenth Embodiment

Figure 35:
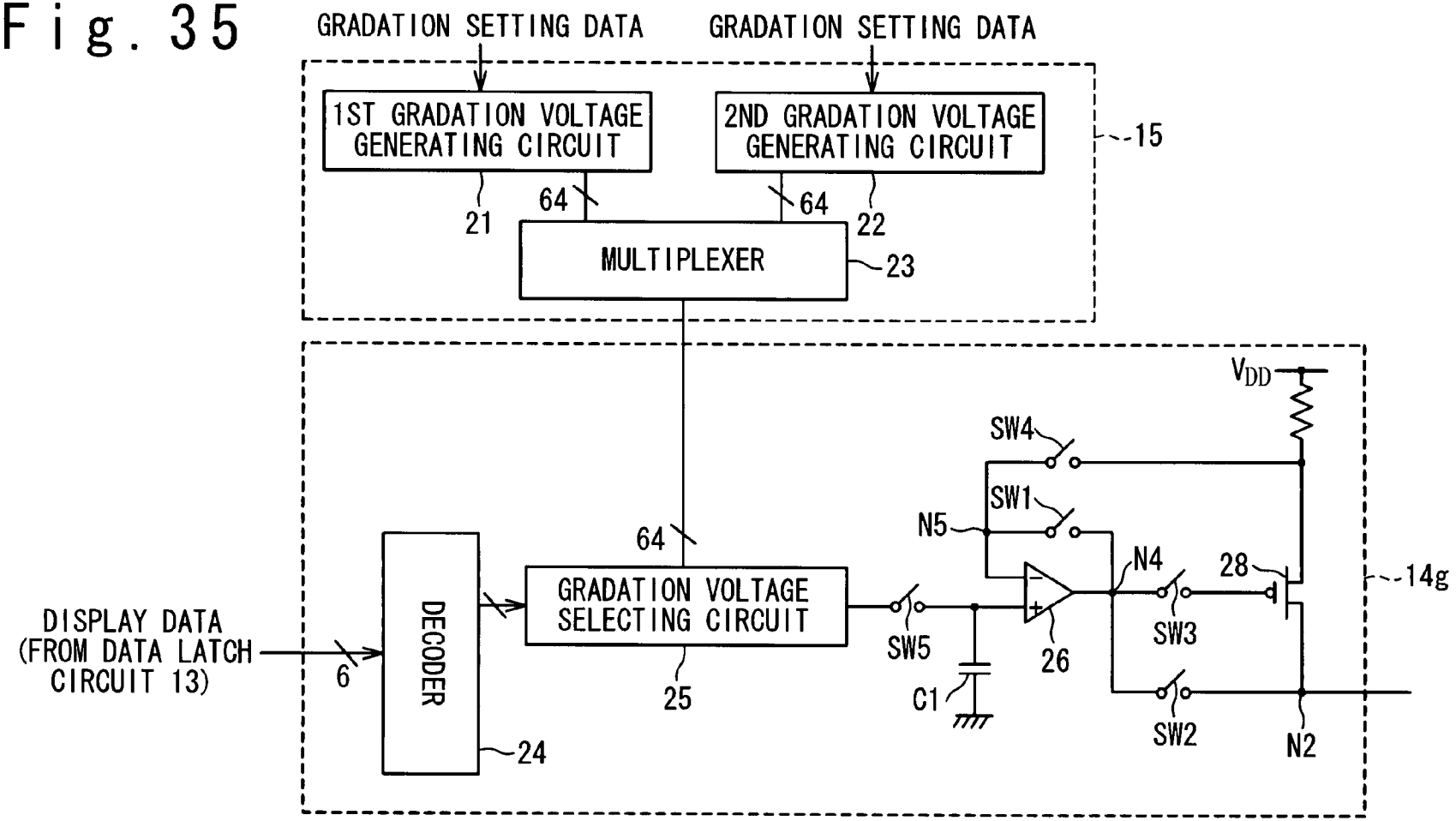
FIG. 35 is a block diagram showing the configuration of the gradation voltage generating circuit and the D/A conversion circuit in a tenth embodiment of the present invention.

The tenth embodiment of the present invention will be described below. FIG. 35 is a block diagram showing the configuration of the gradation voltage generating circuit 15 and a D/A conversion circuit 14*g* in the tenth embodiment of the present invention. The data line driving circuit 1 in the tenth embodiment of the present invention includes the gradation voltage generating circuit 15 and the D/A conversion circuit 14*g* connected with the gradation voltage generating circuit 15. In addition, the D/A conversion circuit 14*g* includes the decoder 24, the gradation voltage selecting circuit 25, the voltage driver 26, the current driver 28, a capacitor C1, and a plurality of switches (SW1 to SW5). The gradation voltage generating circuit 15, the decoder 24, and the gradation voltage selecting circuit 25 in the tenth embodiment have the same configuration in the above-mentioned embodiments. Therefore, the detailed description thereof is omitted in the following description.

The voltage driver 26 shown in FIG. 35 can drive the data line 6 in a high drive ability as mentioned above. Also, the current driver 28 can drive the data lines 6 in a constant current determined based on the selected gradation voltage as mentioned above. As shown in FIG. 35, the first gradation voltage generating circuit 21 of the gradation voltage generating circuit 15 is connected with the multiplexer 23. Similarly, the second gradation voltage generating circuit 22 is connected with the multiplexer 23.

The output terminal of the gradation voltage selecting circuit 25 is connected with a normal input terminal of the voltage driver 26 through the switch SW5. Moreover, the capacitor C1 is connected between the normal input terminal and the ground potential. The output terminal of the voltage driver 26 is connected with a node N4. The switch SW1 is connected between the node N4 and an inversion input terminal of the voltage driver 26 through a node N5. Also, the output terminal of the voltage driver 26 is connected with the switch SW2 through the node N4. The voltage driver 26 operates as a voltage follower by shutting the switches SW1 and SW2 at the same time. In addition, the switch SW3 is connected between the output of the voltage driver 26 is connected with the switch SW3 and the gate of the P-channel transistor of the current driver 28 through the node N4. Also, the switch SW4 is connected between the inversion input terminal of the voltage driver 26 and the source of the above-mentioned P-channel transistor through the node N5. The drain of the P-channel transistor is connected with the data line 6 (not shown) through the node N2. The above-mentioned switch SW2 is connected with the data line 6 through the node N2.

Figures 36A, 36B, 36C, 36D, 36E:
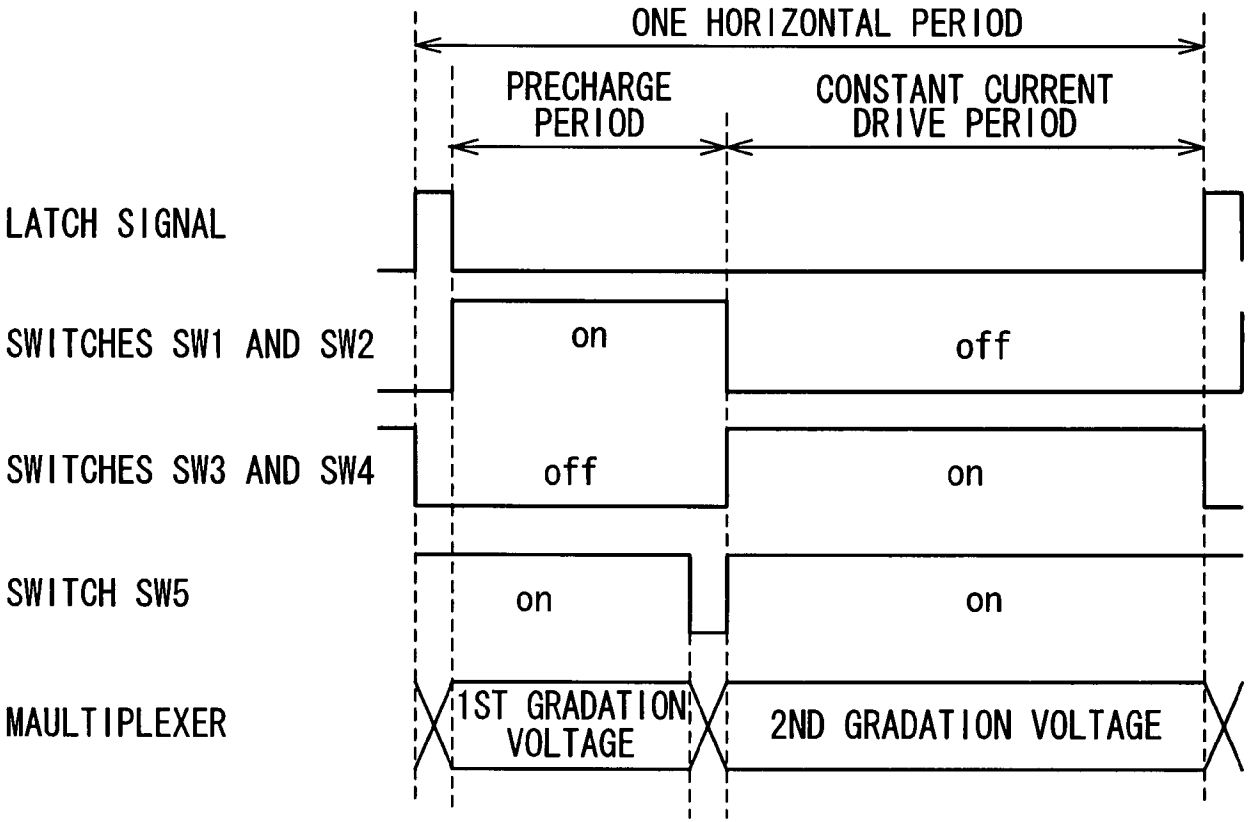
FIGS. 36A to 36E are timing charts showing an operation of the tenth embodiment.

FIGS. 36A to 36E are timing charts showing an operation of the tenth embodiment. One horizontal period in the tenth embodiment includes the precharge period and the current drive period. FIG. 36A shows an operation waveform of the latch signal. FIG. 36A to FIG. 36D shows the timing of ON/OFF of each switch in the D/A conversion circuit 14*g*. FIG. 36E shows an output from the multiplexer 23.

As shown in FIGS. 36A to 36E, each of the switches SW1 and SW2 is set to the ON state in the precharge period (FIG. 36B). At this time, the switches SW3 and SW4 are set to the OFF state (FIG. 36C). As shown in FIG. 36E, the first gradation voltage is outputted from the multiplexer 23 in the precharge period. When the capacitor C1 is charged up to the first gradation voltage, the switch SW5 is turned off immediately before switching from the precharge period to the current drive period. The first gradation voltage is held since the switch SW5 is turned off. Each of the switches SW1 and SW2 is switched from the ON state to the OFF state in the current drive period (FIG. 36B). At this time, each of the switches SW3 and SW4 is switched from the OFF state to the ON state (FIG. 36C). The second gradation voltage is outputted from the multiplexer 23 in the current drive period. The switch SW5 is set to the ON state after the output of the gradation voltage selecting circuit 25 is switched into the second gradation voltage.

Figure 37:
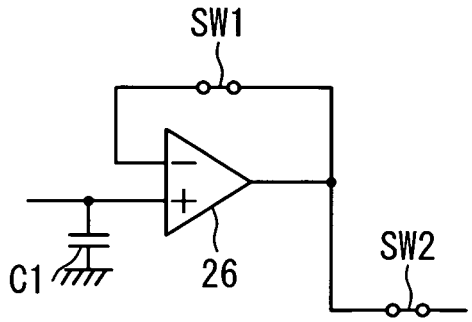
FIG. 37 is a circuit diagram showing the configuration of a circuit in the latter stage of the gradation voltage selecting circuit in a precharge period.

FIG. 37 is a circuit diagram showing the configuration of a circuit in the latter stage of the gradation voltage selecting circuit 25 in the above-mentioned precharge period. As shown in FIG. 37, the first gradation voltage is supplied from the gradation voltage selecting circuit 25 to the data line 6 through the voltage follower when the switches SW1 and SW2 are turned on (closed), and the switches SW3 and SW4 are turned off (opened) in the precharge period. It should be noted that though being not shown in FIG. 37, it is desirable that a switch which operates in conjunction with the switch SW3 is provided on the gate of the P-channel transistor of the current driver 28. It is preferable that the operating switch is connected with a signal line which has the same voltage as the signal voltage in a high level, and operates to supply the signal voltage of the high level to the above-mentioned gate in response to the switch SW3 being turned off.

Figure 38:
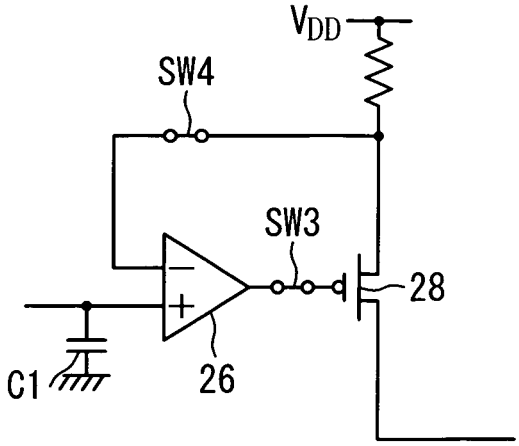
FIG. 38 is a circuit diagram showing the configuration of the circuit in the latter stage of the gradation voltage selecting circuit in a current drive period.

FIG. 38 is a circuit diagram showing the configuration of the circuit in the latter stage of the gradation voltage selecting circuit 25 in the above-mentioned current drive period. As shown in FIG. 38, the output terminal of the voltage driver 26 is connected with the gate of the P-channel transistor of the current driver 28 when the switches SW1 and SW2 are opened, and the switches SW3 and SW4 are closed in the current drive period. As a result, the current driver 28 shown in FIG. 38 generates the gradation current for driving the pixel 5 in response to the output from the voltage driver 26 and supplies the gradation current to the data line 6. The configuration of the D/A conversion circuit 14*g* in the tenth embodiment enables the pixel to be driven with a slight current. Moreover, the glitch generated at the switching from the voltage drive to the current drive can be restrained. Therefore, it is possible to prevent the generation of an irregular display.

It is possible to combine the embodiments described above as long as being not conflicted with each other. Also, the data line drive period mentioned above is not necessarily same length as one horizontal period at each line scanning. In order to reduce the circuit scale of the data line driving circuit 1, one horizontal period may be divided into three drive periods based on 3-color pixels, for instance. In this case, the data latch circuit outputs three display data of three data lines 6 sequentially for every drive period. The D/A conversion circuit may be shared for every three data lines 6. The tree data lines 6 of the display panel 4 in the display apparatus are driven in a time divisional manner for every drive period of the three data lines 6 in response to the output from the D/A conversion circuit.

In the drive circuit of the display apparatus of the present invention, the plurality of gradation voltage subjected to the gamma correction are generated, and one selected from the plurality of gradation voltage is D/A-converted. Then, a desired gradation current is generated by the current driver with a single transistor based on the D/A conversion result of the selected gradation voltage. Thus, the circuit scale of the D/A converting circuit in the data line drive circuit can be made small. Since the D/A conversion circuit is provided for every data line or every data lines, the circuit scale of the data line drive circuit can be also reduce.

Also, according to the drive circuit of the display apparatus of the present invention, the gamma correction can be carried out without increasing the number of bits of the display data. Thus, the power consumption between the control circuit and the data line drive circuit can be restrained. Also, since the current driver of the D/A conversion circuit is composed of a single transistor so that parasitic capacity is decreased, the data line can be driven with a sufficiently smaller current value. In addition, the drive current for the pixel is set individually in the gradation voltage generation circuit previously. Also, the data line drive circuit drives the data line and the pixel at high speed with the precharge voltage by the voltage driver in the precharge period. Then, the data line and the pixel are driven by the current driver in the current drive period. Therefore, a voltage amplitude when the data line and the pixel are driven by the voltage driver can be made smaller. Also, the pixel can be driven with a sufficiently small current in a short time.

Moreover, the drive circuit of the display unit according to the present invention generates the plurality of gradation voltages from the resistance string circuit. Therefore, the gradation voltage increases monotonously. Also, because a current is generated from the gradation voltage by the current driver with a single transistor, the data line drive circuit of the current drive type can be produced, resulting in improvement of the image quality.

Moreover, the drive circuit of the display unit according to the present invention, the monotonous increase of the gradation voltage can be confirmed based on only the voltage levels for the 0-th gradation level, the first gradation level and the maximum gradation level. The test of bit dependence can be carried out at high speed by testing the input of the current driver by the voltage driver.

Moreover, the drive circuit of the display unit according to the present invention, the data line drive circuit is formed on the silicon substrate and the gradation voltage is set individually by the gradation voltage generation circuit in consideration of the degradation of transistor characteristic on the glass substrate. Thus, the data line drive circuit can be produced to have less deviation in characteristic and less influence of the degradation of transistor characteristic produced on the glass substrate.

Moreover, in the drive circuit of the display unit according to the present invention, a current drive is carried out by the current driver while the voltage drive period is carried out by the voltage driver. Therefore, no delay is caused in switching from the voltage drive to the current drive. Thus, the generation of a glitch due to noise of the switch can be restrained.

Eleventh Embodiment

Hereinafter, a drive circuit for a display apparatus according to the present invention will be described with reference to the attached drawings. In the present invention, it is assumed that display data is 6 bits of "D5, D4, D3, D2, D0, D0" of (64 degradation levels), the most significant bit (MSB) is D5 and the least significant bit (LSB) is D0. Also, it is assumed that the brightness is in the lowest level in case of "000000" and is in the highest level in case of "111111". It should be noted that the display data may be 7 bits or 5 bits.

Figure 39A:
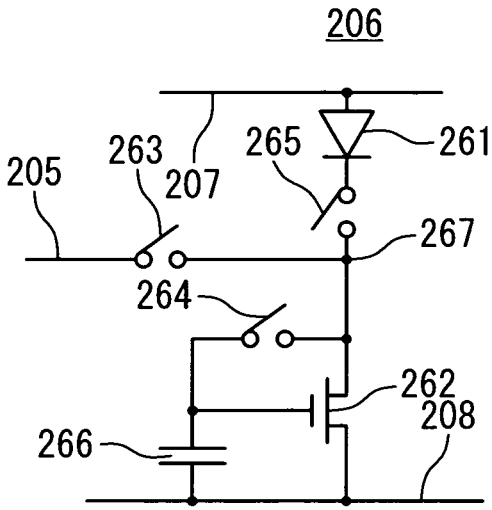
FIG. 39A is a circuit diagram showing the configuration of a current copy-type pixel driven by a drive circuit.

A drive circuit according to the eleventh embodiment of the present invention will be described below. First, a display apparatus is driven by the drive circuit 210 of the present invention and has a pixel 206 of a current copy type. With reference to FIG. 39A, the pixel will be described. The pixel 206 is composed of a light emitting element 261, a drive transistor (TFT) 262, and switch transistors (TFT) 263, 264, and 265 and a capacity 266. One end of the light emitting element 261 is connected with a voltage supply line 207, and the other end of the light emitting element 261 is connected with the one end of the switch transistor 265 and the other end of the switch transistor 265 is connected with a node 267. Also, the source of the drive transistor 262 is connected with a voltage supply line 208 and a drain thereof is connected with the node 267. The node 267 is connected with the other end of each of the switch transistors 263, 264, and 265. One end of the switch transistor 263 is connected with the data line 205 and one end of the switch transistor 264 is connected with the gate of the drive transistor 262 and one end of the capacitance 266. Also, the other end of the capacitance 266 is connected with the voltage supply line 208. Although being not shown in figures, a control signal is supplied to the gate of each of the switch transistors 263, 264 and 265. Here, in the subsequent description, the voltage of voltage supply line 208 will be described as the system ground GND.

Figure 39B:
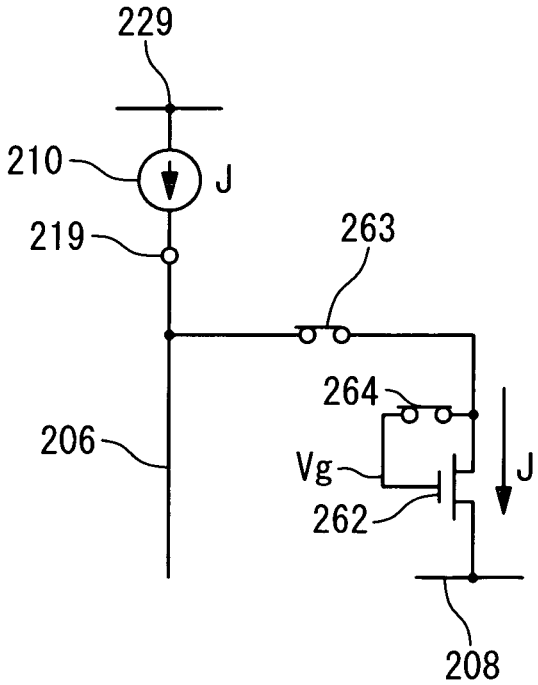
FIG. 39B is an equivalent circuit diagram when current of a predetermined current value flows in the pixel.

Next, an operation when the pixel 206 stores an current value will be described with reference to FIG. 39A and FIG. 39B. In a current storage mode, the switch transistors 263 and 264 are turned on and the switch transistor 265 is turned off. At this time, current of a current value J is supplied from a drive circuit 210 to the drive transistor 262 through the data lines 205 and the switch transistor 263, and the gate and drain of the drive transistor 262 are self-biased to the voltage of Vg for the current of the current value J to flow, as shown in FIG. 39B. Then, the switch transistor 264 is turned off and the gate voltage Vg of the drive transistor 262 is stored in the capacitance 266. When the switch transistor 263 is turned off and the switch transistor 265 is turned on, the pixel enters a light emitting mode and the light emitting element 261 emits light in a brightness determined in accordance with the current value J.

Figure 40:
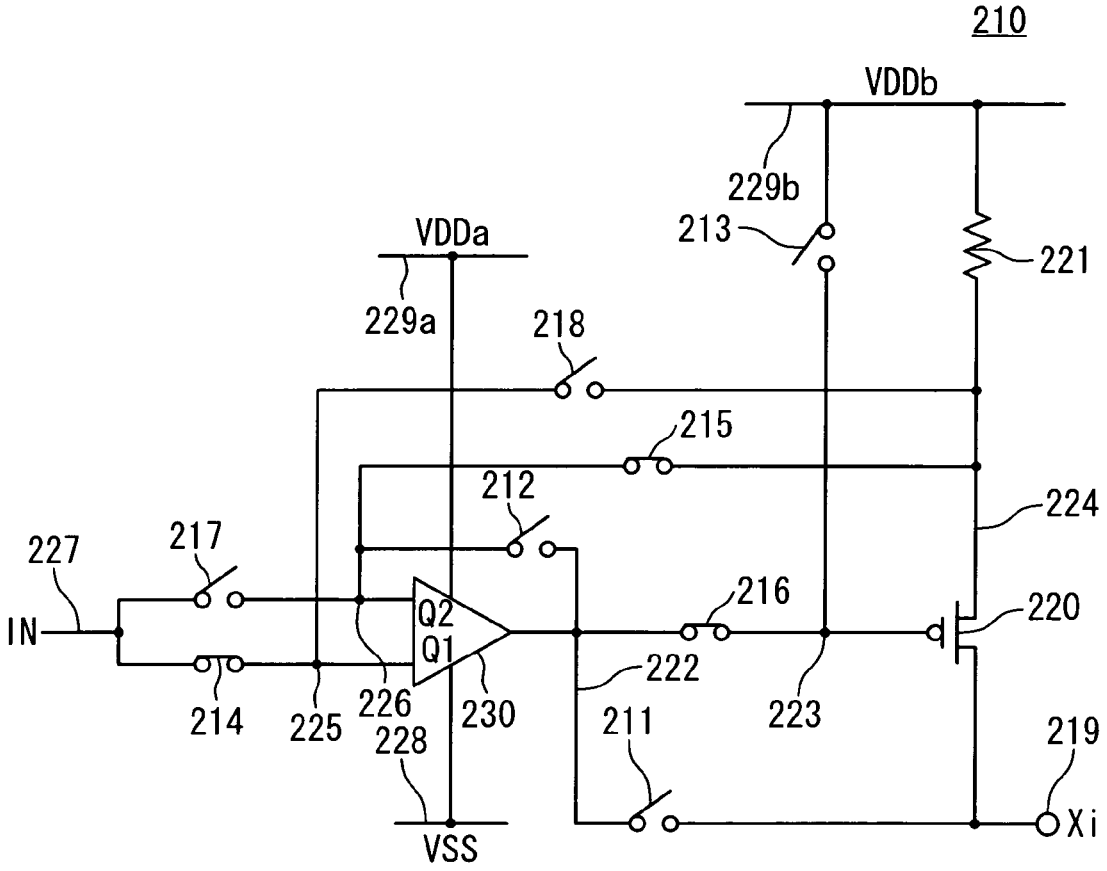
FIG. 40 is a circuit diagram showing the configuration of the drive circuit according to a first embodiment of the present invention.

FIG. 40 is a circuit diagram showing the configuration of the drive circuit 210 for the display apparatus according to the first embodiment of the present invention. The drive circuit 210 shown in FIG. 40 is composed of switches 211 to 218, an output terminal 219, a drive transistor 220, a resistance 221 and a differential amplifier 230. In the present invention, the differential amplifier 230 of the drive circuit 210 is shared in a precharge period and a current drive period. Moreover, a current value deviation due to the offset voltage deviation of the differential amplifier 230 is averaged every scan period or frame period, resulting in picture quality being improved.

Figure 42:
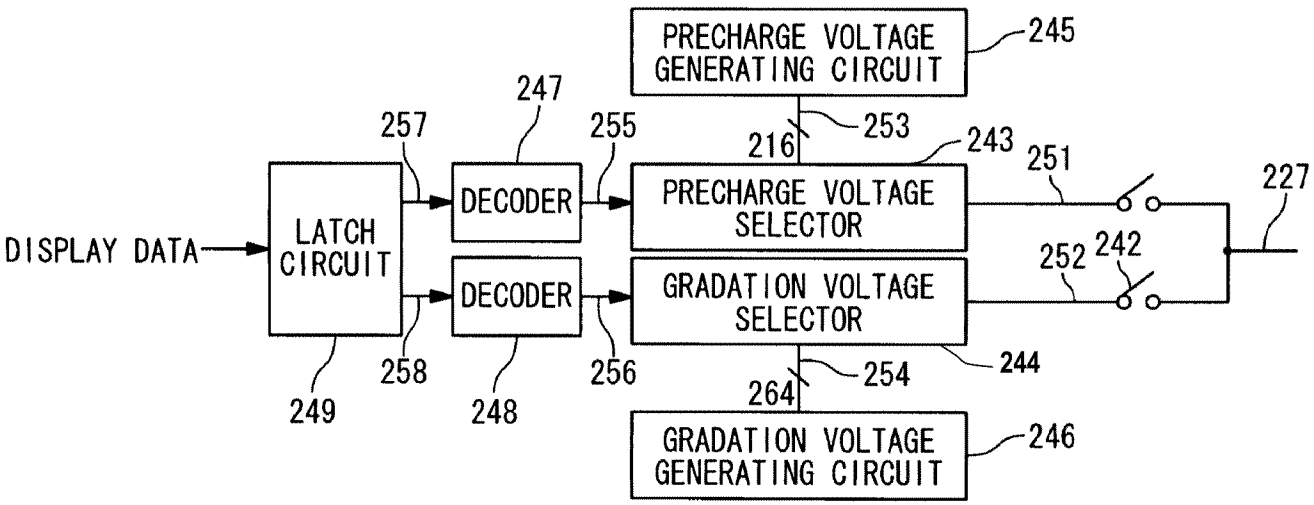
FIG. 42 is a block diagram showing the configuration of a supply circuit of the drive circuit for supply of a precharge voltage or a gradation voltage in the present invention.

The configuration of the drive circuit 210 will be described in detail with reference to FIG. 40. First, the differential amplifier 230 is composed of a differential input transistor Q1 and a differential input transistor Q2 as described later. The gate of the differential input transistor Q1 or a node 225 is connected to one end of the switch 214. Also, the gate of the differential input transistor Q2 or a node 226 is connected to one end of the switch 217. Then, the other ends of these switches are short-circuited as a node 227. The precharge voltage or the gradation voltage selected by two selectors 243 and 244, as shown in FIG. 42, is supplied to the node 227. Also, the output of the differential amplifier 230 or a node 222 is connected to one end of each of the switches 211, 212 and 216. The other end of the switch 211 is connected with the output terminal 219, and the other end of the switch 212 is connected with the node 226, and the other end the switch 216 is connected with the gate of the drive transistor 220 or a node 223. Also, the drain of the drive transistor 220 is connected with the output terminal 219 and the source of the drive transistor 220 or a node 224 is connected with the one end of the resistance element 221. The other end of the resistance element 221 is connected with the power supply line 229*b*. Moreover, the node 223 is connected with the one end of the switch 213 and the other end the switch 213 is connected with the power supply line 229*b*. The node 224 is connected with one end of the switch 218 and the node 225 is connected with the other end of the switch 218. Also, the node 224 is connected with one end of the switch 215 and the node 226 is connected with the other end of the switch 215. The switches 211 to 218 are controlled by a control unit (not shown).

The following description will be made under the assumption that the drive circuit 210 is a flow-out type gradation current circuit, and the drive circuit 210 operates in the power supply voltage VDD=20V and the power supply voltage VSS=5V. Of course, the drive circuit 210 may be a flow-in type gradation current circuit depending on the structure of a pixel 206.

Figure 41:
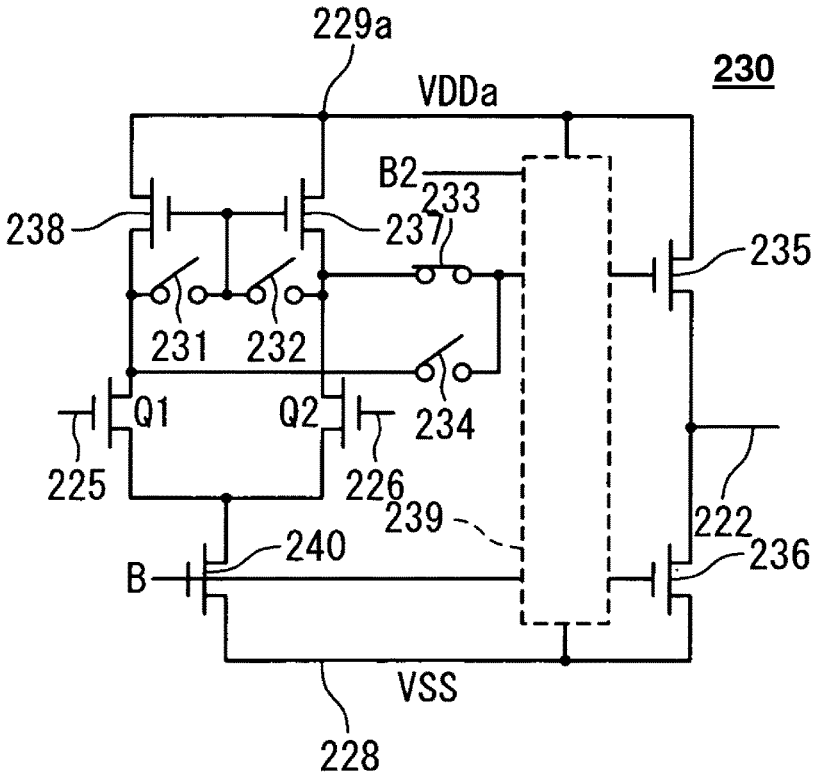
FIG. 41 is a circuit diagram showing the configuration of a differential amplifier used for the drive circuit in the present invention.

Next, the differential amplifier 230 will be described with reference to FIG. 41. The differential amplifier 230 is composed of differential input transistors Q1 and Q2 for a differential input stage, a plurality of switches 231 to 234, transistors 237 and 238 of a current mirror structure and a transistor 240 as a constant current source. Here, the switches 231 to 234 are used to switch the differential input transistors Q1 and Q2 between an inversion input mode or a non-inversion input mode. The control of switches 231 and 233 for on-off state is opposite to that of the switches 232 and 234. The switches 231 to 234 are controlled by the control unit (not shown). An output stage is composed of transistors 235 and 236. Also, a middle stage 239 is provided between the differential input stage and the output stage, and it is desirable that the differential amplifier 230 operates in a push-pull manner.

It is desirable that the power supply line 229*a* of the differential amplifier 230 and the power supply line 229*b* connected with resistance element 221 are separated. This is because a plurality of drive circuits 210 are used so that voltage drop is caused in the power supply line due to the current flowing through the differential amplifier 230, resulting in large current value deviation.

Next, the circuit which supplies the precharge voltage or the gradation voltage to the drive circuit 210 will be described with reference to FIG. 42. In FIG. 42, the circuit is composed of a latch circuit 249 which latches the display data for a predetermined period, a decoder 247 which decodes all the bits of a part of the display data, and a decoder 248 which decodes all the bits of the display data. Also, the circuit is further composed of a precharge voltage generating circuit 45 which generates a plurality of precharge voltages, a gradation voltage generating circuit 246 which generates a plurality of gradation voltages, a precharge voltage selector 43 which selects one of the plurality of precharge voltages according to the bits of the part of the display data, and a gradation voltage selector 244 which selects a desired one of the plurality of gradation voltages according to all the bits of the display data. Also, the circuit is further composed of switches 241 and 242, each of which selects precharge voltage or gradation voltage, and a control unit (not shown). The switches 241 and 242 are controlled by the control unit.

Figure 43A:
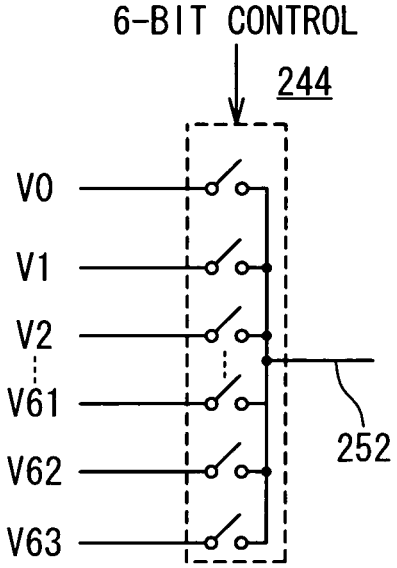
FIGS. 43A and 43B are circuit diagrams showing a gradation voltage selector and a precharge voltage selector in the drive circuit of the present invention.
Figure 43B:
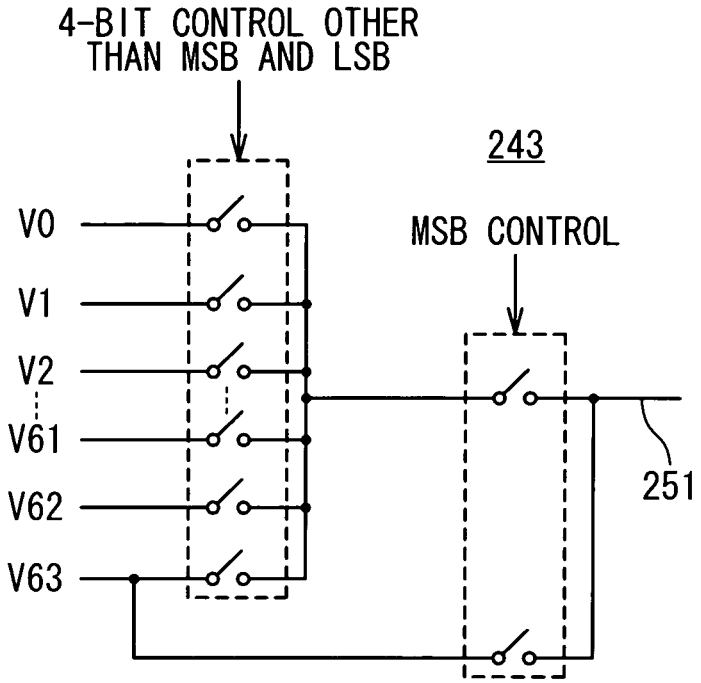

The gradation voltage selector 244 is composed of 64 switches shown in FIG. 43A and the gradation voltages V0 to V63 with 64 values are supplied to the respective switches. On the other hand, a precharge voltage selector 243 is composed of 218 switches shown in FIG. 43B. Because it is a preliminary operation before the current drive by the gradation current circuit, the voltage precharge operation does not need voltage precision. Also, because the change of the current characteristic of the drive transistor 262 is too large, it does not need voltage precision. The voltage precharge is sufficient to be carried out only in the low brightness light emitting region, i.e., the current region driven in the low current value. In the high current value, because the current value is larger than 210 times of the low current value, the data line and the pixel can be driven during a predetermined current drive period without precharge. Therefore, the precharge voltage is selected from among the 16 precharge voltages VC0 to VC15 based on four bits except for the least significant bit (LSB) and the largest significant bit (MSB) to correspond to the low brightness region. In the high brightness region, the precharge voltage of VC15 is supplied to the data line 205 and the pixel 206. The brightness region is divided into two by setting the low brightness region in case of the MSB of "0" and the high brightness region in case of the MSB of "1".

Figure 44:
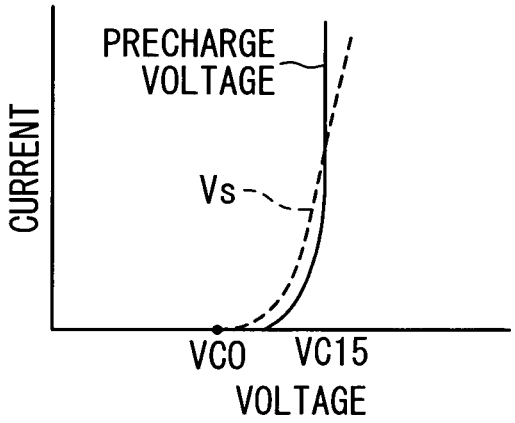
FIG. 44 is a graph showing voltage-current characteristic of a drive transistor of the drive circuit of the present invention.
Figures 45A, 45B, 45C, 45D, 45E, 45F, 45G, 45H, 45I, 45J:
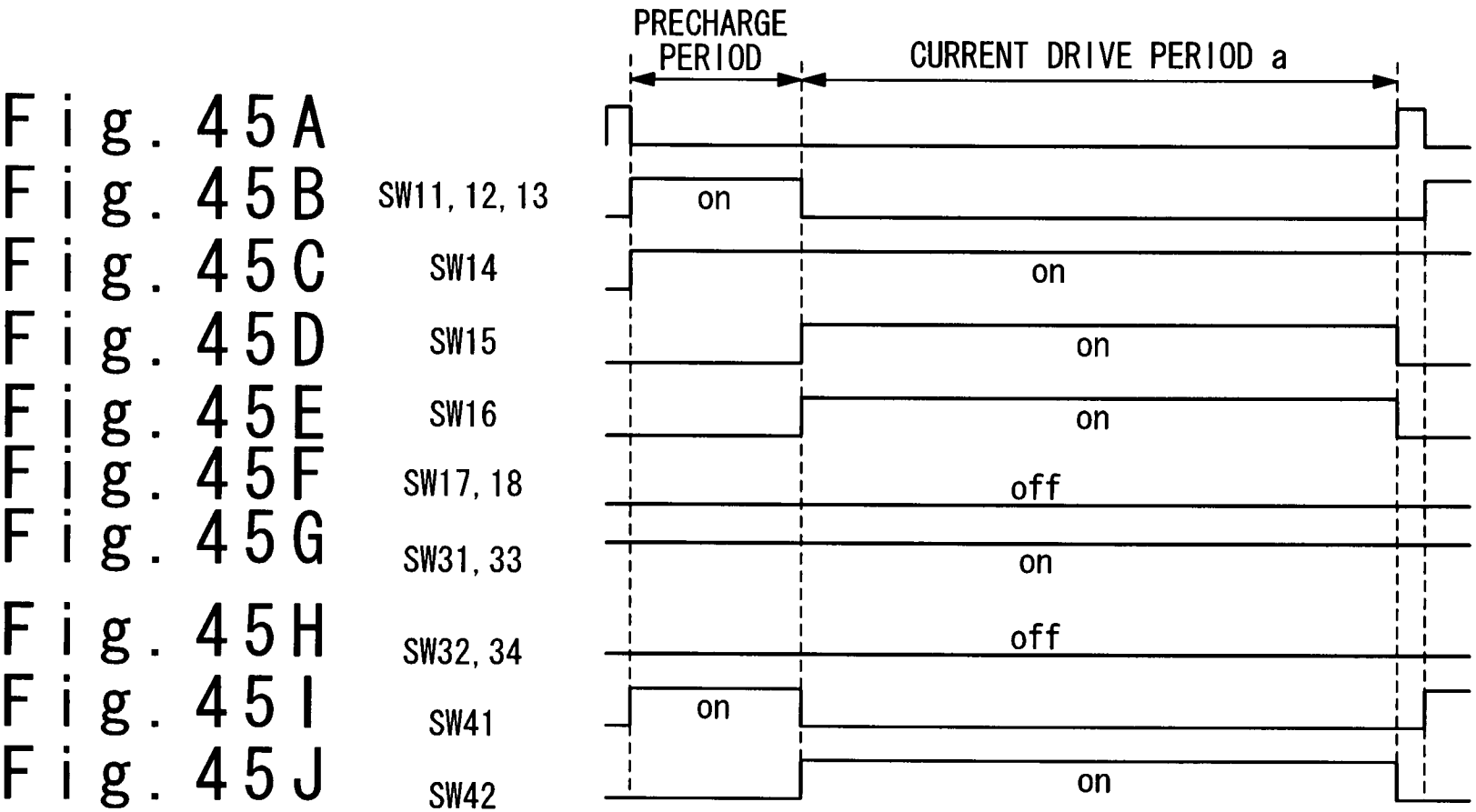
FIGS. 45A to 45J are timing charts showing an operation of the drive circuit according to the first embodiment of the present invention.
Figures 46A, 46B, 46C, 46D, 46E, 46F, 46G, 46H, 46I, 46J:
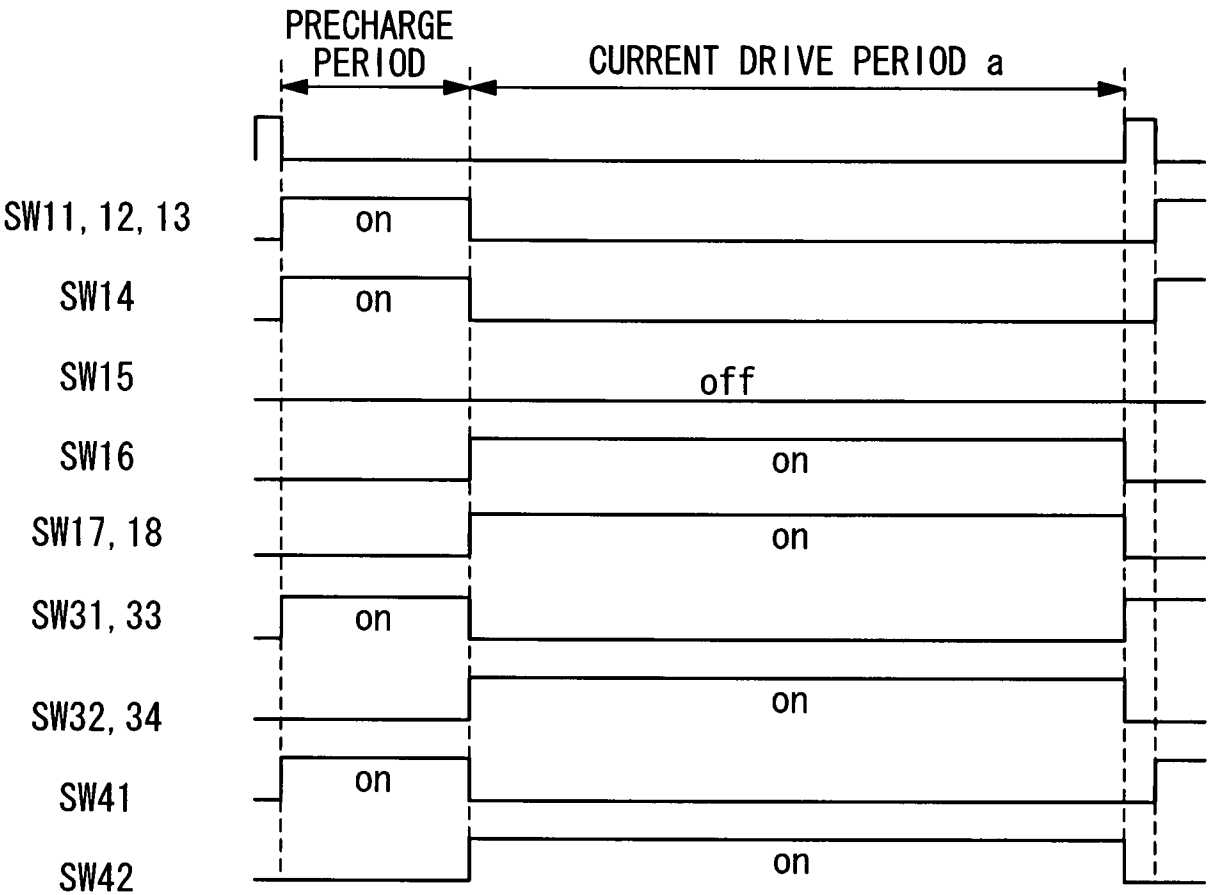
FIGS. 46A to 46J are timing charts showing another operation of the drive circuit according to the first embodiment of the present invention.

The precharge voltage generating circuit 245 generates precharge voltages before the current drive period. FIG. 44 shows a voltage—current characteristic of the drive transistor (TFT) 262. The characteristic of the drive transistor 262 is shown by the dotted line, and a setting example of the precharge voltage is shown by the solid line. When the current value is small, the precharge voltage is dependent on the characteristic of the drive transistor 262, and when the current value is large, it is fixed to VC15. For example, the current drive cannot be carried out in the 0 gradation level since the current value is 0. Therefore, VC0 needs not to be near VC1 if it is lower than a threshold voltage Vt of the drive transistor 262 such as 5 V.

The gradation voltage generating circuit 246 generates the plurality of gradation voltages to generate the plurality of gradation currents that are subjected to gamma correction. The current of the value J=ΔV/R flows due to the voltage drop or voltage difference ΔV in the resistance element 221 of the drive circuit 210. For example, if the value R of the resistance element 221 is 500 KΩ, and the gradation voltages are generated such that 0 nA is in case of 0th gradation level, 20 nA is in case of 1st gradation level, . . . , 10 μA in case of 63rd gradation level. In this case, various gradation voltages are generated, V0=20V (ΔV=0V) in case of 0th gradation level, V1=19.99V (ΔV=0.01V) in case of 1st gradation level, . . . , V63=15V (ΔV=5V) in case of 63rd gradation level.

The circuit shown in FIG. 42 is an example of the circuit which supplies the precharge voltage or the gradation voltage to the drive circuit 210, and may have another circuit configuration. For example, current may be supplied to the pixel and the dummy pixel and the precharge voltage may be generated from the voltage caused due to the current.

A plurality of data lines 205 are provided for the display apparatus, and a plurality of drive circuits 210 are provided. Therefore, the current deviation of each drive circuit 210 influences a picture quality. The main cause of the current deviation of the drive circuit 210 is a resistance value deviation of the resistance element 221 and an offset voltage deviation of the differential amplifier 230. The offset voltage deviation of the differential amplifier 230 is determined based on a relative deviation between the differential input transistor Q1 and the differential input transistor Q2, and a relative deviation between the transistor 237 and transistor 238 in the current mirror configuration. The voltage deviation of the differential amplifier 230 is about ±10 mV generally and current precision in the low brightness region is aggravated. Especially, in the 1st gradation level, the voltage difference ΔV is 10 mV and monotonous increase property is lost when the voltage deviation is ±10 mV. It could be considered that the voltage difference is set to a value such that the voltage deviation ±10 mV of the differential amplifier 230 can be ignored. For example, if the resistance value of the resistance element 221 is 2 MΩ, ΔV=20 nA×2 MΩ=40 mV. However, in order to set 10 μA as the 63th gradation level, the voltage difference ΔV=10 μA×2 MΩ=20 V is necessary. Thus, the circuit region has become large in addition to the large drive voltage of the drive circuit 210 and large consumed power.

In the present invention, the picture quality is improved by averaging the offset voltage temporally through switching of the differential input transistors Q1 and Q2 of the differential amplifier 230 every frame, so that the deviation of the current to be supplied to a pixel is averaged temporally.

Next, the operation of the drive circuit 210 will be described in detail with reference to the timing charts of FIG. 45A to 45J.

Figure 47A:
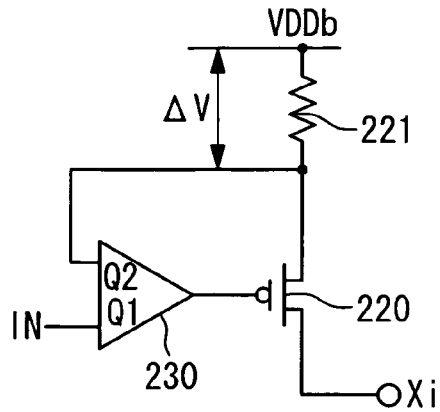
FIGS. 47A to 47C are equivalent circuits of the drive circuit of the present invention.
Figure 47B:
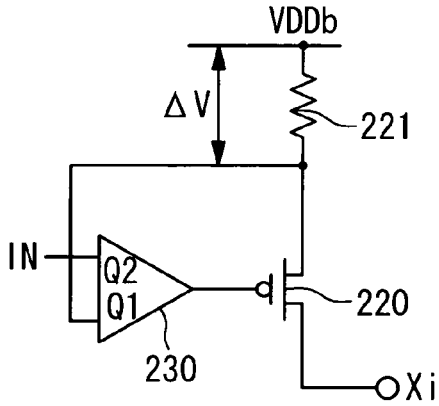
Figure 47C:
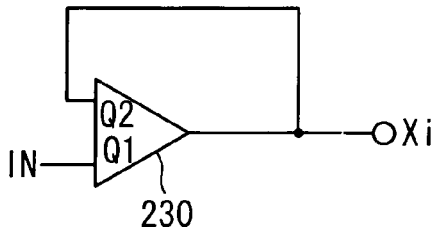

First, in the beginning of the horizontal period (a scan period), the display data is latched by the latch circuit 249. In the following precharge period, precharge of the data lines 205 is carried out based on the latched display data. In the precharge period, the switches 211, 212, 213, 214, 231, 233, and 241 are turned on and the switches 215, 216, 217, 218, 232, 234, 242 are turned off. FIG. 47C shows an equivalent circuit at that time. Thus, the circuit operates as a voltage follower and the data line 5 is precharged to either of VC0 to VC15 through the switch 211. At this time, the differential input transistor Q1 becomes a non-inversion input terminal and the differential input transistor Q2 becomes an inversion input terminal. The gate voltage of the drive transistor 220 becomes the power supply voltage 229*b* when the switch 213 is turned on, so that the drive transistor 220 is set to an off state and an output from the drive transistor 220 is blocked off.

In the next current drive period a, the switches 211, 212, 213, and 241 are turned off. When the switches 215, 216, and 242 are turned on, the differential input transistor Q1 becomes a non-inversion input terminal, and the differential input transistor Q2 becomes an inversion input terminal. The gradation voltage selected according to the display data is supplied to the differential input transistor Q1 and the drive circuit operates as the gradation current circuit A in the equivalent circuit shown in FIG. 47A. Because the differential amplifier 230 operates such that the voltages of the node 225 and the node 226 are same. The voltage difference ΔV between the power supply voltage 229*a* and the gradation voltage is applied to the resistance element 221 of a resistance value R, and the gradation current of J=ΔV/R is outputted to the output terminal 219.

Next, an operation will be described with reference to the timing charts of FIGS. 46A to 46J. First, in the beginning of the horizontal period, the display data is latched by the latch circuit 249. The switches 211, 212, 213, 214, 231, 233, and 241 are turned on and the switches 215, 216, 217, 218, 232, 234, and 242 are turned off in the following precharge period, like a case of FIGS. 45A to 45J, so that the data lines 205 are precharged in accordance with the latched display data.

In the next current drive period b, the switches 211, 212, 213, 214, 231, 233, and 241 are turned off and the switches 216, 217, 218, 232, 234, and 242 are turned on, unlike the current drive period a. Thus, the differential input transistor Q1 becomes the inversion input terminal, and the differential input transistor Q2 becomes the non-inversion input terminal. The gradation voltage selected according to the display data is supplied to the differential input transistor Q2, and the drive circuit operates as the gradation current circuit B in the equivalent circuit shown in FIG. 47B. Because the differential amplifier 230 operates in such a manner that the voltages of the node 225 and the node 226 are same, the voltage difference ΔV between the power supply voltage 229*a* and the gradation voltage is applied to the resistance element 221 of the resistance value R, and the gradation current of J=ΔV/R is outputted to the output terminal 219.

In this way, the differential input transistors Q1 and Q2 of the differential amplifier 230 are switched at predetermined timings in the current drive period a and the current drive period b. The gradation current of the gradation current circuit A and the gradation current circuit B shown in FIGS. 47A and 47B are supplied to the pixel 206 while they are switched every frame. Therefore, it is possible to improve in the picture quality of the display apparatus by averaging the current value deviation of the drive circuit 210 due to the offset voltage of the differential amplifier 230 with respect to time.

In the self-light-emitting type display apparatus, it is preferable to employ the structure in which the precharge voltage and the gradation current can be set independently for each of R (red), G (green), and B (the blue). The voltage generation circuits 245 and 246 may be provided for each of R, G, and B. Instead, the voltage generating circuits 245 and 246 may be shared for R, G, and B, and a setting register may be provided for each of R, G, and B such that the setting registers are switched time-divisionally.

Twelfth Embodiment

Next, the drive circuit according to the second embodiment of the present invention will be described with reference to FIG. 48. Here, a difference from the first embodiment will be described and the detailed description of the same portion as in the first embodiment will be omitted. In the first embodiment, as shown in FIG. 40, the switch 216 is provided between the output node 222 of the differential amplifier 230 and the gate of the drive transistor 220. Also, the switch 213 is provided between the gate of the drive transistor 220 and the power supply line 229*b*. Thus, the drive transistor 220 is controlled.

Figure 48:
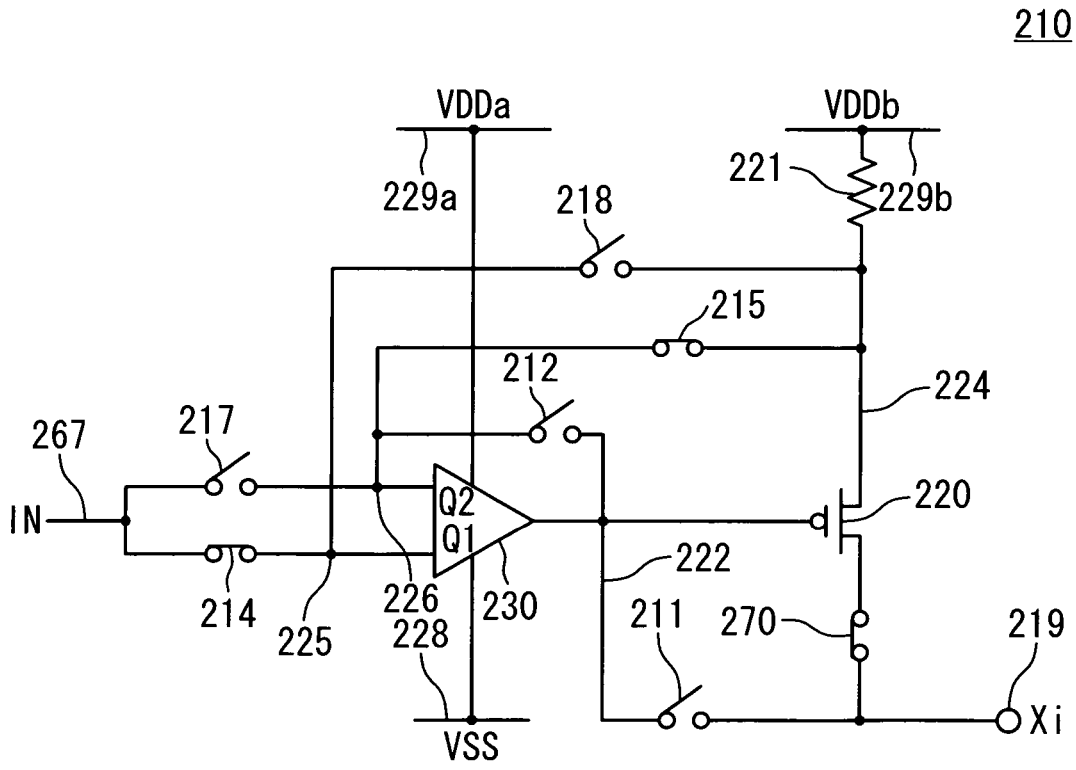
FIG. 48 is a circuit diagram showing the configuration of the drive circuit according to a second embodiment of the present invention.

On the other hand, in the second embodiment shown in FIG. 48, the switches 213 and 216 are omitted, and instead, a switch 270 is provided between the drain of the drive transistor 220 and the output terminal 219. Then, the switch 270 is controlled at the same timing as the switch 216. The switch 270 is controlled by the control unit (not shown).

Thirteenth Embodiment

Figure 49:
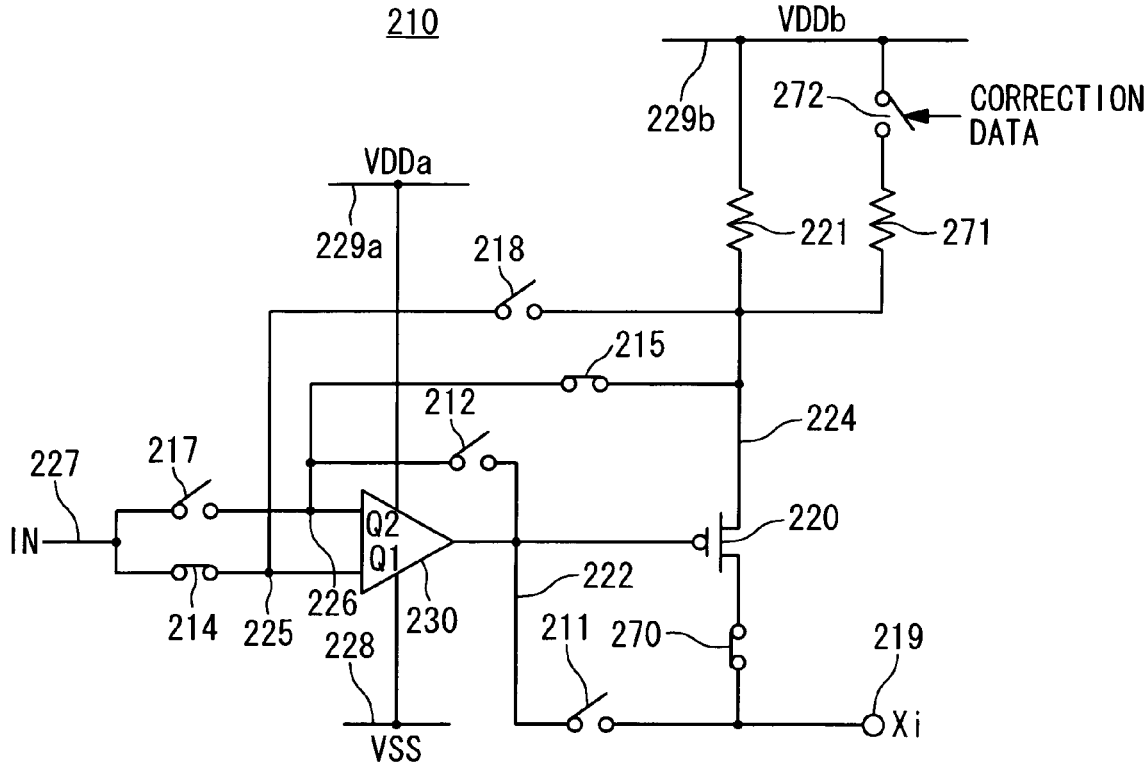
FIG. 49 is a circuit diagram showing the configuration of the drive circuit according to a third embodiment of the present invention.

Next, the drive circuit according to the third embodiment of the present invention will be described below with reference to FIG. 49. Here, a difference of the third embodiment from the first and second embodiments will be described and the detailed description of the whole of the third embodiment will be omitted, because it is similar to that of the first or second embodiment.

In the first and second embodiments, the resistance element connected with the source of the drive transistor 220 is single. On the other hand, in the third embodiment, a series circuit of a correction resistance 271 and a switch 272 is provided in parallel to the resistance element 221, and the switch 272 is controlled according to a correction data. Thus, the resistance value deviation can be corrected by using the resistance elements 221 and 271. It should be noted that the correction data may be stored in a nonvolatile memory such as rewritable EEPROM. The switch 272 is controlled by the control unit (not shown).

In the first to third embodiments, the current value deviation due to the voltage offset deviation of the differential amplifier 230 which is a cause of the current deviation is averaged with respect to time by switching the differential input transistors Q1 and Q2 temporally. Moreover, in the third embodiment, it is possible to improve the picture quality of the display apparatus by reducing a current value deviation due to the resistance value deviation by providing the correction resistance element. It should be noted that the drive circuit of the present invention can be used for a printer head driver in addition to the display apparatus.

In the present invention, the current drive circuit with monotonous increase property and a reduced current value deviation can be provided. Also, the circuit scale can be reduced by sharing the differential amplifier as a part of the constant current circuit in the precharge drive period and the current drive period.

What is claimed is:

1. A drive circuit which outputs an output signal to an output terminal, comprising:

a drive transistor configured to output a gradation current to said output terminal;

a single differential amplifier;

a resistance element connected with said drive transistor; and a plurality of switches external to said single differential amplifier and provided between the drive transistor, the single differential amplifier, and the resistance element, each being controlled such that a precharge voltage is outputted from said differential amplifier to said output terminal in a first period while blocking off an output from said drive transistor and such that a gradation current is outputted from said drive transistor to said output terminal in a second period after said first period, wherein a current value deviation due to an offset voltage deviation of said single differential amplifier is averaged for every one of a plurality of predetermined periods.

2. The drive circuit according to claim 1, wherein said differential amplifier has differential input transistors, and polarities of signals to be supplied to said differential input transistors are switched every one of said plurality of predetermined periods.

3. The drive circuit according to claim 1, wherein a first power supply line connected to said differential amplifier and a second power supply line connected to said resistance element are separated from each other.

4. A drive circuit, comprising:

an output terminal;

a differential amplifier configured to output a precharge voltage to said output terminal in response to an input signal in a first period; and a single drive transistor configured to output a gradation current to said output terminal based on an output from said differential amplifier in response to said input signal in a second period after said first period based upon selective operation of a plurality of switches external to the differential amplifier and provided between the drive transistor and the differential amplifier, wherein a current value deviation due to an offset voltage deviation of said differential amplifier is averaged for each of said first and second periods.

5. The drive circuit according to claim 4, wherein said plurality of switches includes a switch circuit configured to switch supply of first and second signals of said input signal to an inversion input and a non-inversion input in said differential amplifier every predetermined period.

6. The drive circuit according to claim 4, wherein a first power supply line connected with said differential amplifier and a second power supply line connected with said drive transistor are separated.

7. The drive circuit according to claim 4, wherein said input signal supplied to said differential amplifier in said first period is determined based on a part of bits of a display data, and said input signal supplied to said differential amplifier in said second period is determined based on all of bits of said display data.

8. The drive circuit according to claim 4, wherein said plurality of switches includes a first switch configured to prohibit an operation of said drive transistor in said first period.

9. The drive circuit according to claim 4, further comprising:

a first switch configured to disconnect said drive transistor from said output terminal in said first period.

10. The drive circuit according to claim 4, further comprising:

a first resistance element connected in series with said drive transistor; and a series circuit of a second switch and a second resistance element, said series circuit being connected in parallel to said first resistance element, wherein said second switch is controlled based on a resistance value of said first resistance element.

11. A drive method for a display apparatus, comprising:

outputting a precharge voltage from a differential amplifier to an output terminal in response to an input signal in a first period; and outputting a gradation current from a single drive transistor to said output terminal based on an output from said differential amplifier in response to said input signal in a second period after said first period, wherein a current value deviation due to an offset voltage deviation of said differential amplifier is averaged for each of said first and second periods based upon selective operation of a plurality of switches external to the differential amplifier and provided between the single drive transistor and the differential amplifier.

12. The drive method according to claim 11, further comprising:

switching supply of first and second signals of said input signal to an inversion input and a non-inversion input in said differential amplifier every predetermined period using said plurality of switches.

13. The drive method according to claim 12, wherein said input signal supplied to said differential amplifier in said first period is determined based on a part of bits of a display data, and said input signal supplied to said differential amplifier in said second period is determined based on all of bits of said display data.

14. The drive method according to claim 11, wherein powers are supplied to said differential amplifier and said drive transistor through different power supply lines, respectively.

15. The drive method according to claim 11, wherein said input signal supplied to said differential amplifier in said first period is determined based on a part of bits of a display data, and said input signal supplied to said differential amplifier in said second period is determined based on all of bits of said display data.

16. The drive method according to claim 11, further comprising: prohibiting an operation of said drive transistor in said first period.

17. The drive method according to claim 11, further comprising:

disconnecting said drive transistor from said output terminal in said first period.

18. The drive method according to claim 11, further comprising:

adjusting a resistance value of a first resistance element connected in series with said drive transistor.

19. The drive method according to claim 18, wherein the drive method is carried out by a drive circuit, which comprises the first resistance element connected in series with said drive transistor; and a series circuit of a first switch and a second resistance element, said series circuit being connected in parallel to said first resistance element, and said drive method further comprises controlling said first switch based on a resistance value of said first resistance element.

20. A drive circuit, comprising:

an output terminal; and a single drive transistor configured to output a drive current to said output terminal in response to a gate input signal, wherein one of a first voltage corresponding to a difference from a voltage of said gate input signal to a voltage of a drain of said drive transistor and a second voltage corresponding to a difference from said drain voltage to said gate input signal voltage is selected every predetermined period, and wherein the selected voltage is supplied to said drive transistor as the gate input signal, and the drive circuit selectively functions as each of a voltage follower circuit, a first-type constant current source circuit, and a second-type constant current source circuit different from the first-type based upon selective operation of a plurality of switches that provide said gate input signal.

* * * * *